US006910815B2

(12) United States Patent
Nozawa et al.

(10) Patent No.: US 6,910,815 B2
(45) Date of Patent: Jun. 28, 2005

(54) PHOTOSENSITIVE MATERIAL PROCESSING APPARATUS

(75) Inventors: Ryoei Nozawa, Kanagawa (JP); Shinichi Matsuda, Kanagawa (JP); So Konno, Kanagawa (JP); Yasuhiro Endo, Kanagawa (JP); Hideaki Iijima, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/252,364

(22) Filed: Sep. 24, 2002

(65) Prior Publication Data

US 2003/0086710 A1 May 8, 2003

(30) Foreign Application Priority Data

Sep. 27, 2001 (JP) ..... 2001-296486
Sep. 27, 2001 (JP) ..... 2001-296487
Sep. 27, 2001 (JP) ..... 2001-296493
Sep. 27, 2001 (JP) ..... 2001-296494
Sep. 27, 2001 (JP) ..... 2001-296496

(51) Int. Cl.[7] ..... G03D 5/00

(52) U.S. Cl. ..... 396/602; 396/604; 396/606; 396/626

(58) Field of Search ..... 396/602, 604, 396/606, 626; 355/27–29; 134/64 P, 64 R, 122 P, 122 R

(56) References Cited

U.S. PATENT DOCUMENTS 4,533,225 A * 8/1985 Shiga ..... 396/622
5,349,413 A * 9/1994 Ohishi et al. ..... 396/626
5,387,499 A * 2/1995 Earle et al. ..... 396/626
5,479,233 A * 12/1995 Takekoshi et al. ..... 396/626
5,568,220 A * 10/1996 Joos et al. ..... 396/626
5,845,169 A * 12/1998 Patton et al. ..... 396/627
6,604,869 B1 * 8/2003 Davis et al. ..... 396/626

OTHER PUBLICATIONS

Verlinden et al., Method of Supplying Processing Liquid to a Photographic Procssing Machine and Removing Waste Liquid Therefrom, Reserch Disclosure 408110, Apr. 1998, pp. 425–428.*

* cited by examiner

*Primary Examiner*—D. Rutledge
(74) *Attorney, Agent, or Firm*—Sughrue Mion, PLLC

(57) ABSTRACT

The present invention provides a photosensitive material processing apparatus in which a photosensitive material is processed with a processing solution. Reliable liquid displacement in the vicinity of the surface of a photosensitive material, and uniform temperature adjustment can be performed. Also, damage or a transport deficiency, caused by a corner of the material coming into a through hole when a conveyance path of the photosensitive material is formed can be prevented. When pre-washing processing is carried out prior to development processing using a developer, processing unevenness in which an overcoat layer partially remains can be prevented. An operation of mounting and removing conveyance rollers disposed in a pair is facilitated and a proper nipping force can be imparted between a conveyance roller pair. Mounting of a replenisher case filled with a replenisher is facilitated and a replenisher is kept from remaining in piping or in a replenisher case.

10 Claims, 27 Drawing Sheets

PHOTOSENSITIVE MATERIAL PROCESSING APPARATUS

BACKGROUND OF THE INVENTION

1. Field of the Invention

The present invention relates to a photosensitive material processing apparatus in which a photosensitive material is immersed in a processing solution stored in a processing tank.

2. Description of the Related Art

In a photosensitive material processing apparatus such as an automatic processor, a photosensitive material exposed imagewise is processed (developed or the like) with a processing solution by immersing the photosensitive material in a processing solution or spraying a surface of the photosensitive material with a processing solution while the photosensitive material is being conveyed.

In a presensitized plate (PS plate) processor which is an automatic processor for processing a photosensitive planographic printing plate (hereinafter referred to as a "presensitized (PS) plate"), that is, a photosensitive material in which a photosensitive layer is provided on a support such as an aluminum plate, in addition to a development process in which a PS plate exposed imagewise is immersed in a developer, a washing process in which a PS plate having been subjected to development processing is washed by blowing washing water against front and back surfaces of the PS plate, a desensitizing process in which desensitizing processing is carried out in such a manner that the front and back surfaces of the PS plate having been subject to washing processing are coated with a desensitizer such as a gum solution, and the like are provided.

In some of such PS plate processors as well, a heater is provided in a developer tank so that a developer in the developer tank is heated to a temperature in a temperature range in which PS plates are most suitably processed. At this time, in the PS plate processor, a developer in the developer tank is circulated and agitated by being sucked and jetted out from a spray pipe disposed in the developer by way of a circulating pump so that the temperature of developer in the developer tank becomes uniform.

In order that development processing for PS plates may be efficiently carried out so that the same product quality could be obtained, it is necessary to attempt liquid displacement in which a fresh developer is supplied to the surface of a PS plate conveyed in the developer and a fatigued developer is removed from vicinities of the surface of the PS plate.

However, there is a problem that reliable liquid displacement in the vicinities of the surface of the PS plate is difficult to carry out in a system in which a developer is simply made to jet out from a spray pipe disposed in a developer tank. Further, the developer flow is divided into upper and lower sides of a conveyance path by the PS plate conveyed in the developer tank, thereby making it difficult to control the temperature of the developer with high accuracy.

The present invention has been achieved in view of the aforementioned circumstances, and a first object of the present invention is to provide a photosensitive material processing apparatus in which, when a photosensitive material is processed by being immersed in a processing solution while the temperature of the processing solution is being adjusted, reliable liquid displacement in vicinities of the surface of the photosensitive material, and uniform temperature adjustment of the processing solution are made possible.

In the PS plate processor as described above, a conveyance path is formed using a guide plate and a PS plate is guided along the upper surface of the guide plate. Due to the guide plate being curved so that a surface thereof facing the conveyance path of the PS plate becomes concave, or the guide plate being formed by connecting a plurality of flat surfaces, a conveyance path having a downwardly convexed surface can be formed.

In the PS plate processor as well, it is necessary that a fresh developer may be supplied to front and back surfaces of the PS plate to allow uniform development processing for the PS plate. To that end, the guide plate is formed so as to have a through hole passing through from front to back surfaces thereof like punching metal, so as to allow a fresh developer at a lower side of the guide plate to be supplied to the side of the conveyance path of the PS plate.

However, when a through hole is formed on a guide plate with which the PS plate is brought into contact when the PS plate is moved, a corner at a widthwise-direction edge of the leading end of the PS plate tends to be pulled in the through hole, thereby causing damage to the PS plate (for example, bending) or transport deficiency.

The present invention has been achieved in view of the aforementioned circumstances, and a second object of the present invention is to provide a guide plate for conveying a photosensitive material, which prevents damage to a photosensitive material such as a printing plate and transport deficiency, which damage and transport deficiency are caused by a corner of the photosensitive material being pulled in a through hole when a conveyance path of the photosensitive material is formed.

In the PS plate processor as described above, a light receiving portion and a non-receiving portion are formed by exposure on a photosensitive layer, and thereafter, development processing is carried out by means of a developer. As a result, an unnecessary photosensitive layer is removed and an image is formed.

As for a photosensitive planographic printing plate, a so-called four-layer photopolymerization plate is used in which a photosensitive layer is formed on a support by a light adhesive layer, a photopolymerization layer or the like, and the surface of the printing plate is protected by an overcoat layer. This photopolymerization plate is heated to a predetermined temperature so that a photopolymerization layer of the light receiving portion is firmly adhered to a support via a light adhesive layer to improve printing resistance. Further, an overcoat layer which covers the photopolymerization layer is dissolved in water.

When the photopolymerization plate is subjected to development processing, a pre-heating process and a pre-washing process are provided before an automatic processor or prior to a developing process. The photopolymerization plate is heated prior to development processing, and thereafter, the surface of the photopolymerization plate is brushed while washing water is being supplied thereto, so that an overcoat layer removed. As a result, a photopolymerization layer of a non-receiving portion can be reliably removed at the time of development processing.

When such photopolymerization plates are subjected to development processing, an overcoat layer needs to be reliably removed prior to processing with a developer. To that end, in the pre-washing process, water is supplied from a spray pipe to the surface of the photopolymerization plate to swell the overcoat layer, and thereafter, the surface of the photopolymerization plate is brushed with a brush roller. As a result, the overcoat layer is swollen with and dissolved in washing water, and is easily peeled off.

The solubility and peeling property of the overcoat layer are greatly influenced by the period of time in which washing water adheres to the overcoat layer. The shorter this period of time, the worse the solubility and peeling property becomes. In the pre-washing process, it is necessary that brushing using a brush roller is carried out at least three seconds after water is supplied to the surface of the photopolymerization plate.

For this reason, there is proposed a structure in which a horizontal conveyance path of a photopolymerization plate is provided in the pre-washing process and washing water supplied from a spray pipe disposed immediately before a brush roller is jetted out toward the photopolymerization plate.

Although, in the pre-washing process carried out in the structure as described above, improvement in solubility and peeling property of the overcoat layer can be achieved in an intermediate portion of the photopolymerization plate in the conveying direction, washing water is apt to run down from ends of the photopolymerization plate in the conveying direction, particularly, a leading end thereof, and washing water cannot stay thereat for a required time. As a result, the solubility and peeling property of the overcoat layer are deteriorated. Further, washing water is apt to adhere unevenly to the ends of the photopolymerization plate and the overcoat layer is unevenly removed therefrom. As a result, when development processing of a photopolymerization plate is carried out, a remaining overcoat layer may cause a partial delay in development.

Such delay in development has a great influence on a finished state of a developed photopolymerization plate and may eventually be reflected in the quality of a printed matter obtained using this photopolymerization plate.

The present invention has been achieved in view of the aforementioned circumstances, and a third object of the present invention is to provide a preprocessing apparatus which prevents occurrence of processing unevenness caused by a partially remaining overcoat layer when pre-washing processing is carried out prior to development processing using a developer.

In the PS plate processor as described above, when a PS plate is conveyed, the PS plate is nipped by conveyance rollers (hereinafter referred to as a "conveyance roller pair") which are disposed in a pair with a conveyance path of a PS plate interposed therebetween. The pair of conveyance rollers are rotatingly driven in a predetermined direction, whereby a conveying force is applied to the PS plate. Further, the conveyance roller pair are disposed at a downstream side of the processing process, whereby a processing solution used in the processing process is squeezed out from the surface of the PS plate.

As for a structure for imparting nipping force to the conveyance roller pair, various structures, for example, a structure in which a roller bearing for supporting a lower conveyance roller is held at a predetermined position and a roller bearing for supporting an upper conveyance roller is urged toward the bearing of the lower conveyance roller, can be used.

When processing for the PS plate is started in a state in which a predetermined nipping force is not imparted between the conveyance roller pair, transport deficiency of the PS plate may be caused. That is, when urging force between the conveyance roller pair disposed to face each other is not sufficient, when the PS plate is fed in between the conveyance roller pair, slippage occurs between the conveyance roller pair and the PS plate. As a result, there arises a problem that conveying force cannot be imparted to the PS plate.

Further, when the PS plate is nipped by the conveyance roller pair, it is necessary that a large nipping force may be imparted to squeeze out a processing solution adhering to the surface of the PS plate. For this reason, when the conveyance roller pair is removed/attached for the purpose of maintenance or the like, an operation resistible to a large urging force must be carried out. Such a troublesome operation of removing/attaching the conveyance roller pair complicates the maintenance of a PS plate processor.

The present invention has been achieved in view of the aforementioned circumstances, and a fourth object of the present invention is to provide a photosensitive material processing apparatus in which an operation of removing conveyance rollers disposed in a pair, or attaching the conveyance rollers so that the rollers are disposed in a pair is facilitated and a photosensitive material such as a PS plate can be processed with nipping force being properly imparted thereto between the conveyance roller pair.

In the PS plate processor as described above, processing performance of a processing solution stored in a processing tank is maintained in a range in which a PS plate can be properly finished, by replenishing a replenisher in accordance with a quantity of PS plates to be processed (processing replenishment) or by replenishing a replenisher in accordance with an elapsed time (age-based replenishment).

The PS plate processor is provided with a replenisher tank in which a replenisher is stored. The replenisher tank is provided so as to replenish a replenisher for a processing tank by operating a replenisher pump at a predetermined timing. Further, when a replenisher in the replenisher tank is reduced due to a replenisher being replenished for a processing tank, a fresh replenisher needs to be supplied to the replenisher tank.

The replenisher to be supplied to the replenisher tank is contained in a replenisher case. In the PS plate processor, a piping extending from the replenisher tank is connected to a cap provided in the replenisher case, and thereafter, the replenisher case is turned upside down to allow a replenisher to run down from the replenisher case to the replenisher tank.

However, when the replenisher case is turned upside down in a state in which the piping is connected thereto, breakage or unnatural bending occurs in the piping. As a result, there is a possibility that a replenisher may not reliably run down into the replenisher tank and may remain in the piping or replenisher case.

Further, the operation of mounting the replenisher case filled with the replenisher at a lower side of the apparatus while turning the replenisher case upside down is troublesome because an operator's working posture is not easy and this operation needs to be carried out at a high position.

The present invention has been achieved in view of the aforementioned circumstances, and a fifth object of the present invention is to provide a photosensitive material processing apparatus in which a replenisher case filled with a replenisher is easily mounted and a state in which a replenisher remains in a piping or replenisher case can be prevented.

SUMMARY OF THE INVENTION

In order to achieve the aforementioned first object of the invention, a first aspect of the present invention is a photosensitive material processing apparatus comprising: first blowing means provided adjacent to a photosensitive material conveyance path at a section thereof along which a photosensitive material is conveyed diagonally downward with respect to a surface of a processing solution while being immersed in the processing solution stored in a processing tank, the first blowing means jetting out the processing solution supplied thereto along a direction orthogonal to a conveying direction of the photosensitive material; second blowing means provided adjacent to the photosensitive material conveyance path at a section thereof along which the photosensitive material is conveyed diagonally upward with respect to the surface of a processing solution while being immersed in a processing solution stored in a processing tank, so that a longitudinal direction of the second blowing means coincides with a widthwise direction of the photosensitive material, the second blowing means jetting out the processing solution supplied thereto, from holes formed along the longitudinal direction of the second blowing means toward a downstream side in the conveying direction of the photosensitive material; and circulating means for circulating a processing solution by sucking in, the processing solution within the processing tank, from a suction hole formed at a predetermined position in the processing tank and supplying the sucked processing solution to the first blowing means and the second blowing means.

In accordance with the first aspect, a processing solution is circulated in such a manner that a processing solution in the processing tank is sucked in from a suction hole by circulating means and is jetted out by the first and second blowing means into the processing solution in the processing tank.

At this time, the first blowing means jets out the processing solution at the upstream side of the processing tank along a direction orthogonal to the conveying direction, thereby allowing the processing solution to flow along a widthwise direction of the photosensitive material conveyed through a conveyance path. Accordingly, a large quantity of processing solution is supplied to the surface of the photosensitive material in the early stage of processing using a processing solution, and a variation in the temperature of the processing solution caused by an inserted photosensitive material is lessened. As a result, the photosensitive material can be processed substantially evenly.

Further, the second blowing means jets out a processing solution to a downstream side in the conveying direction at a downstream portion of the processing tank so as to form a flow of processing solution along the conveying direction in the vicinity of the surface of the photosensitive material.

Accordingly, in the final stage of processing using a processing solution, having an influence on finish of the photosensitive material, a flow of processing solution along the conveying direction of the photosensitive material is formed and no processing solution in a relatively fatigued stage is stored. Therefore, no finish unevenness occurs.

Particularly, when the processing solution is jetted out toward the photosensitive material, the jetted processing solution is directly applied to the photosensitive material to cause processing unevenness. However, the aforementioned second blowing means is provided so as to jet out the processing solution from the horizontal direction substantially to the lower side (that is, the blowing hole formed in the second blowing means is formed so that the opening thereof is directed diagonally to the lower side). Therefore, the jetted developer is turned back from the bottom or the tank wall of the developing tank to form a flow along the conveying direction of the photosensitive material. As a result, such processing unevenness can be prevented.

In the first aspect, the suction hole is preferably provided at the bottom of the processing tank between the first and second blowing means.

By providing the suction hole used to circulate the processing solution between the first and second blowing means so that the processing solution is not jetted out toward the suction hole, relatively fresh processing solution jetted out from the first and second blowing means can be kept from being drawn into the suction hole and circulated by the circulating means.

The suction hole is preferably formed at the bottom of the tank, but the present invention is not limited to the same. So long as the processing solution jetted out from the first and second blowing means is not directly drawn in, the suction hole may be provided at an arbitrary position on a wall of the processing tank, or the like.

Further, in the present invention, when temperature adjustment means is provided for maintaining the temperature of the processing solution in a predetermined temperature range, flow-rate control means is also provided for regulating the quantity of processing solution jetted out from the first blowing means, to be larger than the quantity of processing solution jetted out from the second blowing means.

According to the present invention, the flow-rate control means is provided so as to jet out a large quantity of processing solution from the first blowing means at the upstream side of the conveyance path.

As a result, a large quantity of processing solution is supplied to the surface of the photosensitive material in the early stage of processing and processing using a processing solution can be facilitated. The temperature of a photosensitive layer on the surface of the photosensitive material at the upstream side of the conveyance path and the temperature of the processing solution are generally greatly different from each other. However, as the quantity of processing solution jetted out from the first blowing means is increased as described above, the temperature of the photosensitive layer on the surface of the photosensitive material can be promptly made equal to the temperature of the processing solution. As a result, the photosensitive material can be processed with a processing solution set at a substantially uniform temperature.

In order to achieve the aforementioned second object of the present invention, a second aspect of the present invention is a photosensitive material processing apparatus comprising a guide plate for conveying a photosensitive material, by which the photosensitive material which is being conveyed is guided, wherein the guide plate comprises: a guide main body whose one surface faces a conveyance path of the photosensitive material; and through holes formed so as to pass through between front and back surfaces of the guide main body, an angle formed between a direction through which the through holes pass and a conveying direction of the photosensitive material being an acute angle.

In accordance with the second aspect, for example, when the through hole is formed as a circular hole, the axial line of the circular hole coincides with a direction through which the hole passes. At this time, in the present invention, an angle formed by the direction through which the through hole passes, and the conveying direction of the photosensitive material guided along a surface of the guide main body adjacent to the conveyance path makes an acute angle.

As a result, in this aspect, even if a corner of the photosensitive material comes into the through hole, it is guided or brought by the internal surface of the through hole to the surface of the guide main body adjacent to the conveyance path. Accordingly, damage to the photosensitive material or transport deficiency caused by the corner of the photosensitive material coming into and being caught in the through hole can be reliably prevented.

In this aspect, an angle $\alpha$ formed between a guide surface of the guide main body adjacent to the conveyance path of the photosensitive material and the photosensitive material abutting against the guide surface, and an angle $\beta$ formed between the guide surface and an internal surface of the through hole at a downstream side in the conveying direction of the photosensitive material are set so as to satisfy $\alpha+\beta<90°$.

Further, in this aspect, a hole width d as the inner diameter of the through hole along the conveying direction of the photosensitive material is set based on a plate thickness t of the guide main body between front and back surfaces thereof, and the angles $\alpha$ and $\beta$.

As a result, the through hole can be formed so as to keep the corner of the photosensitive material coming into the through hole from protruding from the through hole to the rear surface of the guide main body, and damage to the photosensitive material and transport deficiency can be more reliably prevented.

In order to achieve the third object of the present invention, a third aspect of the present invention is a photosensitive material processing apparatus including a preprocessing device which preprocesses a planographic printing plate exposed imagewise, prior to development processing, the preprocessing device comprising: a dampening member having a water holding property and provided along a widthwise direction of the planographic printing plate, an end of the dampening member protruding toward a conveyance path of the planographic printing plate being provided so as to abut against the planographic printing plate substantially evenly along the widthwise direction of the printing plate; a spray pipe extending so that a longitudinal direction thereof coincides with the widthwise direction of the planographic printing plate and having holes formed therein along the longitudinal direction of the spray pipe, the spray pipe being provided so as to jet out washing water from the holes toward the dampening member; and a brush roller disposed at a downstream side of the dampening member and the spray pipe in the conveying direction and provided so as to brush the surface of the planographic printing plate to which the washing water is supplied.

In accordance with the third aspect, the dampening member is disposed at the upstream side of the brush roller so as to protrude toward the conveyance path of the planographic printing plate, and abuts against the planographic printing plate, conveyed toward the brush roller, along the widthwise direction of the planographic printing plate. Further, the spray pipe jets out washing water toward the dampening member.

As a result, the dampening member is dampened by washing water jetted out from the spray pipe and the planographic printing plate abuts against the wet dampening member, thereby allowing washing water to be uniformly supplied to the surface of the planographic printing plate along the widthwise direction of the planographic printing plate.

At this time, the dampening member protrudes toward the conveyance path of the planographic printing plate. Therefore, washing water is reliably supplied not only to an intermediate portion of the planographic printing plate in the conveying direction, but also to a leading end or a trailing end thereof, and thereafter, the surface of the planographic printing plate can be brushed with the brush roller.

Accordingly, even when an overcoat layer is removed from the surface of the planographic printing plate, the overcoat layer can be reliably kept from remaining at the leading or trailing end of the planographic printing plate. When the planographic printing plate is subjected to development processing, no developer streak is formed.

Further, in the third aspect, a flow-straightening plate may be further provided which is disposed adjacent to the dampening member so that a longitudinal direction thereof coincides with a longitudinal direction of the dampening member and one end side in the widthwise direction thereof is inclined to face the dampening member, the flow-straightening plate being provided so as to allow washing water jetted out from the spray pipe to run down toward the dampening member while diffusing the washing water along the longitudinal direction thereof.

In this case, so long as washing water is jetted out from the spray pipe to the flow-straightening plate, the flow-straightening plate supplies the washing water to the dampening member while diffusing the washing water along the longitudinal direction thereof, that is, the widthwise direction of the planographic printing plate.

As a result, washing water can be reliably supplied to an entire region of the dampening member in the longitudinal direction thereof, and washing water can be supplied evenly to an entire surface of the planographic printing plate along the widthwise direction thereof.

Further, in the third aspect, the conveyance path of the planographic printing plate may be inclined so that the position at which the brush roller is provided is lower than the position at which the dampening member is provided.

In this case, the planographic printing plate is conveyed at least between the dampening member and the brush roller so that the position at which the brush roller is provided becomes lower than the position at which the dampening member is provided. As a result, washing water supplied from the dampening member can be made to stay on the surface of the planographic printing plate between the dampening member and the brush roller, and therefore, the surface of the planographic printing plate can be brushed with the brush roller in a state of being sufficiently dampened.

In the third aspect, a channel brush is preferably used as the dampening member. As a result, washing water can be supplied evenly to the surface of the planographic printing plate along the widthwise direction thereof. In the present invention, so long as desired rubbing efficiency is obtained, a rubbing member having an arbitrary structure can be used.

In order to achieve the aforementioned fourth object, a fourth aspect of the present invention is a photosensitive material processing apparatus comprising: conveyance rollers disposed in a pair with a conveyance path of a photosensitive material interposed therebetween, for conveying the photosensitive material in a processing section for carrying out processing with a processing solution stored therein while nipping the photosensitive material therebetween; and a roller-nip adjustment device in which an operation of mounting and removing the conveyance rollers, and an operation of imparting and releasing nipping force for the rollers are carried out, the roller-nip adjustment device comprising: a bearing supporting portion disposed at a predetermined position on a pair of side plates provided so as to face each other at both sides in a widthwise direction of the photosensitive material orthogonal to the conveying direction thereof; a bearing accommodating portion disposed in the bearing supporting portion to prevent downward movement of a first bearing which supports a lower conveyance roller, and accommodating a second bearing which supports an upper conveyance roller so that the second bearing can move close to and apart from the first bearing; a presser member disposed at a predetermined position in the bearing supporting portion so as to be moved between a position at which the presser member keeps each of the first and second bearings accommodated in the bearing accommodating portion from being pulled out from the bearing accommodating portion, and a position at which the presser member can pull out the first bearing and the second bearing from the bearing accommodating portion, the presser member being provided so as to urge the second bearing by urging force of urging means formed therein at the position at which the pullout is prevented, thereby allowing a predetermined nipping force to be imparted between the upper and lower conveyance rollers; and a mounting lever provided swingably in the presser member and applying urging force of the urging means to the first bearing in a state in which the mounting lever is inclined lower from an upright position at which an end of the lever is turned upward.

In the fourth aspect, the first and second bearings for supporting upper and lower conveyance rollers, respectively, are accommodated in the bearing accommodating portion of the bearing supporting portion mounted in the side plates. In a state in which pullout of the first and second bearings from the bearing accommodating portion is prevented by the presser member, the mounting lever is inclined. As a result, urging force of urging means provided in the presser member is imparted, as nipping force for nipping the photosensitive material, to between the upper and lower conveyance rollers via the first bearing.

Further, as the inclined mounting lever being lifted up to an upright position, nipping force imparted between the conveyance rollers is released, and the presser member is allowed to retreat to a position at which the first and second bearings can be pulled out from the bearing accommodating portion.

As described above, it is possible to carry out an operation of imparting nipping force to between the conveyance rollers and releasing the nipping force, by using a simple operation, that is, a swinging operation of the mounting lever. Further, mounting and removal of the conveyance rollers can be carried out, and maintenance of a conveyance roller pair which forms a conveyance path of the photosensitive material is facilitated.

Further, in the fourth aspect, an apparatus casing in which the processing section is provided, and a cover which closes an upper side of the apparatus casing, may be further provided, and when the mounting lever is set upright with an end thereof turned upward, the end of the mounting lever abuts against the cover to lift up the cover from a position at which the cover closes an interior of the apparatus casing.

When the mounting lever is set at an upright position, the mounting lever abuts against and lifts up the cover. As a result, based on whether the cover is mounted in a normal state or not, it can be clearly determined whether or not a predetermined nipping force is being imparted between a conveyance roller pair. Therefore, a state in which the photosensitive material is processed with no predetermined nipping force being imparted between a conveyance roller pair can be reliably prevented.

Further, some photosensitive material processing apparatuses are each provided with an interlock mechanism which allows processing of a photosensitive material only when the cover is mounted in a normal state. When the interlock mechanism is used, the photosensitive material can be processed only when the photosensitive material can be reliably nipped by the conveyance roller pair. Accordingly, it is possible to reliably prevent transport deficiency or damage to the photosensitive material, which results from that the photosensitive material is processed without being nipped by the conveyance roller pair.

In order to achieve the aforementioned fifth object of the present invention, a fifth aspect of the present invention is a photosensitive material processing apparatus comprising: a photosensitive material processing section which is provided above an apparatus casing and in which a photosensitive material is processed with a processing solution, or a photosensitive material is processed with a processing solution and subjected to drying processing; a trolley which can be moved between a position within a space provided in the apparatus casing and below the photosensitive material processing section, and a position to which the trolley is pulled out from the apparatus casing; a replenisher tank disposed on the trolley and accommodating a replenisher of a processing solution used for processing of the photosensitive material; and a replenisher pump used to supply a replenisher filled in the replenisher tank to a processing tank.

In accordance with the fifth aspect, the trolley with the replenisher tank mounted thereon is moved into a space provided in the apparatus casing so that the replenisher tank is loaded in the apparatus casing. When the trolley is pulled out from the apparatus casing, the replenisher tank can be pulled out from the apparatus.

Accordingly, when a replenisher is supplied to the replenisher tank, the operation therefor can be carried out at an outer side of the apparatus casing. As a result, supply of a replenisher becomes extremely facilitated.

Further, in the fifth aspect, a mounting portion, in which a replenisher case having a substantially rectangular box-shaped configuration and filled with the replenisher is mounted, is formed on the replenisher tank, and the replenisher case can be inserted between the replenisher tank and the photosensitive material processing section when the trolley is moved to a predetermined position in the apparatus casing.

That is, a replenisher case filled with a replenisher may be mounted on the replenisher tank.

As a result, the replenisher case is mounted on the replenisher tank and a replenisher is made to run down from the replenisher case to the replenisher tank. Therefore, an operation of supplying a replenisher to the replenisher tank becomes easy. Further, the trolley is moved with the replenisher case mounted on the replenisher tank, and can be loaded in the apparatus casing. Therefore, the time for the operation of supplying a replenisher to the replenisher tank can be shortened. That is, it suffices that the replenisher case may be loaded in the apparatus casing so that the replenisher runs down from the replenisher case to the replenisher tank. A waiting time until the total quantity of replenisher in the replenisher case flows into the replenisher tank is no longer required.

Further, in the fifth aspect of the present invention, a nozzle provided in the replenisher tank and connected to an outlet opening of the replenisher case by a flexible tube is supported swingably by a holder provided in an inlet opening of the replenisher tank.

That is, the nozzle is swingably mounted to the holder provided at the inlet opening of the replenisher tank, and the flexible tube connected to the nozzle is connected to a replenisher outlet opening of the replenisher case. In this case, when the replenisher case is inverted and mounted on the replenisher tank, the nozzle swings to prevent breakage of the flexible tube. Accordingly, it is possible to reliably prevent a state in which a replenisher remains in the replenisher case due to breakage of the flexible tube, or the like.

DESCRIPTION OF THE PREFERRED EMBODIMENTS

[First Embodiment]

Figure 1:
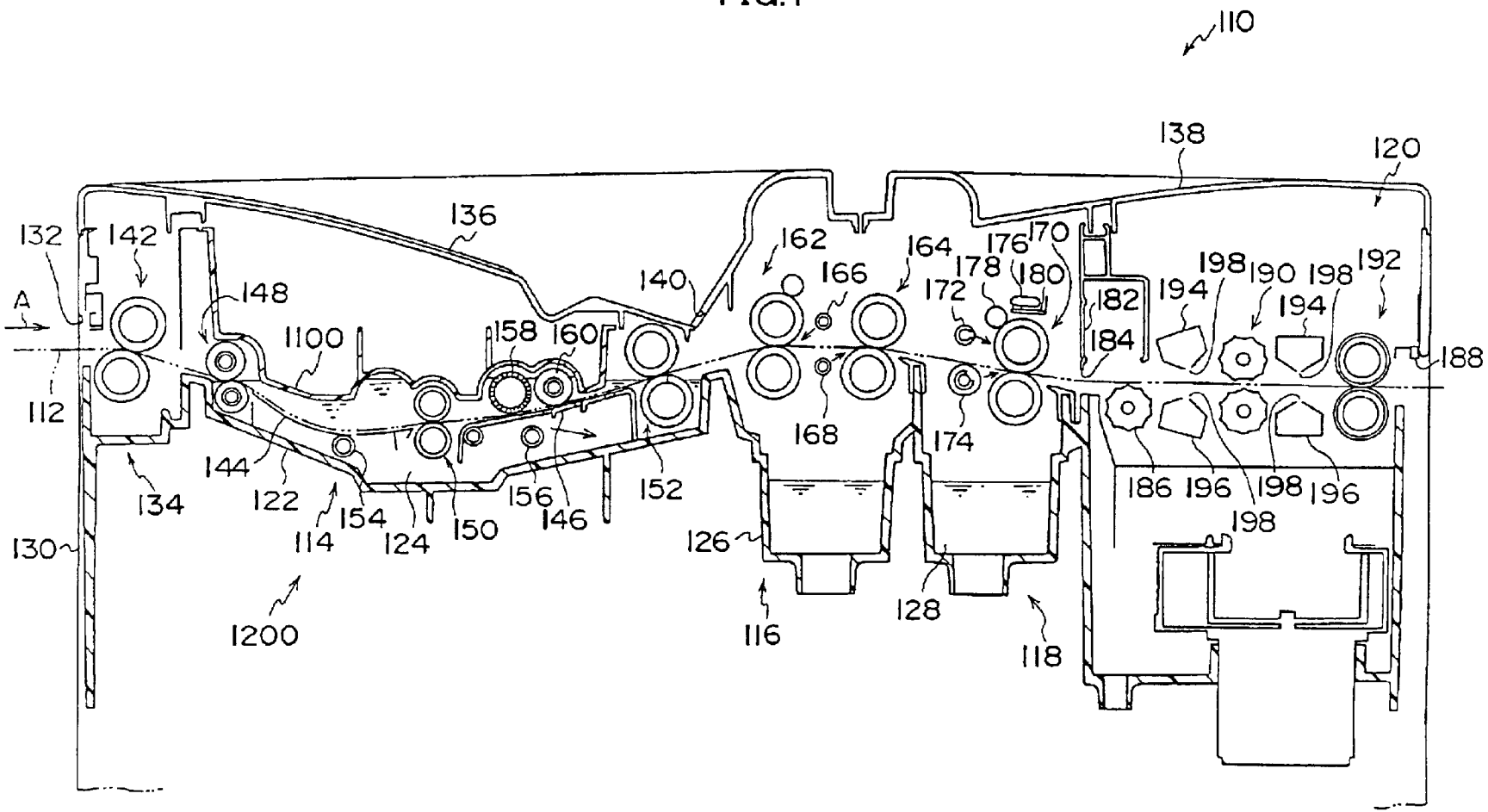
FIG. 1 is a schematic structural diagram of a PS plate processor applied to a first embodiment of the present invention.

A description will be hereinafter given of a first embodiment of the present invention with reference to the attached drawings. FIG. 1 schematically shows the structure of a photosensitive planographic printing plate processing apparatus (hereinafter referred to as a "PS plate processor 110") applied as an example of photosensitive material processing apparatus. The PS plate processor 110 carries out processing for a photosensitive planographic printing plate (hereinafter referred to as a "PS plate 112"), which has been exposed imagewise as a photosensitive material using an exposing device (not shown), with a processing solution. The PS plate 112 is formed in such a manner that a thin-walled rectangular flat plate such as an aluminum plate is formed as a support and a photosensitive layer is formed on the support. As for the PS plate 112, a photopolymerization plate can be applied in which a photosensitive layer is formed by a light adhesive layer, a photopolymerization layer and an overcoat layer in an overlapping state, and is exposed imagewise to laser light to accelerate a polymerization reaction in an image portion of the photopolymerization layer.

The PS plate processor 110 is provided with a developing section 114 in which the PS plate 112 is processed with a developer, a washing section 116 in which the PS plate 112 processed with a developer is washed with washing water, a desensitizing section 118 in which the washed PS plate 112 is coated with a gum solution for protecting a printing plate and desensitized, and a drying section 120 for drying the PS plate 112. That is, in the PS plate processor 110, a developing process, a washing process, a desensitizing process and a drying process are provided in this order in a direction in which the PS plate 112 is conveyed (which direction is indicated by arrow A in FIG. 1).

A processing tank 122 is provided in the PS plate processor 110. The processing tank 122 includes a developing tank 124 formed at a position in which the developing section 114 is located, a washing tank 126 formed at a position in which the washing section 116 is located, and a desensitizing tank 128 formed at a position in which the desensitizing section 118 is located.

A slit-shaped insertion opening 132 is formed on an outer panel 130 which covers the processing tank 122, and an insertion portion 134 is formed in the processing tank 122 between the insertion opening 132 and the developing section 114.

The PS plate processor 110 is provided with covers 136 and 138 which cover the upper side of the processing tank 122 and the upper side of the drying section 120, respectively. The cover 136 at the side of the insertion opening 132 is disposed so as to cover an upper side of a region from the insertion portion 134 to the washing section 116 in the processing tank 122. The cover 138 is disposed so as to cover an upper side of a region from the washing section 116 to the drying section 120.

The cover 136 includes an insertion opening for reentry (an auxiliary insertion opening) 140 in which the PS plate 112 is inserted between the developing section 114 and the washing section 116. The auxiliary insertion opening 140 is used to insert therein the PS plate 112 when the PS plate processor 110 is to be processed at a section other than the developing section 114.

A conveyance roller pair 142 made of rubber is disposed in the insertion portion 134 adjacent to the insertion opening 132. The PS plate 112 on which an image is printed is inserted from the insertion opening 132 along the direction indicated by arrow A and sent into between the conveyance roller pair 142.

When the conveyance roller pair 142 is driven to rotate, the PS plate 112 is pulled in from the insertion opening 132 and sent into the developing section 114 at a conveying angle of about 15 to 31 degrees with respect to the horizontal direction. In the present embodiment, a single-sided PS plate 112 with a photosensitive layer being formed on a support at one surface thereof is used. The PS plate 112 is inserted from the insertion opening 132 into the PS plate processor 110 in a state in which the photosensitive layer faces upward.

The developing tank 124 formed in the processing tank 122 is constructed so that the bottom center thereof protrudes downward to have a substantially mountain-shaped configuration, and a developer used for development processing of the PS plate 112 is stored in the developing tank 124. The developing tank 124 is provided with guide plates 144 and 146 at a lower side thereof (along the base thereof) and along a direction in which the PS plate 112 is conveyed. In the developing tank 124, conveyance roller pairs 148, 150 and 152 are provided at an upstream side (at the side of the insertion portion 134) and midstream and downstream sides (at the side of the washing section 116), in addition to the guide plates 144 and 146.

The PS plate 112 pulled in by the conveyance roller pair 142 from the insertion opening 132 is sent into between the conveyance roller pair 148. The conveyance rollers 148 pulls the PS plate 112 in the developing tank 124 and conveys the same onto the guide plate 146.

The guide plate 144 is disposed between the conveyance roller pairs 148 and 150, and guides the PS plate 112 conveyed by the conveyance roller pair 148 toward the conveyance roller pair 140 diagonally to the lower side. Further, the guide plate 146 is disposed between the conveyance roller pairs 150 and 152, and guides the PS plate 112 conveyed by the conveyance roller pair 150 along the bottom of the developing tank 124 diagonally to the upper side.

As a result, the PS plate 112 is immersed in a developer while being guided and conveyed in the developing tank 124 along the substantially U-shaped conveyance path.

The conveyance roller pair 152 is formed by rollers of which outer peripheries are made of rubber, and is provided so as to pull out the PS plate 112 from the developing tank 124 by nipping the PS plate 112 guided by the guide plate 146, and convey the same to the washing section 116. At this time, the conveyance roller pair 152 sends out the PS plate 112 while squeezing out a developer from the PS plate 112 pulled out from the developing tank 124.

In the developing tank 124, spray pipes 154 and 156 are provided at the side of lower surfaces of the guide plates 144 and 146, respectively. Further, a large number of through holes (not shown) are formed on each of the guide plates 144 and 146.

The spray pipes 154 and 156 are each provided so as to jet out a developer when a developer stored in the developing tank 124 is supplied to the spray pipes via circulating means (described later). As a result, the developer in the developing tank 124 is agitated so that the PS plate 112 can be uniformly processed. At this time, due to the developer flowing from the through holes formed in the guide plates 144 and 146 toward the conveyance path of the PS plate 112, rapid development processing of the PS plate 112 is realized and also processing unevenness of the PS plate 112 is prevented.

A brush roller 158 and a conveyance roller 160 are provided in the developing tank 124 so as to face the guide plate 146. The brush roller 158 brushes the surface of the PS plate 112 by rotating in a state in which a hair member is made to contact the surface of the PS plate 112 immersed in the developer and conveyed on the guide plate 146, and facilitates removal of an unnecessary photosensitive layer from the surface of the PS plate 112. At this time, the conveyance roller 160 prevents the PS plate 112, brushed by the brush roller 158, from rising to the liquid surface from the guide plate 146.

Due to the PS plate 112 being thus conveyed in the developing tank 124 while being immersed in the developer, a photosensitive layer exposed to light and no longer required is removed.

In the washing section 116, a conveyance path is formed so as to convey the PS plate 112 substantially in the horizontal direction by conveyance roller pairs 162 and 164 disposed above the washing tank 126. The PS plate 112 is conveyed horizontally above the washing tank 126 in a state of being nipped by the conveyance roller pairs 162 and 164.

In the washing section 116, spray pipes 166 and 168 which make a pair in the vertical direction are provided between the conveyance roller pairs 162 and 164 with the conveyance path of the PS plate 112 interposed therebetween. The spray pipes 166 and 168 are disposed so that the axial direction thereof coincides with the widthwise direction of the PS plate 112 (a direction orthogonal to the direction in which the PS plate 112 is conveyed). A plurality of blowing openings (not shown) are formed in each of the spray pipes 166 and 168 along the axial direction of the spray pipe so as to face the conveyance path of the PS plate 112.

Washing water is stored in the washing tank 126 and supplied to the spray pipes 166 and 168 synchronously with conveying of the PS plate 112. As a result, washing water is jetted out from the spray pipes 166 and 168 toward the PS plate 112 and a developer adhering to the surface of the PS plate 112 is washed off.

When the PS plate 112 is sent out by being nipped by the conveyance roller pair 164, the washing water supplied to the PS plate 112 is squeezed out from front and back sides of the PS plate 112 together with the developer adhering to the front and back sides of the PS plate 112, and thereafter, recovered in the washing tank 126. Washing water is jetted out from the spray pipe 166 toward an upstream side in the conveying direction of the PS plate 112 and washing water is jetted out from the spray pipe 168 toward a downstream side in the conveying direction of the PS plate 112. However, the directions in which washing water is jetted out from the spray pipes 166 and 168 are not limited to the same, and other directions may be adopted.

In the desensitizing section 118, a conveyance roller pair 170 is provided above the desensitizing tank 128. The PS plate 112 is conveyed by the conveyance roller pair 164 toward the conveyance roller pair 170 and conveyed within the desensitizing section 118, and thereafter, it is further conveyed toward the drying section 120 by being nipped by the conveyance roller pair 170.

In the desensitizing section 118, a spray pipe 172 is provided above the conveyance path of the PS plate 112, and a spray pipe 174 is provided below the conveyance path of the PS plate 112. The spray pipes 172 and 174 are disposed with the conveyance path of the PS plate 112 interposed therebetween so that the longitudinal direction (axial direction) thereof coincides with the widthwise direction of the PS plate 112. Further, a plurality of blowing openings are formed in each of the spray pipes 172 and 174 along the widthwise direction of the PS plate 112.

A gum solution used to protect the printing surface of the PS plate 112 is stored in the desensitizing tank 128 and supplied to the spray pipes 172 and 174 synchronously with conveying of the PS plate 112. The spray pipe 172 drops the gum solution toward the PS plate 112 and spreads the same on the surface of the PS plate 112. Further, the spray pipe 174 jets out the gum solution from the blowing openings toward the back surface of the PS plate 112 and applies the same to the back surface of the PS plate 112.

A protective film is formed by applying a gum solution to the front and back surfaces of the PS plate 112. The direction to which the gum solution is jetted out from the spray pipe 172 is not limited to the downstream side in the conveying direction of the PS plate 112, and other directions may be adopted. Alternatively, the gum solution may drop to be applied to or coated on the surface of the PS plate 112 in such a manner that the gum solution jetting out toward a flow-straightening plate is uniformly diffused by the flow-straightening plate along the widthwise direction of the PS plate 112. Further, in place of the spray pipe 174, for example, a discharging unit may be used in which the gum solution is applied to the surface of the PS plate 112 while the PS plate 112 is being moved in contact with the discharged gum solution.

In the desensitizing section 118, a washing spray 176 is provided above the conveyance roller pair 170 and a washing roller 178 is provided so as to rotate in contact with an upper roller of the conveyance roller pair 170. At a predetermined timing, washing water is dropped from the washing spray 176 via the flow-straightening plate 180 at a position in which the upper roller of the conveyance roller pair 170 and the washing roller 178 contact each other. This makes it possible for the washing water to uniformly diffuse on a peripheral surface of the upper roller of the conveyance roller pair 170 and the gum solution is washed off from the peripheral surfaces of upper and lower rollers in the conveyance roller pair 170. As a result, damage to the PS plate 112 caused by the gum solution being firmly fixed to the peripheral surfaces of the rollers is prevented.

The PS plate 112 to which the gum solution is applied in the desensitizing section 118 is nipped by the conveyance roller pair 170 and conveyed to the drying section 120 in a state in which the gum solution slightly remains on the front and back surfaces of the PS plate 112.

In the PS plate processor 110, a partition plate 182 is provided between the desensitizing section 118 and the drying section 120. This partition plate 182 is disposed above the conveyance path of the PS plate 112 so as to face an upper end of the processing tank 122. As a result, a slit-shaped insertion opening 184 is formed between the desensitizing section 118 and the drying section 120. The partition plate 182 has a double structure, and a groove-shaped air passage is formed in the insertion opening 184 at the side of the drying section 120 so that air within the drying section 120 may infiltrate into the air passage. As a result, a state in which the air within the drying section 120 infiltrates into the desensitizing section 118 from the insertion opening 184 is prevented.

In the drying section 120, a supporting roller 186 which supports the PS plate 112 is disposed in the vicinity of the insertion opening 184. A conveyance roller pair 190 is disposed in the intermediate portion of the drying section 120 in the conveying direction of the PS plate 112, and a conveyance roller pair 192 is disposed in the vicinity of an exhaust opening 188. The PS plate 112 is conveyed within the drying section 120 by the supporting roller 186 and the conveyance roller pairs 190 and 192.

A pair of ducts 194 and 196 is provided between the supporting roller 186 and the conveyance roller pair 190 and also between the conveyance roller pair 190 and the conveyance roller pair 192, with the conveyance path of the PS plate 112 interposed between each pair of ducts. The ducts 194 and 196 are disposed so that the longitudinal direction thereof coincides with the widthwise direction of the PS plate 112, and a slit hole 198 is formed on a surface of each duct which faces the conveyance path of the PS plate 112.

When dry air generated by a dry air generating means (not shown) is supplied to each duct 194, 196 from one longitudinal-direction end of the duct, the dry air is discharged from the slit hole 198 toward the conveyance path of the PS plate 112 and blown against the PS plate 112. As a result, the gum solution applied to the front and back surfaces of the PS plate 112 is dried and a protective film is thereby formed.

A shielding lid 1100 is disposed in the developing section 114 so that the lower surface thereof is located below the liquid surface of the developer stored in the developing tank 124. Therefore, an area in which the liquid surface of the developer within the developing tank 124 is in contact with the air is reduced. Further, the auxiliary insertion opening (an insertion opening for reentry) 140 of the cover 136 is closed by a shielding member (not shown) to prevent outside air from infiltrating into the developing section 114. The space between the shielding lid 1100 and each upper roller of the conveyance roller pairs 148 and 152 projecting from the liquid surface is reduced, thereby preventing deterioration of the developer in the developing tank 124 due to the developer coming in contact with carbon dioxide in the air.

Alternatively, a bladed shielding member made of silicon rubber or the like may be provided between the shielding lid 1100, processing tank 122, and conveyance roller pairs 148 and 152, thereby preventing the developer within the developing tank 124 from coming in contact with outside fresh air or preventing evaporation of water content in the developer.

Figure 2:
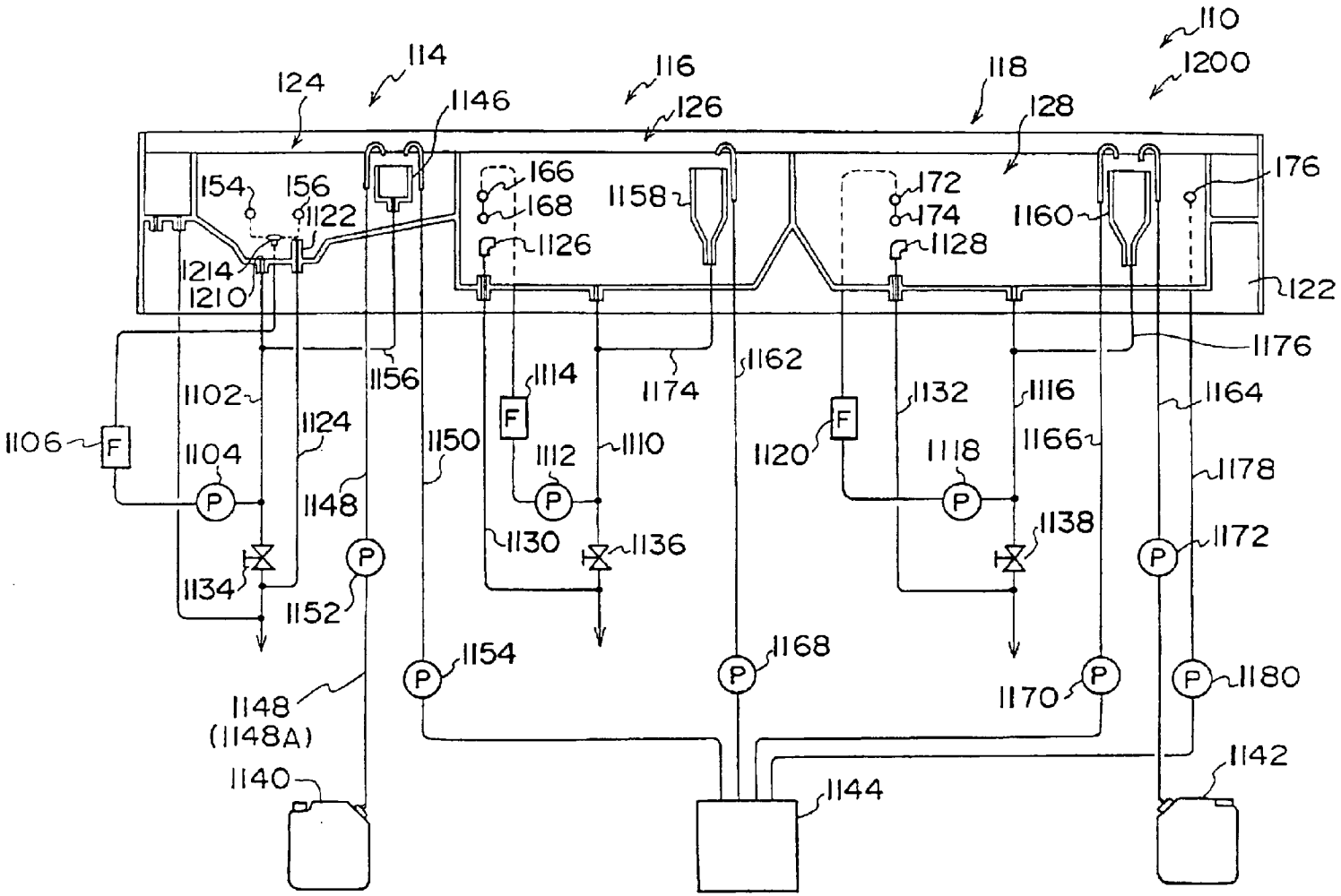
FIG. 2 is a schematic diagram showing a pipeline of the PS plate processor according to the first embodiment.

FIG. 2 shows a piping system for a processing solution in the PS plate processor 110. One end of piping 1102 is connected to the processing tank 122 of the PS plate processor 110 at the bottom of the developing tank 124. The other end of the piping 1102 is connected to the spray pipes 154 and 156 which are disposed within the developing tank 124, and a circulating pump 1104 and a filter 1106 are provided in an intermediate portion of the piping 1102. When the circulating pump 1104 is activated, the developer in the developing tank 124 is supplied to the spray pipes 154 and 156 and jetted out from the spray pipes 154 and 156 into the developing tank 124, thereby allowing circulation and agitation of the developer. At this time, when the developer passes through the filter 1106, suspended matters are removed therefrom.

One end of piping 1110 is connected to the bottom of the washing tank 126. The other end of the piping 1110 is connected to the spray pipes 166 and 168, and a circulating pump 1112 and a filter 1114 are provided in an intermediate portion of the piping 1110. As a result, washing water within the washing tank 126 is supplied to the spray pipes 166 and 168 due to operation of the circulating pump 1112 while suspended matters are being removed by the filter 1114.

Further, one end of piping 1116 is connected to the bottom of the desensitizing tank 128. The other end of the piping 1116 is connected to the spray pipes 172 and 174, and a circulating pump 1118 and a filter 1120 are provided in an intermediate portion of the piping 1116. As a result, when the circulating pump 1118 is activated, a gum solution within the desensitizing tank 128 is supplied to the spray pipes 172 and 174 while suspended matters are being removed by the filter 1120.

An overflow pipe 1122 is provided in the developing tank 124. One end of piping 1124 is connected to the overflow pipe 1122, and the other end thereof is connected to a waste liquid tank (not shown). An overflow pipe 1126 is provided in the washing tank 126, and an overflow pipe 1128 is provided in the desensitizing tank 128. Respective one ends of piping 1130 and piping 1132 are respectively connected to the overflow pipes 1126 and 1128, and respective another ends of the piping 1130 and piping 1132 are each connected to a waste liquid tank (not shown).

As a result, excessive developer, washing water and gum solution in the developing tank 124, the washing tank 126 and the desensitizing tank 128 are made to flow into the overflow pipes 1122, 1126 and 1128, respectively, and are discharged into the waste liquid tank.

The piping 1102 for circulation of a developer branches at an input side of the circulating pump 1104 and is connected via a waste liquid valve 1134 to piping 1124. Further, the piping 1110 for circulation of washing water branches at an input side of the circulating pump 1112 and is connected via a waste liquid valve 1136 to piping 1130, and the piping 1116 for circulation of a gum solution branches at an input side of the circulating pump 1118 and is connected via a waste liquid valve 1138 to piping 1132.

The developer within the developing tank 124, washing water within the washing tank 126, and gum solution within the desensitizing tank 128 can be discharged by opening the waste liquid valves 1134, 1136 and 1138.

The PS plate processor 110 is provided with: a replenisher tank 1140 filled with a developer replenisher to be supplied to the developing tank 124 as a replenisher of developer, a replenisher tank 1142 filled with a gum solution replenisher to be supplied to the desensitizing tank 128 as a replenisher of gum solution, and a replenishment water tank 1144 filled with water. Water stored in the replenishment water tank 1144 is used to dilute a developer replenisher or a gum solution replenisher and replenish water for the washing tank 126. Due to tap water being supplied to the replenishment water tank 1144 via piping (not shown), the quantity of water stored in the tank is maintained in a predetermined range.

Further, a mixing tank 1146 is also provided in the PS plate processor 110 in the vicinity of the developing tank 124. Respective one ends of piping 1148 and piping 1150 are each opened in the mixing tank 1146. The other end of the piping 1148 is connected to the replenisher tank 1140, and a replenisher pump 1152 is provided in an intermediate portion of the piping 1148. The other end of the piping 1150 is inserted in the replenishment water tank 1144 and a replenishment water pump 1154 is provided in an intermediate portion of the piping 1150.

In the PS plate processor 110, when a replenisher is replenished for the developing tank 124, the replenisher pump 1152 and the replenishment water pump 1154 are activated at a predetermined timing, a developer replenisher and water (dilution water) used to dilute the developer replenisher at a predetermined ratio are supplied into the mixing tank 1146 as replenishers.

One end of piping 1156 is connected to the bottom of the mixing tank 1146. The other end of the piping 1156 is connected at an input side of the circulating pump 1104. As a result, a replenisher supplied into the mixing tank 1146 is sucked up due to operation of the circulating pump 1104 and supplied to the spray pipes 154 and 156 while being mixed with the developer within the developing tank 124.

In the PS plate processor 110, auxiliary tanks 1158 and 1160 are provided adjacent to the washing tank 126 and the desensitizing tank 128, respectively. One end of piping 1162 opens in the auxiliary tank 1158 disposed in the washing tank 126 and the other end thereof opens in the replenishment water tank 1144. Further, respective one ends of piping 1164 and piping 1166 each open in the auxiliary tank 1160 disposed in the desensitizing tank 128. The other end of the piping 1164 is connected to the replenisher tank 1142 and the other end of the piping 1166 opens in the replenishment water tank 1144.

The piping 1162 and the piping 1166 are respectively provided with replenishment water pumps 1168 and 1170 at intermediate portions thereof. The piping 1164 is provided with a replenisher pump 1172 at an intermediate portion thereof.

When the replenishment water pump 1168 is activated, water in the replenishment water tank 1144 is supplied to the auxiliary tank 1158 as new washing water. When the replenisher pump 1172 and the replenishment water pump 1170 are activated, a gum solution replenisher in the replenisher tank 1142 and water used to dilute the gum solution replenisher at a predetermined ratio are supplied, as a replenisher of gum solution to be replenished for the desensitizing tank 128, to the auxiliary tank 1160.

One end of piping 1174 is connected to the bottom of the auxiliary tank 1158, and the other end thereof is connected to an input side of a circulating pump 1112. Further, one end of piping 1176 is connected to the bottom of the auxiliary tank 1160, and the other end thereof is connected to an input side of a circulating pump 1118.

When the circulating pump 1112 is activated, water within the auxiliary tank 1158 is supplied to the spray pipes 166 and 168 while being mixed with washing water within the washing tank 126. When the circulating pump 1118 is activated, a replenisher within the auxiliary tank 1160 is supplied to the spray pipes 172 and 174 while being mixed with the gum solution within the desensitizing tank 128.

In the PS plate processor 110, due to each operation of the circulating pumps 1104, 1112 and 1118, replenisher pumps 1152 and 1172, and replenishment water pumps 1154, 1168 and 1170 being controlled based on predetermined conditions, circulation of developer, washing water and gum solution, and replenishment of replenishers for the developing tank 124, washing tank 126 and desensitizing tank 128 are carried out.

A conventionally known method can be applied to the aforementioned control, and a detailed description thereof will be omitted in the present embodiment.

The PS plate processor 110 is also provided with piping 1178 of which one end is connected to a washing spray 176 and of which another end opens in the replenishment water tank 1144. A washing pump 1180 is provided in an intermediate portion of the piping 1178. When the washing pump 1180 is activated, water within the replenishment water tank 1144 is supplied to the washing spray 176 to allow washing of the conveyance roller pair 170 in the desensitizing tank 128.

At this time, water used for washing the conveyance roller pair 170 is recovered into the desensitizing tank 128 and the recovered water in the desensitizing tank 128 is used to dilute a gum solution replenisher. However, water used to dilute a gum solution replenisher may also be supplied using the washing pump 1180, not using the piping 1166 and the replenishment water pump 1170.

A developer sucked up from the developing tank 124 by the circulating pump 1104 is supplied to the spray pipe 154 provided as first blowing means and also to the spray pipe 156 provided as second blowing means, and jetted out from the spray pipes 154 and 156 into the developer in the developing tank 124.

Figure 3:
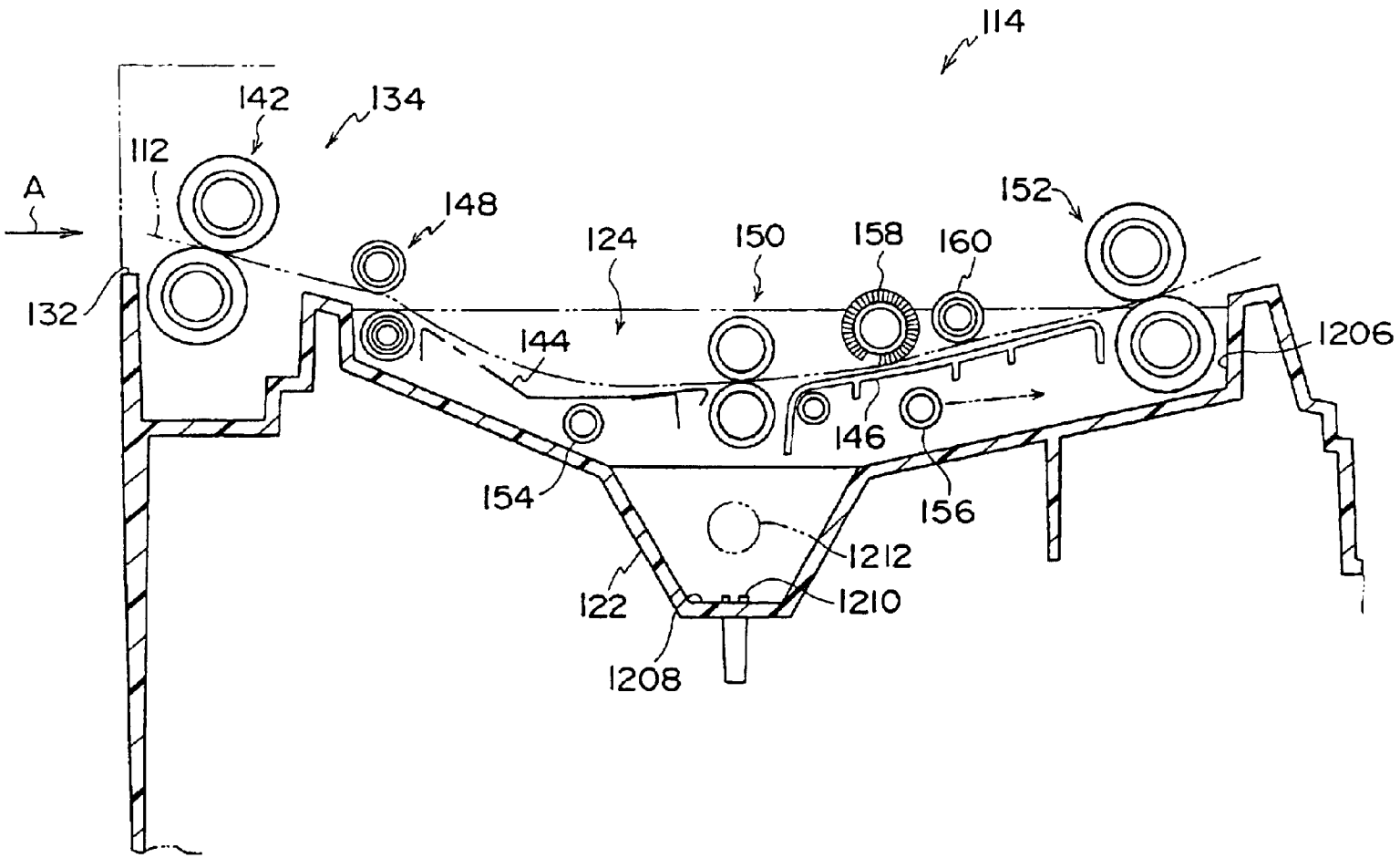
FIG. 3 is a schematic structural diagram showing a developer tank of the PS plate processor according to the first embodiment.
Figure 4:
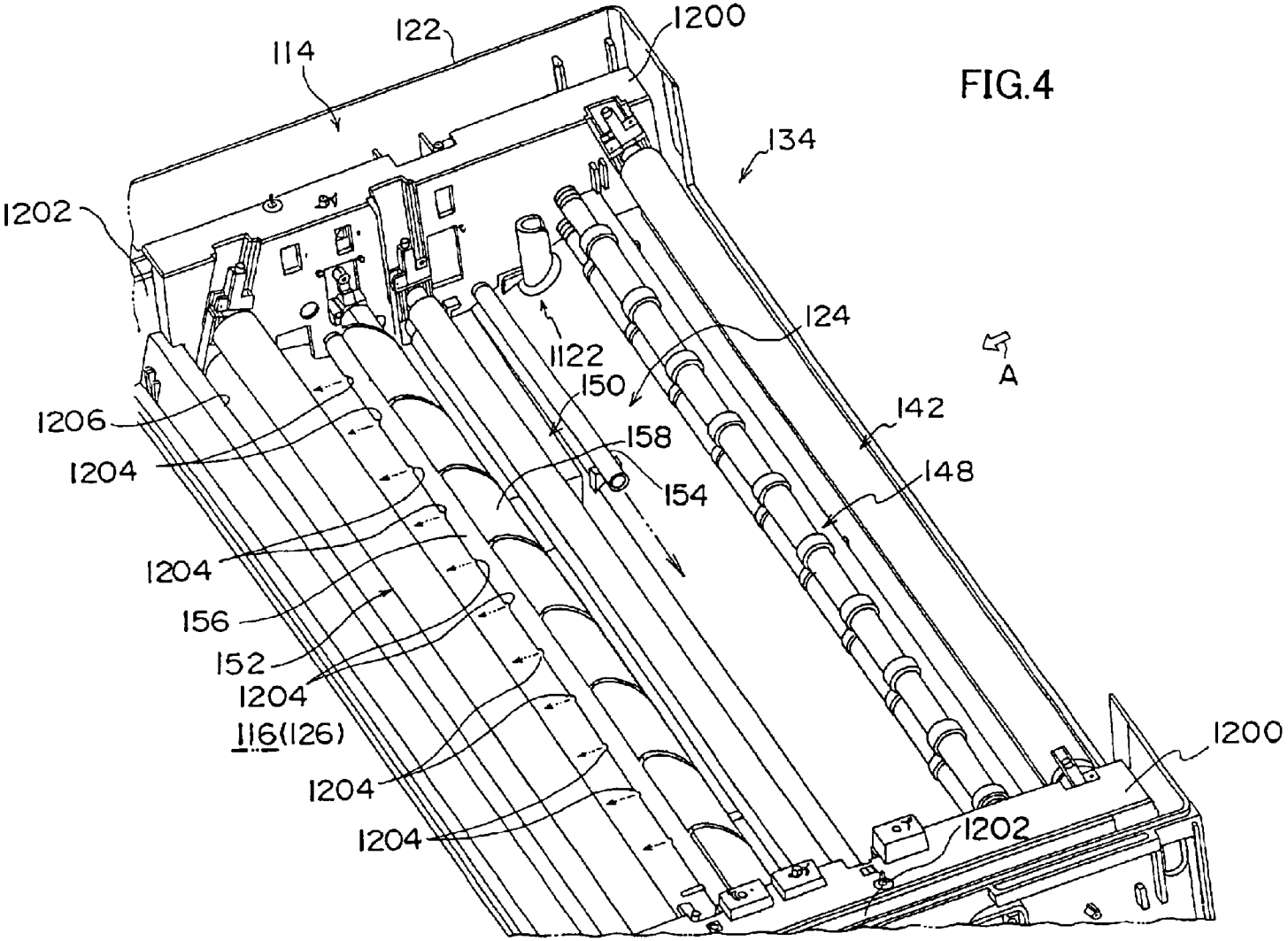
FIG. 4 is a perspective view of a principal portion of a processing tank, which schematically shows the structure of the developer tank of the PS plate processor according to the first embodiment.

As shown in FIG. 3 in detail, the spray pipe 154 is provided below the guide plate 144 at an upstream side of the developing tank 124. Further, as shown in FIG. 4, the spray pipe 154 extends from one end of the developing tank 124 in a direction orthogonal to the conveying direction, to the other end thereof, and is made to open at an intermediate portion of the developing tank 124 along the direction orthogonal to the conveying direction.

The spray pipe 154 is adapted to jet out the developer sucked up by the circulating pump 1104 along the direction orthogonal to the conveying direction of the PS plate 112.

As a result, a flow of developer along the widthwise direction of the PS plate 112 is formed within the developing tank 124 at the upstream side of the conveyance path of the PS plate 112. That is, developer jetted out from the spray pipe 154 is turned back by a rack side plate 1200 disposed in the developing tank 124 or a side wall 1202 of the developing tank 124 and flows along the direction orthogonal to the conveying direction. Accordingly, the developer within the developing tank 124 flows along the surface of the PS plate 112 conveyed at the upstream side of the developing tank 125, from one end to the other end of the widthwise direction of the PS plate 112, and liquid displacement is carried out in the vicinities of the surface of the PS plate 112.

In FIG. 3, the shielding lid 1100 and the like are not shown. Further, in FIG. 4, the guide plates 144 and 146 provided above the spray pipes 154 and 156, the conveyance roller 160, and the like are not shown.

As shown in FIGS. 3 and 4, the spray pipe 156 is disposed below the guide plate 146 at the downstream side of the developing tank 124. As shown in FIG. 4, the spray pipe 156 is disposed so that the longitudinal direction thereof coincides with a direction orthogonal to the conveying direction of the PS plate 112. Further, a large number of exhaust holes 1204 are formed in the spray pipe 156. These exhaust holes 1204 are formed along the longitudinal direction of the spray pipe 156 at predetermined intervals. Further, as shown in FIGS. 3 and 4, the exhaust holes 1204 are each disposed diagonally to the lower side at the downstream side in the conveying direction of the PS plate 112. The space between the exhaust holes 1204 may be set so that developer can be substantially uniformly jetted out from the spray pipe 156 in the direction orthogonal to the conveying direction of the PS plate 112.

As a result, the developer supplied from the circulating pump 1104 to the spray pipe 156 is jetted out from the spray pipe 156 to the downstream side in the conveying direction of the PS plate 112 and a flow of developer along the conveying direction of the PS plate 112 is formed at the downstream side in the conveyance path of the PS plate 112. That is, the developer jetted out from the spray pipe 156 is turned back by the bottom of the developing tank 124 or the tank wall 1206 at the downstream side of the developing tank 124 to form a flow along the conveying direction of the PS plate 112.

Due to the aforementioned flow of developer, a developer having a uniform processing performance along the direction orthogonal to the conveying direction of the PS plate 112 is supplied to the PS plate 112 conveyed on the guide plate 146, and liquid displacement is effectively carried out in the vicinities of the surface of the PS plate 112.

As shown in FIG. 3, a suction hole 1210 is formed on a bottom plate 1208 disposed at the lowest position of the bottom of the developing tank 124 between the spray pipes 154 and 156. When the circulating pump 1104 is activated, the developer within the developing tank 124 is sucked into the suction hole 1210. Further, the developing tank 124 is also provided with a heater 1212, serving as temperature adjustment means to heat the developer, in the vicinity of the suction hole 1210.

As a result, the developer heated by the heater 1212 principally flows into the suction hole 1210.

In the PS plate processor 110, the developer within the developing tank 124 is set substantially at a uniform temperature due to a developer heated by the heater 1212 being jetted out from the spray pipes 154 and 156. So long as the suction hole 1210 is positioned such that the developer jetted out from the spray pipes 154 and 156 does not directly flow therein, it is not necessary that the suction hole 1210 may be provided on the bottom plate 1208 between the spray pipes 154 and 156. For example, the suction hole 1210 may be provided on a tank wall of the developing tank 124, or the like.

A conventionally known method can be used to carry out temperature adjustment control of a developer using the heater 1212, and therefore, a detailed description thereof will be omitted in the present embodiment. Further, the heater 1212 may be provided in the midstream of the piping 1102 in which the developer is circulated, instead of being provided within the developing tank 124. Moreover, a heat exchanger used to cool a developer or adjust the temperature thereof, or the like may also be provided in the piping 1102 in addition to the heater 1212.

As shown in FIG. 2, a branch pipe 1214 is provided in the piping 1102 at a portion in which the piping 1102 is branched into the spray pipes 154 and 156. The branch pipe 1214 includes flow-rate control means such as an orifice (not shown) so that the quantity of developer to be supplied to the spray pipe 154 becomes larger than that to be supplied to the spray pipe 156. In the present embodiment, the ratio between quantities of developer discharged from the spray pipes 154 and 156 is, by way of example, set so as to be 6:4 to 8:2.

In the PS plate processor 110 described above, when the PS plate 112 on which an image is recorded by being exposed using a printing device (not shown) is inserted from the insertion opening 132, the conveyance roller pair 142 is driven to rotate. As a result, the PS plate 112 is pulled in the PS plate processor 110 by being nipped by the conveyance roller pair 142.

In the PS plate processor 110, a sensor is provided in the vicinity of the insertion opening 132 and is used to detect the PS plate 112 passing through the insertion opening 132. When this sensor detects insertion of the PS plate 112, the conveyance roller pair 142 and the like are driven to rotate, and at a timing based on detection of the PS plate 112 by the sensor, washing water is discharged from the spray pipes 166 and 168 of the washing section 116 and a gum solution is discharged from the spray pipes 172 and 174 of the desensitizing section 118.

The conveyance roller pair 142 is used to convey the PS plate 112 inserted from the insertion opening 132 in the developing tank 124, at an inlet angle of 15 to 31 degrees to the horizontal direction. As a result, the PS plate 112 is conveyed within the developing tank 124 by the conveyance roller pairs 148, 150 and 152 while being guided by the guide plates 144 and 146 and immersed in the developer stored in the developing tank 124. Thereafter, the PS plate 112 is discharged from the developer at an outlet angle of 17 to 31 degrees.

Due to the PS plate 112 being immersed in the developer within the developing tank 124, an unnecessary photosensitive layer swells in accordance with an exposed image and the swollen photosensitive layer is removed from a support. At this time, in the PS plate processor 110, the surface of the PS plate 112 (the surface with the photosensitive layer formed thereon) is brushed by the brush roller 158 disposed within the developing tank 124 to facilitate removal of the unnecessary photosensitive layer from the surface of the PS plate 112.

The PS plate processor 110 may be provided so as to brush the surface of the PS plate 112 using a plurality of brush rollers, or may be provided so as to carry out processing for the PS plate 112 using no brush roller.

The PS plate 112 subjected to development processing and discharged from the developing tank 124 is conveyed to the washing section 116 by the conveyance roller pair 152. At this time, the conveyance roller pair 152 is used to squeeze out a developer adhering to the front and back surfaces of the PS plate 112.

In the washing section 116, washing water is jetted out from the spray pipes 166 and 168 toward the PS plate 112 while the PS plate 112 is being conveyed substantially in the horizontal direction in a state of being nipped by the conveyance roller pairs 162 and 164. Further, the conveyance roller pair 164 disposed at the downstream side in the conveying direction of the PS plate 112 is used to squeeze out washing outer supplied to the front and back surfaces of the PS plate 112 together with a remaining developer which has not been squeezed out by the conveyance roller pair 152, and conveys the PS plate 112 to the desensitizing section 118.

As a result, when the PS plate 112 passes through the washing section 116, a developer remaining on the front and back surfaces of the PS plate 112 is washed off.

The PS plate 112 conveyed to the desensitizing section 118 passes through between the spray pipes 172 and 174 and is discharged from the desensitizing section 118 in the state of being nipped by the conveyance roller pair 170.

At this time, in the desensitizing section 118, a gum solution is jetted out from the spray pipes 172 and 174 and applied and diffused uniformly to the front and back surfaces of the PS plate 112. The conveyance roller pair 170 squeezes out an excessive gum solution from the front and back surfaces of the PS plate 112 while nipping and conveying the PS plate 112, thereby forming a uniform thin film of gum solution on the front and back surfaces of the PS plate 112.

The PS plate 112 coated with a gum solution is conveyed by the conveyance roller pair 170 from the insertion opening 184 to the drying section 120. In a case in which a shutter is provided at the insertion opening 184, the shutter is activated at a timing of starting processing of the PS plate 112 or at a timing at which the PS plate 112 is discharged from the desensitizing section 118, to open the insertion opening 184, so that, when the PS plate 112 does not pass therethrough, dry air of the drying section 120 does not inadvertently flow into the desensitizing section 118 and cause a gum solution to firmly adhere to the conveyance roller pair 170. Further, the air flowing from the insertion opening 184 is reliably prevented from reaching the developing section 114 to cause deterioration in the developer due to carbon dioxide in the air. Further, water content of the developer, washing water and water content of the gum solution is reliably prevented from evaporating and escaping from the insertion opening 184.

In the drying section 120, dry air is blown against the front and back surfaces of the PS plate 112 from the ducts 194 and 196 while the PS plate 112 is being conveyed by the supporting roller 186 and the conveyance roller pairs 190 and 192. As a result, a protective film is formed on the PS plate 112 by a gum solution applied on the surface of the PS plate 112, and the PS plate 112 is discharged from the exhaust opening 188.

In the PS plate processor 110, the developer within the developing tank 124 is circulated and agitated by the circulating pump 1104 while being heated by the heater 1212, and maintained in a predetermined temperature range in which the PS plate 112 can be finished most suitably.

In the PS plate processor 110, the developer is sucked into the suction hole 1210 formed on the bottom plate 1208 of the developing tank 124 by operating the circulating pump 1104. The developer is supplied to the spray pipes 154 and 156 via the piping 1102, and jetted out from the spray pipes 154 and 156 into the developing tank 124.

The spray pipe 154 is provided at the upstream side of the developing tank 124 and jets out the developer along a direction orthogonal to the conveying direction of the PS plate 112 to form a flow of developer along the direction orthogonal to the conveying direction of the PS plate 112 in the vicinity of the guide plate 144.

As a result, liquid displacement is carried out in which a fresh developer is supplied to the front and back surfaces of the PS plate 112 inserted from the insertion portion 134 and guided to be conveyed on the guide plate 144 while a developer in the vicinity of the surface of the PS plate 112 is discharged by a developer flowing along the direction orthogonal to the conveying direction.

At this time, in the PS plate processor 110, the branch pipe 1214 is provided in the piping 1102 used to circulate the developer, and a large quantity of developer is thereby jetted out from the spray pipe 154. As a result, rapid liquid displacement is carried out on the front and back surfaces of the PS plate 112 conveyed on the guide plate 144, and development processing of the PS plate 112 is facilitated by this displacement of the developer.

The temperature of the PS plate 112 inserted in the developing tank 124 is, in general, lower than the temperature of the developer, which temperature is different from the temperature of the developer at which the PS plate 112 is most suitably processed. To this end, the temperature of the developer in the vicinity of the surface of the PS plate 112 initially inserted in the developer is influenced by the temperature of the PS plate 112, and the temperature of the developer does not fall within the temperature range in which the PS plate 112 is most suitably processed.

At this time, in the PS plate processor 110, a large quantity of developer is jetted out from the spray pipe 154 provided at the upstream side of the developing tank 124, to prevent the temperature of the developer in the vicinities of the front and back surfaces of the PS plate 112 from changing under the influence of the temperature of the PS plate 112.

In other words, the temperature of a developer at the upstream side of the developing tank 124 is kept from changing under the influence of the temperature of the PS plate 112, by rapidly removing a developer in the vicinity of the surface of the PS plate 112, the temperature of which developer tends to decrease under the influence of the temperature of the PS plate 112, by jetting out a large quantity of developer from the spray pipe 154. Accordingly, efficient development processing of the PS plate 112 can be started.

As a result, the temperature of developer within the developing tank 124 is properly maintained. That is, the temperature of developer can be adjusted with high accuracy by jetting out a large quantity of developer to the upstream side of the developing tank 124.

Further, in the PS plate processor 110, the developer is jetted out from the spray pipe 156 disposed at the downstream side of the developing tank 124 toward the downstream side in the conveying direction of the PS plate 112. As a result, a flow of developer along the conveying direction of the PS plate 112 is formed in the vicinities of the front and back surfaces of the PS plate conveyed on the guide plate 146 provided at the downstream side, and liquid displacement is carried out by the developer in the vicinity of the surface of the PS plate 112.

The developer passing through the downstream side of the developing tank 124 has relatively been fatigued, as compared with a fresh developer. A finish of development processing is influenced by the difference in the processing performance of developer. In the PS plate processor 110, in order to prevent a finishing unevenness caused by the developer jetting out from the spray pipe 156 being directly blown against the front and back surfaces of the PS plate 112, the developer is jetted out diagonally to the lower side at the downstream side of the conveying direction.

In the PS plate processor 110, a flow of developer along the conveying direction of the PS plate 112 is formed at the downstream side of the developing tank 124, as described above. Thus, a developer having uniform processing performance is supplied to the PS plate 112 along the direction orthogonal to the conveying direction of the PS plate 112.

As a result, the PS plate processor 110 prevents, the difference in the processing performance of the developer in the vicinity of the surface of the PS plate 112, from being made along the direction orthogonal to the conveying direction of the PS plate 112 and causes no unevenness in a finished state by development processing.

As described above, in the PS plate processor 110, a large quantity of developer is jetted out from the spray pipe 154 at the upstream side of the developing tank 124 along the direction orthogonal to the conveying direction of the PS plate, so as to improve temperature adjustment accuracy of the developer. Further, rapid liquid displacement in the vicinities of the front and back surfaces of the PS plate 112 conveyed at the upstream side is carried out so as to facilitate development processing.

In the PS plate processor 110, the developer is jetted out from the spray pipe 156 so that a flow of developer along the conveying direction of the PS plate 112 is formed at the downstream side of the developing tank 124. Accordingly, development processing can be carried out without causing unevenness in a finished state of the PS plate 112.

Furthermore, in the PS plate processor 110, the spray pipes 154 and 156 are each adapted not to jet out the developer toward the suction hole 1210 into which developer within the developing tank 124 is sucked by the circulating pump 1104. For this reason, a relatively fresh developer jetted out from the spray pipes 154 and 156 is not kept from being sucked into the suction hole 1210, and development processing of the PS plate 112 is carried out using the relatively fresh developer.

As a result, the PS plate 112 of high quality can be finished efficiently using the developer stored in the developing tank 124.

The structure of the present invention is not limited to the aforementioned embodiment. For example, in the present embodiment, there was described a case in which the developer within the developing tank 124 used for development processing of the PS plate 112 is provided as a processing solution. However, the present invention is not limited to the same and can be applied to any suitable processing tank in which the PS plate 112 is conveyed and processed in a state of being immersed in a processing solution.

Further, in the present embodiment, there was described a case in which the PS plate 112 is used as a photosensitive material and the PS plate processor 110 is used to process the PS plate 112 with a processing solution. The present invention, however, is not limited to a printing plate such as the PS plate 112, and can also be applied to a photosensitive material processing apparatus having any suitable structure in which a photosensitive material such as photographic printing paper or a photographic film is conveyed and processed while being immersed in a processing solution.

As described above, according to the present embodiment, a processing solution is jetted out by first blowing means provided at the upstream side of a processing tank along a direction orthogonal to a direction in which a photosensitive material is conveyed, and a processing solution is jetted out by second blowing means provided at the downstream side of the processing tank toward the downstream side in the direction in which the photosensitive material is conveyed, thereby resulting in that a photosensitive material can be efficiently processed with the processing solution and finished with high quality.

[Second Embodiment]

Figure 5:
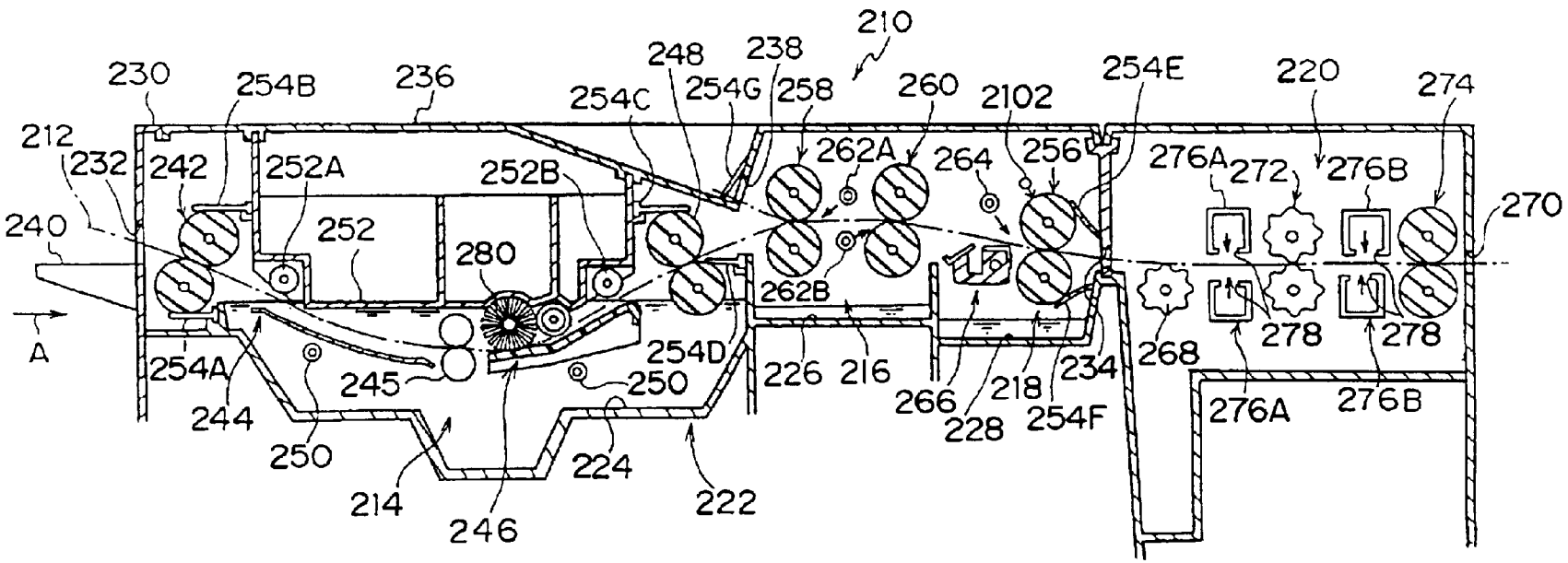
FIG. 5 is a schematic structural diagram of a PS plate processor applied to a second embodiment of the present invention.

Next, a description will be given of a second embodiment of the present invention with reference to the attached drawings. FIG. 5 schematically shows the structure of a PS plate processor 210 which is applied to the second embodiment as a photosensitive material processing apparatus. The second embodiment is similar to the aforementioned first embodiment, and therefore, only structures and operation different from those of the first embodiment will be described and descriptions of the same structures and operation as those of the first embodiment will be basically omitted.

In the PS plate processor 210 based on the present embodiment, guide plates 244 and 246 provided in a developing tank 224 have important features (which differs noticeably from those of the first embodiment). Therefore, the guide plates 244 and 246 will be particularly described below.

The guide plate 244 is provided at the upstream side of the developing tank 224 (near an insertion opening 232), and guides a PS plate 212, fed in by a conveyance roller pair 242, diagonally to the lower side. The guide plate 246 is provided at the downstream side of the developing tank 224 and guides the PS plate 212 along the bottom of the developing tank 224 diagonally to the upper side.

Further, a conveyance roller pair 245 is provided in the developing tank 224 between the guide plates 244 and 246. When the conveyance roller pair 245 is driven to rotate, it conveys the PS plate 212 guided by the guide plate 244 toward the guide plate 246 while imparting conveying force to the PS plate 212. As a result, the PS plate 212 is immersed in a developer while being guided and conveyed within the developing tank 224 along a substantially U-shaped conveyance path.

The developing tank 224 is provided with, near a washing section 216, a conveyance roller pair 248 formed by rollers whose outer peripheries are made of rubber. The PS plate 212 is guided by the guide plate 246 toward the conveyance roller pair 248, and pulled out form the developing tank 224 by being nipped by the conveyance roller pair 248. The PS plate 212 is thus immersed in a developer when conveyed within the developing tank 224, an unnecessary portion of a photosensitive layer exposed imagewise swells due to the developer and is peeled from a support, and an unnecessary photosensitive layer is removed in accordance with an exposure image.

Spray pipes 250 are provided within the developing tank 224 respectively at lower sides of the guide plates 244 and 246. A developer within the developing tank 224, which is sucked by a pump (not shown), is supplied to each spray pipe 250 and jetted out from the spray pipe 250. As a result, the developer within the developing tank 224 is agitated and the PS plate 212 can be uniformly processed.

Thus, in the present embodiment, processing solution jetting/circulating means including the spray pipes 250 may basically have a known structure, but of course may be structured in the same manner as in the first embodiment.

As described above, the guide plates 244 and 246, serving as guide plates used to convey a photosensitive material, are provided within the developing tank 224 of the PS plate processor 210, and used to form a conveyance path for guiding to convey the PS plate 212 along a substantially U-shaped conveyance path.

Figure 6:
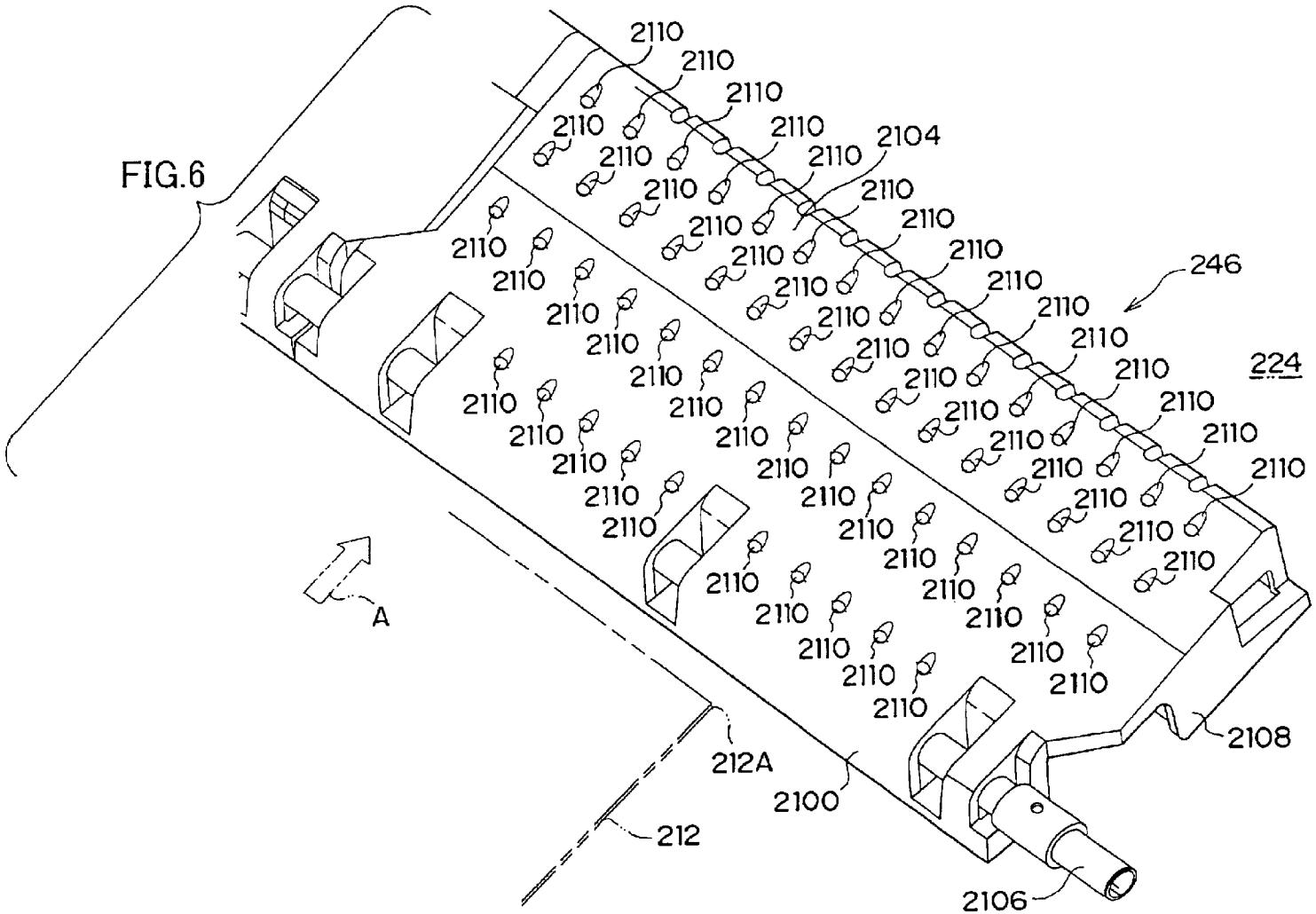
FIG. 6 is a perspective view which schematically shows a principal portion of a guide main body which forms a guide plate according to the second embodiment.

FIG. 6 schematically shows the guide plate 246. In the following, the guide plate 246 will be described as an example, and a description of the guide plate 244 will be omitted.

A guide main body 2100 of the guide plate 246 is formed substantially into a flat plate. The upper surface of the guide main body 2100 (which corresponds to the upper side of the paper of FIG. 6) is provided as a guide surface 2104 facing the PS plate 212. Further, the guide main body 2100 is slightly bent at an intermediate portion thereof in the conveying direction of the PS plate 212 so that the downstream side of the guide main body 2100 in the conveying direction of the PS plate 212 is disposed at a slightly upper position than the lower side.

A shaft 2106 is inserted in and passes through an upstream-side end of the guide main body 2100 in the conveying direction of the PS plate 212. As the shaft 2106 is laid at a predetermined position and spanning between a pair of side plates (not shown) which forms a processing rack disposed in the developing tank 224, a portion of the guide main body 2100 at the upstream side of the PS plate 212 is held at a predetermined position within the developing tank 224.

Further, a leg portion 2108 is provided at each of both ends of the guide main body 2100 in the widthwise direction of the PS plate 212 orthogonal to the conveying direction so as to extend downward in a direction opposite to the conveyance path of the PS plate 212. An end of the guide main body 2100 at the downstream side in the conveying direction of the PS plate 212 is held at a predetermined position within the developing tank 224 by spanning the leg portions 2108 between the pair of side plates of the processing rack or causing the leg portions 2108 to abut against a supporting portion (not shown) protruding from the bottom of the developing tank 224.

As a result, the guide plate 246 which guides the PS plate 212 in an upward direction can be formed by the guide main body 2100, between the pair of side plates (not shown) within the developing tank 224. The guide plate 246 is formed in such a manner that guide main bodies 2100 of which number corresponds to the transverse dimension of the PS plate 212 are joined together along the widthwise direction of the PS plate 212.

A large number of through holes 2110 are formed on the guide main body 2100 at predetermined intervals. In FIG. 6, the through holes 2110 are arranged at predetermined intervals both in the longitudinal and widthwise directions of the PS plate 212, but the present invention is not limited to the same. For example, the through holes 2110 may be arranged diagonally at a predetermined angle with respect to the conveying direction of the PS plate 212, or may be formed at random.

When the developer in the vicinity of the conveyance path of the PS plate 212 passes through the through holes 2110 of the guide main body 2100 in the developing tank 224, the developer can be discharged toward the bottom of the developing tank 224 and a fresh developer can be made to flow from the bottom side of the developing tank 224 toward the conveyance path of the PS plate 212.

Figure 7:
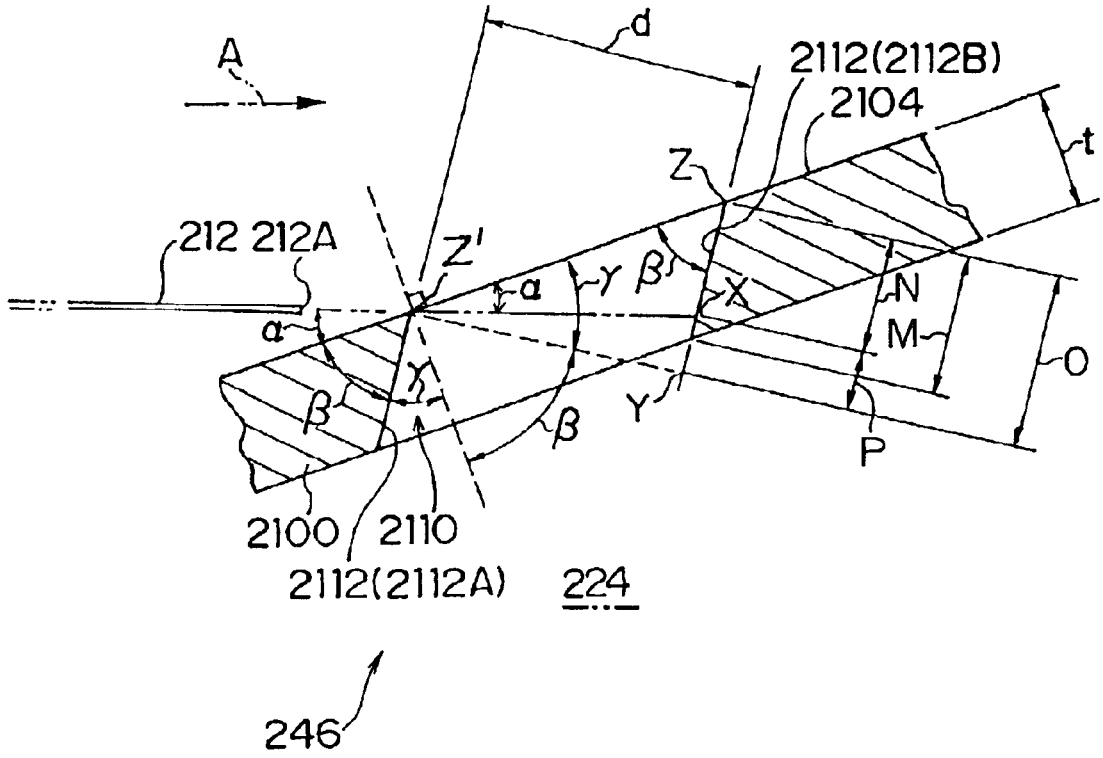
FIG. 7 is a cross sectional view of a principal portion of the guide main body taken along a direction in which a PS plate is conveyed, which schematically shows a through hole formed in the guide main body.

As shown in FIG. 7, the PS plate 212 is guided along the guide surface 2104 in such a manner that the end thereof is moved in contact with the guide surface 2104 of the guide main body 2100.

The through holes 2110 formed in the guide main body 2100 are formed such that each hole opening on the guide surface 2104 faces the downstream side in the conveying direction of the PS plate 212. The direction to which the through hole opens indicates, for example, the axial direction of the through hole when the through hole 2110 is formed as a circular hole. The through holes 2110 shown in FIGS. 6 and 7 are each formed so that the axial direction thereof is directed to the downstream side in the conveying direction of the PS plate 212.

The guide surface 2104 of the guide main body 2100 is disposed along the conveying direction of the PS plate 212. As a result, the PS plate 212 is moved so that the leading end thereof abuts against the guide surface 2104 at a predetermined angle $\alpha$.

Further, when the angle formed between the direction to which each of the through holes 2110 formed in the guide main body 2100 opens, and the guide surface 2104 is indicated as $\beta$, an angle formed between an internal surface 2112 of the through hole 2110 at the downstream side in the conveying direction of the PS plate 212, and the guide surface 2104 equals to the angle β.

At this time, in the PS plate processor 210, when the sum of angle α and angle β is indicated as angle θ, the angle θ is made to become an acute angle, preferably 45 degrees or less.

$\alpha+\beta=\theta$ $0<\theta<90°$ preferably, $0<\theta<45°$ that is, $0<(\alpha+\beta)<90°$ preferably, $0<(\alpha+\beta)<45°$ The angle θ becomes an angle formed when the leading end of the PS plate 212 abuts against the internal surface 2112 of the through hole 2110. When the angle θ is made to become an acute angle, even if a corner 212A of the PS plate 212 in the widthwise direction is pulled into the through hole 2110, the corner 212A is moved along the internal surface 2112 and comes out from the through hole 2110 without being caught therein, and the leading end of the PS plate 212 can be moved again on the guide surface 2104.

The angle α formed between the PS plate 212 and the position of the guide main body 2100, namely, the guide surface 2104 on the upper surface of the guide main body 2100 can be determined based on the positional relationship between the PS plate 212 conveyed within the developing tank 224 and the guide main body 2100. In order to prevent transport deficiency caused by the corner 212A of the leading end of the PS plate 212 moving into the through hole 2110, the thickness of the guide main body 2100, the size of the through hole 2110 formed in the guide main body 2100, and the like need to be set based on the angles α and β.

If the angles α and β are set in the aforementioned ranges and the corner 212A of the PS plate 212 moving into the through hole 2110 does not come out from the through hole 2110, the corner 212A should be in a state of protruding from the through hole 2110 toward the rear surface of the guide main body 2100.

Specifically, as shown in FIG. 7, assuming that a distance from the guide surface 2104 of the guide main body 2100 to the rear surface of the guide main body 2100 along the internal surface 2112 of the through hole 2110 is indicated as length M, an intersecting point of a line obtained by extending the leading end of the PS plate 212 facing, at the angle α, the guide surface 2104 of the guide main body 2100, and the direction along the length M, is indicated as point X, and a distance from the guide surface 2104 to the point X along the length M is indicated as N, if M>N, it is possible to prevent the leading end of the PS plate 212 from protruding from the through hole 2110 to the rear surface of the guide main body 2100.

A point located at an edge of the through hole 2110 at the side of the guide surface 2104, and also located at the downstream side in the conveying direction of the PS plate 212, is indicated as point Z. Point Z' as another edge of the through hole 2110 at the side of the guide surface 2104, which is opposite to point Z and at the internal surface 2112A in FIG. 7, is determined. A line normal to the internal surface 2112B is drawn from point Z'. A line as an extension of the internal surface 2112B is drawn in the direction of "M". The intersecting point of these two lines are indicated as Y in FIG. 7. Here, the angle γ is obtained based on the following expression:

$$\beta+\gamma=90° \text{ and } \gamma=90°-\beta.$$

In this case, when the distance between point Z and point Y is length Q and the distance between point X and point Y is length P, an expression, M>Q−P must be satisfied to realize the relationship M>N.

Lengths M, P and Q are each expressed as below based on angles α, β and γ, plate thickness t, and hole width d of the through hole 2110 between the internal surface 2112A and the internal surface 2112B.

$M=t/\cos\gamma=t/\cos(90-\beta)$ $Q=d\cdot\tan\gamma=d\cdot\tan(90-\beta)$ $P=d\cdot\tan(\gamma-\alpha)=d\cdot\tan(90-\alpha-\beta)$ Accordingly, the through hole 2110 is preferably formed so as to satisfy the following expression.

$$d\cdot\tan(90-\beta)-d\cdot\tan(90-\alpha-\beta)<t/\cos(90-\beta)$$

As a result, even if the corner 212A of the PS plate 212 comes into the through hole 2110, the corner 212A can be reliably kept from protruding from the rear surface of the guide main body 2100 (the side opposite to the guide surface 2104) and being caught by the guide main body 2100.

In the PS plate processor 210 structured as described above, when the PS plate 212 on which an image is recorded by a printing device (not shown) is placed on an insertion table 240 and inserted in the insertion opening 232, the PS plate 212 is pulled in by the conveyance roller pair 242 and conveyed to the developing section 214. In the PS plate processor 210, a timer is used so that the PS plate 212 passing through the insertion opening 232 is detected by the sensor (not shown). The timer is used for operating driving means for conveying the PS plate 212, and measuring a timing at which washing water is discharged from the spray pipes 262A and 262B of the washing section 216 or a timing at which a gum solution is discharged in the desensitizing section 218.

In the developing section 214, the PS plate 212 is inserted by the conveyance roller pair 242 at an inlet angle of 15 to 31 degrees with respect to the horizontal direction, and conveyed while being immersed in the developer. Further, the PS plate 212 is discharged from the developer at an outlet angle of 17 to 31 degrees. When the PS plate 212 is immersed in the developer in the developing section 214, an unnecessary portion of a photosensitive layer swells in accordance with an exposure image, and the swollen photosensitive layer is removed from a support. At this time, the surface of the PS plate 212 is brushed by the bush roller 280 disposed within the developing tank 224 to facilitate removal of an unnecessary photosensitive layer from the surface of the PS plate 212.

In the PS plate processor 210, the PS plate 212 may be brushed with a plurality of brush rollers 280 disposed so as to face the surface of the PS plate 212, or may be processed using no brush roller 280.

The PS plate 212 processed with the developer and discharged from the developer in such a manner as described above is pulled out by the conveyance roller pair 248 and conveyed to the washing section 216. Subsequent operations are the same as those of the first embodiment, and a description thereof will be omitted.

As described above, the guide plate 246 is provided within the developing tank 224 of the PS plate processor 210, and the PS plate 212 is conveyed by the guide plate 246 in a bent state and immersed in the developer.

Further, the through holes 2110 are formed in the guide plate 246, and a relatively fresh developer is supplied via the through holes 2110 to the guide surface 2104 of the guide main body 2100, serving as the conveyance path of the PS plate 212.

As a result, the developer in the vicinity of the conveyance path of the PS plate 212, which has been deteriorated due to the PS plate 212 being processed therewith, is discharged from the vicinity of the conveyance path of the PS plate 212, and the PS plate 212 can be entirely subjected to development processing using a developer having a substantially uniform processing performance.

Further, suspended matters adhering to the PS plate 212 are brought into the developing tank 224 and reside on the guide surface 2104 of the guide main body 2100. Such suspended materials can be discharged by way of the through holes 2110 toward the bottom of the developing tank 224.

As a result, in the PS plate processor 210, there is no possibility that the product quality deteriorates due to uneven development caused by adhesion of suspended materials in the developing tank 224 to the PS plate 212 and/or variation in processing performance of the developer.

The PS plate 212 is conveyed in such a manner that the leading end thereof abuts against the guide surface 2104 of the guide main body 2100. At this time, when the corner 212A of the PS plate 212 moves into the through hole 2110 formed in the guide main body 2100, damage such as corner bending, or transport deficiency may be caused.

According to the present embodiment, the through holes 2110 are formed in the guide main body 2100 of the guide plate 246 so that the angle θ which is the sum of the angle α formed between the guide surface 2104 and the PS plate 212 when the leading end of the PS plate 212 abuts against the guide surface 2104, and the angle/formed between the guide surface 2104 and the internal surface 2112, becomes an acute angle.

As a result, when the corner 212A of the PS plate 212 moves into the through hole 2110 and abuts against the internal surface 2112, it is possible to prevent the corner 212A from protruding from the rear surface of the guide main body 2100 at the innermost position of the through hole 2110. Thus, even if the corner 212A of the PS plate 212 abuts against the internal surface 2112, it can be moved back toward the guide surface 2104.

Accordingly, the PS plate 212 can be smoothly guided by reliably preventing damage to the PS plate 212 or transport deficiency, which is caused by the corner 212A of the PS plate 212 moving into the through hole 2110.

Further, in the through hole 2110 formed in the guide main body 2100, the angle β and the hole width d are set based on the plate thickness t of the guide main body 2100. Therefore, there is no possibility that the corner 212A of the PS plate 212 moving into the through hole 2110 may protrude from the rear surface of the guide main body 2100. As a result, smooth conveying of the PS plate 212 becomes possible by reliably preventing damage to the PS plate 212 or transport deficiency, which is caused by the corner 212A of the PS plate 212 moving into the through hole 2110 and protruding from the rear surface of the guide main body 2100.

In the present embodiment described above, a circular hole is formed as the through hole 2110, but the shape of the through hole 2110 is not limited to the same.

Figure 8:
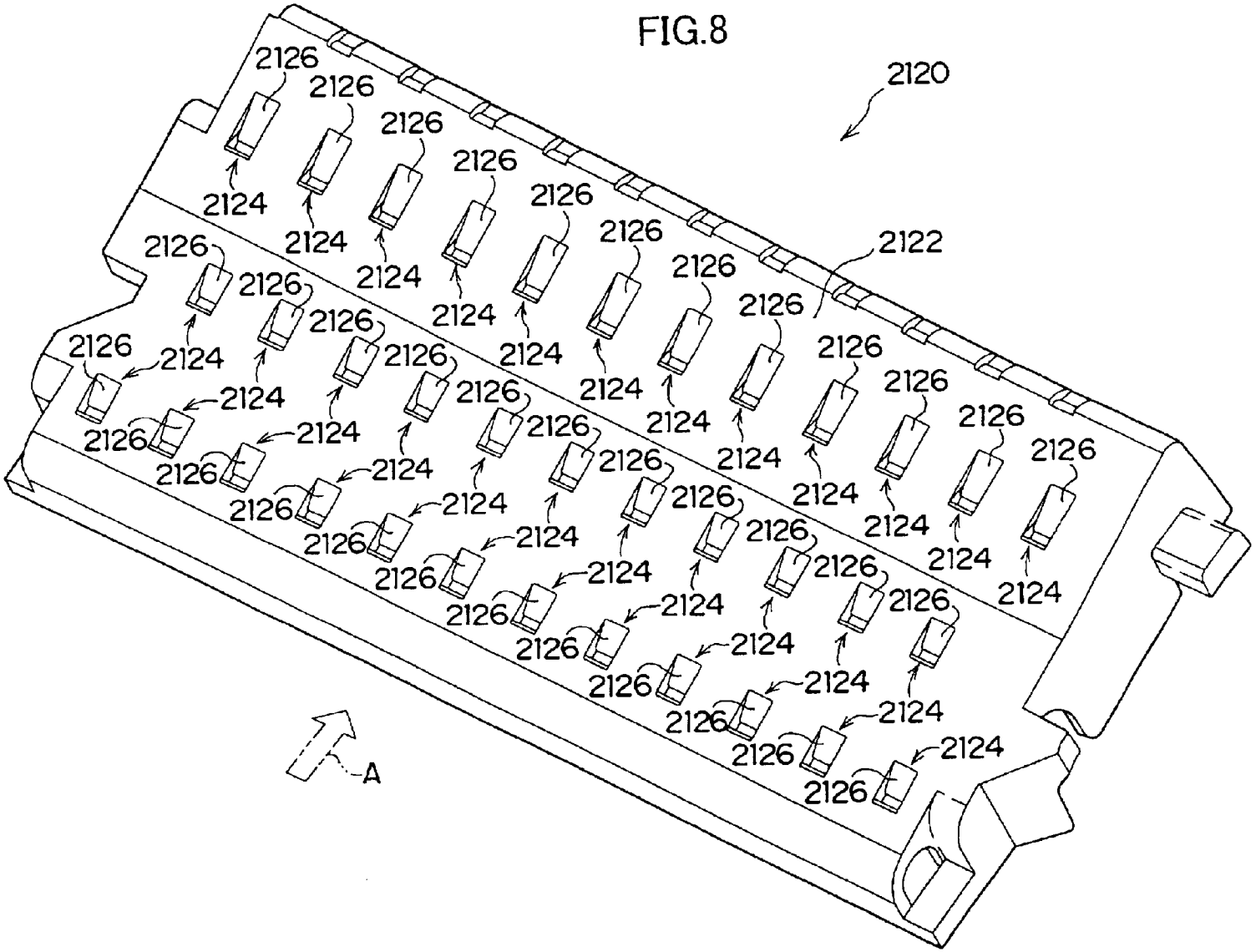
FIG. 8 is a perspective view which schematically shows another example of a guide main body which can be applied to the guide plate.

For example, through holes 2124 formed in a guide main body 2120 shown in FIG. 8 each have a rectangular opening at the side of a guide surface 2122. It suffices that the through holes 2124 are formed in the guide main body 2120 so that the angle θ which is the sum of the angle β formed between the guide surface 2122 and an internal surface 2126 of the through hole 2124 at the downstream side in the conveying direction of the PS plate 212, and the angle α formed between the PS plate 212 and the guide surface 2122 is less than 90 degrees, and more preferably less than 45 degrees.

In the present embodiment, the guide plate 246 within the developing tank 224 was described as an example, but naturally, the present embodiment can also be applied to the guide plate 244.

Further, the photosensitive material processing apparatus using the guide plates to which the present invention is applied is not limited to the PS plate processor 210. That is, the present invention can also be applied to a PS plate processor having any suitable structure in which a conveyance path of a PS plate is formed using a guide plate in which through holes are formed for circulation of a processing solution, or to a photosensitive material processing apparatus having any suitable structure in which not only the PS plate 212, but other photosensitive material such as photographic printing paper or a film are processed.

Moreover, in the present embodiment, there was described the guide surface 2104 or 2122 of the guide main body 2100 or 2120, which is bent to become a concave surface. However, the present invention is not limited to the same, and the guide surface may be formed as a flat surface.

As described above, the present embodiment has an excellent effect that the sum of the angle α formed between a photosensitive material and a guide surface which faces a conveyance path of the photosensitive material, and the angle β formed between the guide surface and an internal surface of a through hole is made into an acute angle, thereby reliably preventing damage to the photosensitive material and transport deficiency, which is caused by a corner of the photosensitive material moving into the through hole, and reliably allowing smooth conveying of the photosensitive material.

[Third Embodiment]

Next, a third embodiment of the present invention will be described with reference to the attached drawings. A photosensitive material processing apparatus according to the third embodiment is basically the same as the photosensitive material processing apparatus according to the first embodiment except that a preprocessing apparatus is provided which carries out preprocessing such as removal of an overcoat layer, prior to development processing of a printing plate such as a photopolymerization plate having an overcoat layer formed thereon. Therefore, only structures and operation of the preprocessing apparatus peculiar to the present embodiment will be described hereinafter and the same structures and operation as those of the first embodiment will be basically omitted.

Figure 9:
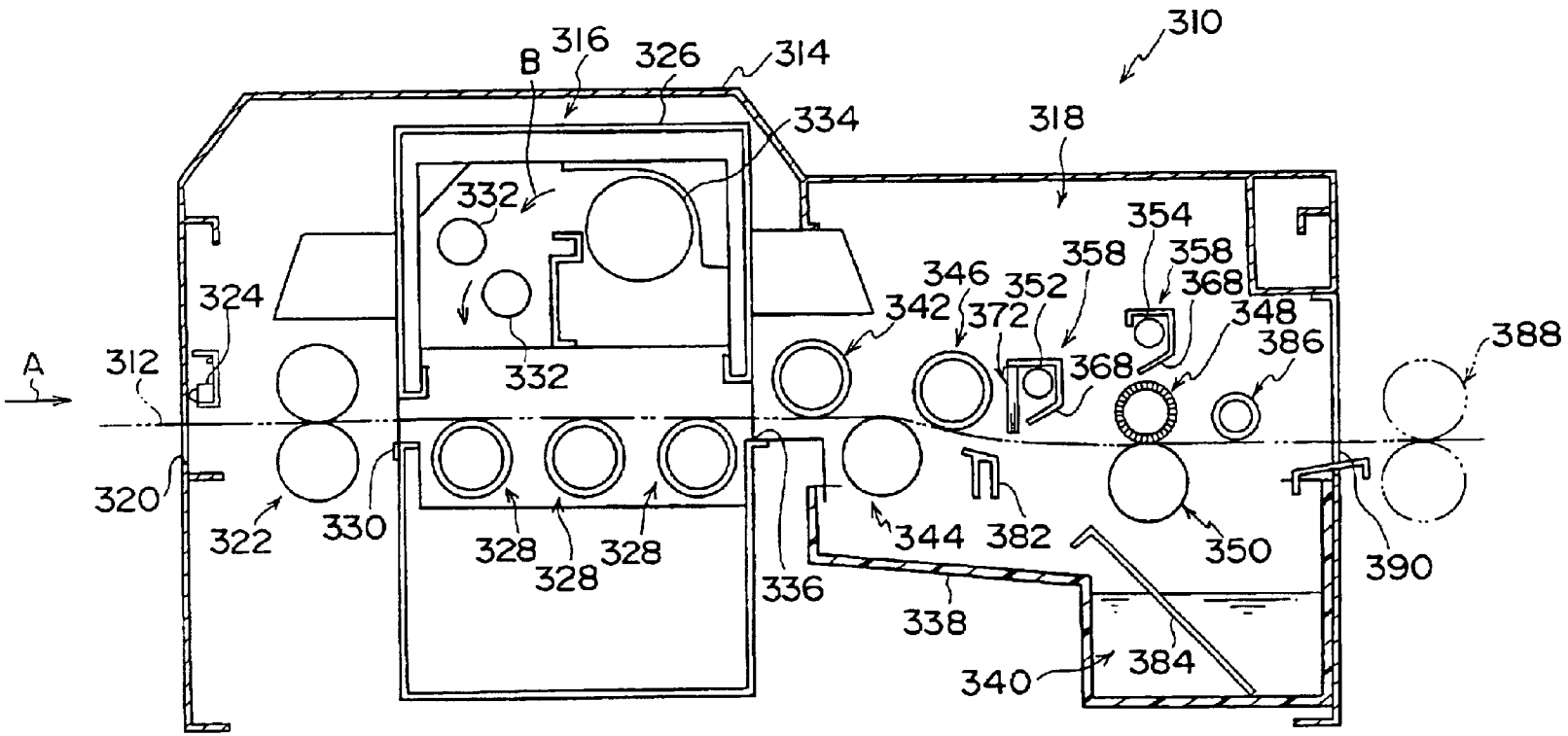
FIG. 9 is a schematic structural diagram of a preprocessing apparatus based on a third embodiment of the PS plate processor according to the present invention.

FIG. 9 schematically shows the structure of a preprocessing apparatus 310 according to the present embodiment.

The preprocessing apparatus 310 is used when development processing is carried out after a planographic printing plate, in which a photosensitive layer has been formed on one surface of a support (a rectangular thin film made of aluminum or the like), is exposed imagewise by an exposure device (not shown). More specifically, the preprocessing apparatus 310 is used to carry out pre-heating processing and pre-washing processing prior to development processing. As for a planographic printing plate to be processed by the preprocessing apparatus 310, a so-called photopolymerization plate (hereinafter referred to as a "photopolymerization plate 312") is used in which an overcoat layer, such as an oxygen cutoff layer, is formed on an upper surface of a photosensitive layer formed by a light adhesive layer and a photopolymerization layer being overlapped with each other.

That is, the present embodiment is applied to a case in which a photopolymerization plate is used in the photosensitive material processing apparatus of the present invention, and the preprocessing apparatus for preprocessing a photopolymerization plate is a part of the photosensitive material processing apparatus.

When the photopolymerization plate 312 having a four-layer structure is exposed imagewise by scanning thereon laser light based on image data using an exposure device such as a setter, a polymerization reaction is accelerated in an image portion of a photopolymerization layer. Further, when the photopolymerization plate 312 is subjected to heating processing (pre-heating processing) prior to development processing, a polymerization reaction is accelerated in a photopolymerization layer of an image portion, so that the photopolymerization layer is firmly adhered to a support via a light adhesive layer. As a result, resistance to printing can be improved. Furthermore, due to the photopolymerization plate 312 being subjected to pre-washing processing to allow removal of an overcoat layer, the time for development processing can be reduced and the product quality is improved.

In the preprocessing apparatus 310, the photopolymerization plate 312 is subjected to pre-heating processing and pre-washing processing prior to development processing. The photopolymerization plate 312 preprocessed by the preprocessing apparatus 310 is basically subjected to development processing by the same automatic processor as that of the first embodiment. However, an automatic processor having any suitable structure may be used so long as it allows development processing for the photopolymerization plate 312. Further, the preprocessing apparatus 310 applied to the present embodiment may be used alone separately from the automatic processor, or may be used in a state of being connected to the automatic processor.

In an apparatus casing 314 of the preprocessing apparatus 310, a pre-heating section 316 for a pre-heating process is provided at the upstream side in the conveying direction of the photopolymerization plate 312, and a pre-washing section 318 for a pre-washing process is provided at the downstream side in the conveying direction of the photopolymerization plate 312.

In the apparatus casing 314, an insertion opening 320 is formed at the upstream side of the pre-heating section 316, and a conveyance roller pair 322 is provided between the insertion opening 320 and the pre-heating section 316. When the photopolymerization plate 312 is inserted in the insertion opening 320 along the direction indicated by arrow A, it is pulled in by being nipped by the conveyance roller pair 322. A plate detecting sensor 324 is provided at an inner side of the insertion opening 320. When the plate detecting sensor 324 detects the leading end of the photopolymerization plate 312 inserted from the insertion opening 320, driving of the conveyance roller pair 322 and the like is started.

In the pre-heating section 316, a plurality of skewer rollers 328 are provided within a heating chamber 326. The skewer rollers 328 are each formed in such a manner that, for example, a plurality of short rollers are rotatably supported along the axial direction with a predetermined space therebetween and made slightly movable along the axial line. Even if a support thermally expands due to the photopolymerization plate 312 being heated in the pre-heating section 316, occurrence of an undulate state of a support is prevented by the skewer rollers 328.

In the heating chamber 326, heaters 332 serving as heating means are provided near an inlet 330 and a circulating fan 334 is provided at the upstream side of the heaters 332.

The circulating fan 334 supplies the air to the heaters 332 and blows out the heated air against the conveyance path of the photopolymerization plate 312. The air within the heating chamber 326 is thus agitated so that the temperature thereof becomes substantially uniform and reaches a predetermined temperature. At this time, the circulating fan 334 blows out the air, heated by the heaters 332 provided near the inlet 330, against the conveyance path of the photopolymerization plate 312 (in the direction indicated by arrow B) to remove cold air on the surface of the photopolymerization plate 312 inserted from the inlet 330, from the surface of the photopolymerization plate 312, thereby accelerating heating of the photopolymerization plate 312 by the heaters 332.

In the pre-heating section 316, a photopolymerization layer of the photopolymerization plate 312 is properly polymerized and hardened by setting a predetermined temperature and a predetermined heating time when the photopolymerization plate 312 passes through the heating chamber 326. As a result, resistance to printing of the photopolymerization plate 312 is improved.

The photopolymerization plate 312 having passed through the heating chamber 326 is conveyed from the outlet 336 to the pre-washing section 318. A cooling section is provided between the outlet 336 of the heating chamber 326 and the pre-washing section 318. Prior to a supply of washing water to the photopolymerization plate 312 conveyed from the heating chamber 326 in the pre-washing section 318, the photopolymerization plate 312 is cooled by a cooling fan (not shown). As a result, wrinkles in the photopolymerization plate 312, which are caused by the photopolymerization plate 312 being rapidly cooled by washing water supplied in the pre-washing section 318, can be prevented.

The pre-washing section 318 is provided with a washing tank 338, and a washing tank 340 filled with washing water is formed within the washing tank 338.

In the pre-washing section 318, conveyance rollers 342, 344 and 346 are disposed in a zigzag manner from the side of the pre-heating section 316. The conveyance rollers 342 and 346 are provided so as to face the upper surface of the photopolymerization plate 312 and the conveyance roller 344 is disposed between the conveyance rollers 342 and 346 so as to face the lower surface of the photopolymerization plate 312.

As a result, the photopolymerization plate 312 conveyed into the pre-washing section 318 is conveyed between the conveyance rollers 342 and 346, and the conveyance roller 344.

Further, the upper end of the conveyance roller 344 is located at a position higher than the lower ends of the conveyance rollers 342 and 346. The conveyance rollers 342 and 346 are provided so that a line tangential to respective lower ends thereof is directed downward at the downstream side in the conveying direction. Therefore, when the photopolymerization plate 312 is conveyed between the conveyance rollers 342 and 346, the photopolymerization plate 312 is bent by the conveyance roller 344 so as to be made slightly convex at an upper side thereof, and thereafter, the photopolymerization plate 312 is conveyed out from between the conveyance rollers 344 and 346 slightly diagonally to the lower side.

The conveyance rollers 342 and 346 are each formed as a skewer roller in which a plurality of short rollers are slightly movable along the axial direction thereof. Due to this structure of each conveyance roller and the aforementioned zigzag arrangement of the conveyance rollers 342,

344 and 346, even if the photopolymerization plate 312 shrinks by being heated in the pre-heating section 314, occurrence of wrinkles or the like is prevented.

In the pre-washing section 318, a brush roller 348 and a back-up roller 350 are provided in a pair at the downstream side of the conveyance roller 346 with the one above the other. The position at which the brush roller 348 and the back-up roller 350 contact each other is lower than the lower end of the conveyance roller 346. As a result, the photopolymerization plate 312 is conveyed and inserted in between the brush roller 348 and the back-up roller 350 slantingly from the position between the conveyance rollers 344 and 346.

In the pre-washing section 314, a spray pipe 352 is provided between the conveyance roller 346 and the brush roller 348, and a spray pipe 354 is provided above the brush roller 348. The spray pipes 352 and 354 are each supplied with washing water within the washing tank 340 using a washing pump (not shown) or the like. Any conventionally known structure can be used to supply washing water to the spray pipes 352 and 354, and therefore, a detailed description thereof will be omitted in the present embodiment.

Figure 10:
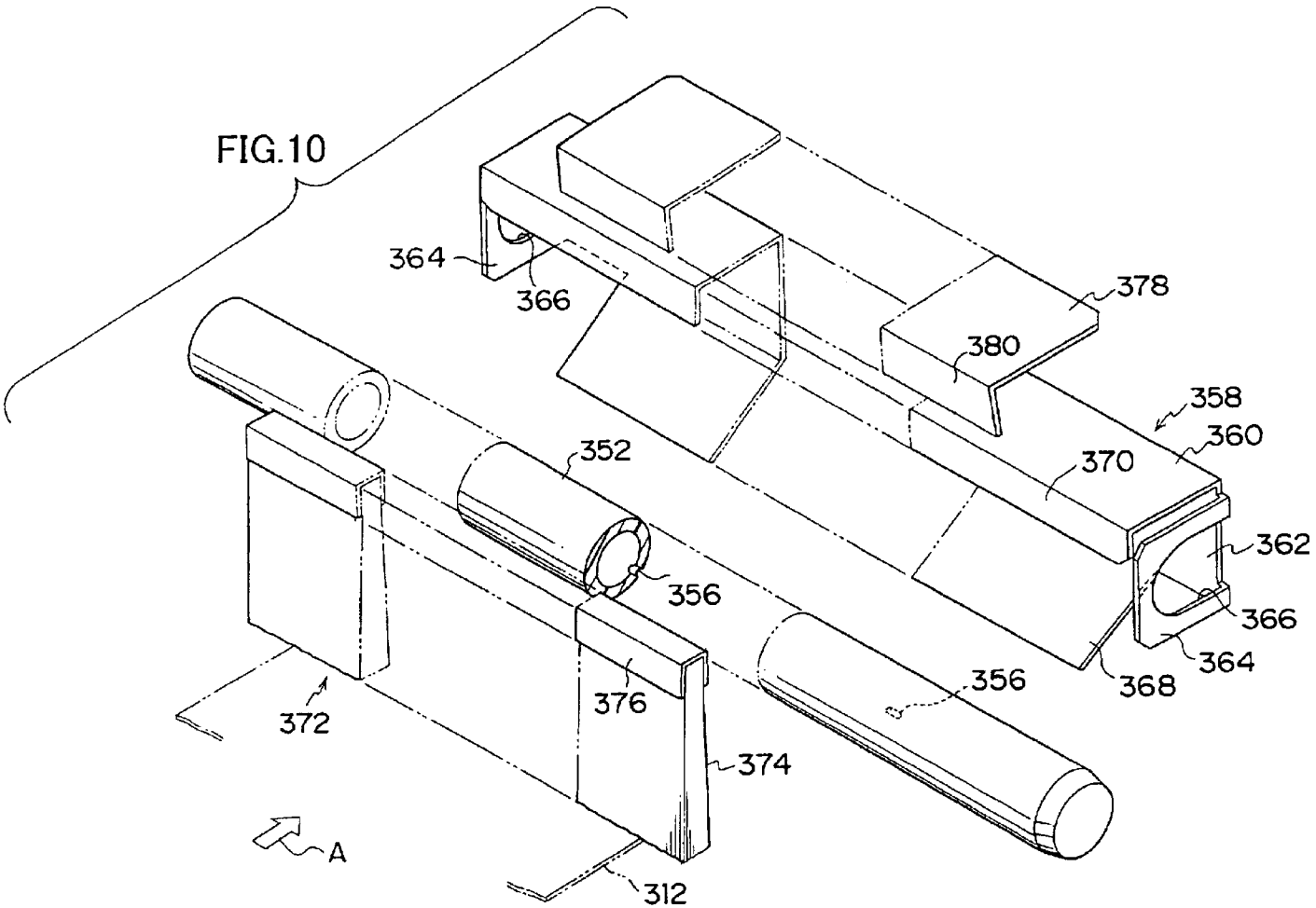
FIG. 10 is an exploded perspective view of a principal portion which schematically shows the structure in the vicinity of a spray pipe based on the third embodiment.

As shown in FIG. 10, the spray pipe 352 is hollow and one end thereof in the longitudinal direction is opened. A plurality of holes 356 are formed in the spray pipe 352 at predetermined intervals along the longitudinal direction of the spray pipe 352. As a result, washing water supplied to the spray pipe 352 is jetted out from the holes 356.

Figure 11:
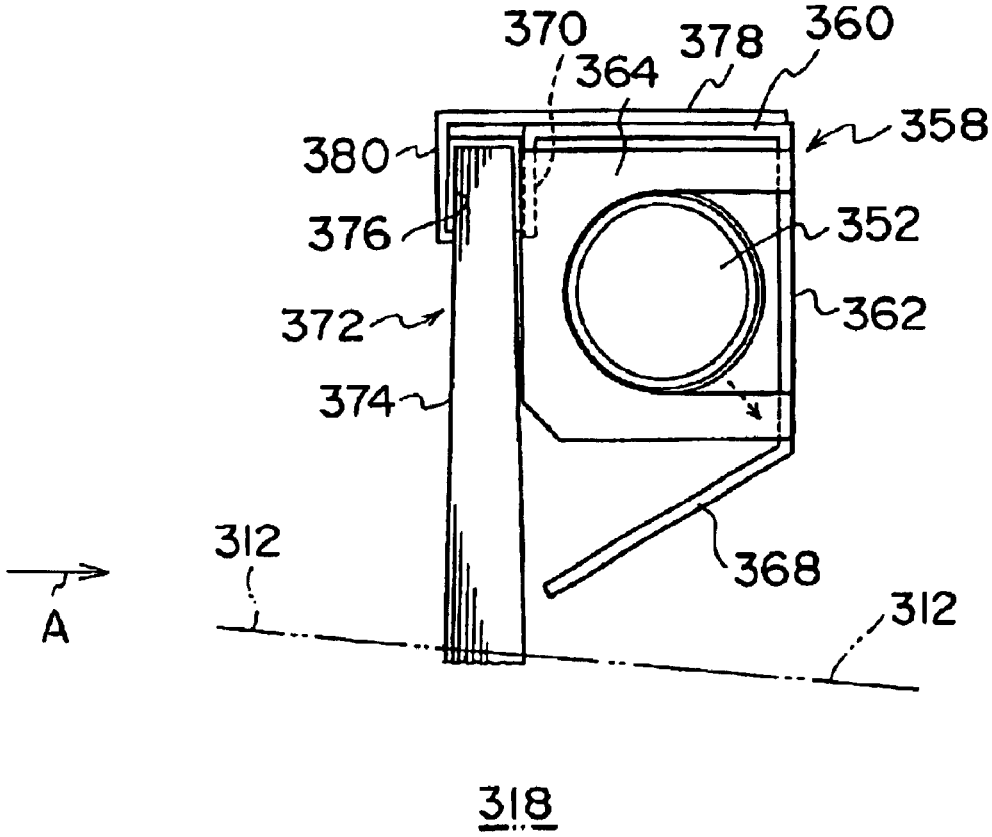
FIG. 11 is a schematic structural diagram of a principal portion when the structure in the vicinity of the spray pipe based on the third embodiment is seen from a direction orthogonal to a direction in which a photopolymerization plate is conveyed.

As shown in FIGS. 10 and 11, a holder 358 is mounted at the spray pipe 352. The holder 358 is formed so as to have a substantially L-shaped cross sectional configuration by a top plate 360 disposed substantially in the horizontal direction, and a hanging plate 362 extending downward from one widthwise direction end of the top plate 360. The holder 358 is disposed so as to extend along the longitudinal direction of the spray pipe 352.

Both longitudinal-direction ends of the hanging plate 362 are each bent inward to form a pair of leg plates 364. The leg plates 364 each include an insertion hole 366 corresponding to an outer diameter of the spray pipe 362.

Further, a flow-straightening plate 368 is provided in the holder 358 so as to extend from a lower end of the hanging plate 362 in the widthwise direction thereof. When the top plate 360 of the holder 358 is disposed substantially in the horizontal direction, the flow-straightening plate 368 is inclined so as to face diagonally to the lower side.

The holder 358 is connected to the spray pipe 352 in such a manner that the spray pipe 352 is inserted in each of the insertion holes 366 from the side of one longitudinal-direction end thereof. At this time, the spray pipe 352 and the holder 358 are held by a bracket (not shown) so that the holes 356 are directed to the vicinity of the bent portion between the hanging plate 362 and the flow-straightening plate 368, and further mounted at a predetermined position in the pre-washing section 318 so that the longitudinal direction of the spray pipe 352 coincides with the widthwise direction of the photopolymerization plate 312 orthogonal to the conveying direction of the photopolymerization plate 312.

As a result, washing water jetted out from the holes 356 of the spray pipe 352 flows down on the flow-straightening plate 368 while being diffused in the widthwise direction of the photopolymerization plate 312, that is, the longitudinal direction of the flow-straightening plate.

An attachment plate 370 is formed at an end of the top plate 360 of the holder 358 opposite to a side in which the hanging plate 362 is formed. The attachment plate 370 is formed by bending a widthwise direction end of the top plate 360 so as to be made substantially parallel to the hanging plate 362, and the spray pipe 352 is disposed between the hanging plate 362 and the attachment plate 370.

A channel brush 372 serving as a dampening member is mounted in the attachment plate 370. For the channel brush 372, any suitable structure can be used in which, for example, a bundle of brush material 374 of a predetermined length is folded back at the intermediate portion thereof, and the folded intermediate portion is inserted in a channel member 376 having a substantially U-shaped cross sectional configuration, and the brush material 374 is fixed to the channel member 376 by carrying out caulking processing for the channel member 376, and thereafter, the ends of the brush material 374 is trimmed so as to be aligned to a predetermined length.

Further, a presser plate 378 is mounted to the holder 358. The presser plate 378 is bent along the widthwise direction thereof at an angle slightly smaller than a right angle to form a presser portion 380. As the presser plate 378 is mounted to the plate 360 of the holder 358, the presser portion 380 is made to face the attachment plate 370 of the holder 358.

The channel brush 372 is formed so that the channel member 376 is made to face the attachment plate 370 of the holder 358 with the brush material 374 disposed at the lower side. In this state, the presser plate 378 is mounted at the top plate 360 of the holder 358. At this time, the channel brush 372 is mounted to the holder 358 by fixing the channel member 376 to the holder 358 with the channel member 376 interposed between the attachment plate 370 and the presser portion 380.

As shown in FIG. 11, in the channel brush 372 mounted to the holder 358, the lower end of the brush material 374 reaches a position lower than the flow-straightening plate 368. As a result, washing water jetted out from the spray pipe 352 adheres to the brush material 374 of the channel brush 372 and is held within the brush material 374, and excessive washing water flows out from the brush material 374.

As shown in FIGS. 9 and 11, the leading end of the brush material 374 of the channel brush 372 is made to protrude toward the conveyance path of the photopolymerization plate 312 inclined between the conveyance roller 346 and the brush roller 348. As a result, the channel brush 372 (brush material 374) abuts and rubs against the surface of the photopolymerization plate 312 conveyed from a position between the conveyance rollers 344 and 346 to a position between the brush roller 348 and the idle roller 350.

Further, as shown in FIG. 10, the transverse dimension of the channel brush 372 is longer than that of the photopolymerization plate 312. As a result, the channel brush 372 is made to evenly abut against an entire region of the photopolymerization plate 312 along the widthwise direction thereof.

At this time, when washing water is jetted out from the spray pipe 352, washing water is evenly supplied to the upper surface of the photopolymerization plate 312.

As shown in FIG. 9, the holder 358 is mounted to the spray pipe 354 disposed above the brush roller 348. The lower end of the flow-straightening plate 368 of the holder 358 is directed to the upper portion of the brush roller 348. As a result, washing water jetted out from the spray pipe 354 is supplied to the brush roller 348 while being diffused by the flow-straightening plate 368 along the axial direction of the brush roller 348.

When the photopolymerization plate 312 is nipped between the brush roller 348 and the idle roller 350, the brush roller 348 is adapted to have a predetermined brush pressure. As a result, when the photopolymerization plate 312 passes through a position between the brush roller 348 and the idle roller 350 with the brush roller 348 being rotated in a predetermined direction, the brush roller 348 brushes the surface of the photopolymerization plate 312.

As shown in FIG. 9, a guide plate 382 is provided between the conveyance roller 346 and the spray pipe 352 at the lower side of the conveyance path of the photopolymerization plate 312. When the guide plate 382 is used, the trailing end of the photopolymerization plate 312 conveyed out from between the conveyance rollers 344 and 346 significantly hangs down due to its own weight or the weight of washing water supplied to the surface of the plate, and washing water staying on the surface of the photopolymerization plate 312 runs down. Accordingly, adhesion of washing water staying on the surface of the photopolymerization plate to the conveyance roller 344 is reliably prevented.

Namely, there is no possibility that washing water containing components of an overcoat layer and adhering to the conveyance roller 344 may adhere to a back surface of the photopolymerization plate 312, so that the photopolymerization plate 312 may slip on the idle roller 350 during conveying thereof or the photopolymerization plate 312 may be contaminated.

Further, a guide plate 384 is provided below the idle roller 350 in an inclined manner. Washing water jetting out from the spray pipes 352 and 354 falls from the idle roller 350 on the guide plate 384, so as to prevent bubbling or scattering of washing water, which results from that washing water falling from the idle roller 350 directly hits against the liquid surface of the washing water stored in the washing tank 340.

A skewer roller 386 is provided in the pre-washing section 318 at the downstream side of the brush roller 348. The skewer roller 386 prevents the photopolymerization plate 312, which is being located at the upper side of the conveyance path of the photopolymerization plate 312 and passing through between the brush roller 348 and the idle roller 350, from rising to the liquid surface by being brushed with the brush roller 348 and being moved apart from the conveyance path.

A conveyance roller pair 388 is provided at the downmost position at the downstream side of the pre-washing section 318. The conveyance roller pair 388 discharges the photopolymerization plate 312, while squeezing out washing water supplied from the spray pipes 352 and 354 to the photopolymerization plate 312, from the front and back surfaces of the photopolymerization plate 312.

An overcoat layer at the uppermost position of the photopolymerization plate 312 swells with water and is apt to be peeled off. When the overcoat layer in the swollen state is brushed with the brush roller 348 or the like, the overcoat layer can be reliably removed.

In the pre-washing section 318, washing water is supplied from the spray pipe 352 to the upper surface of the photopolymerization plate 312 discharged from the position between the conveyance rollers 344 and 346, to swell the overcoat layer, and thereafter, the photopolymerization plate is brushed with the brush roller 348 to remove an overcoat layer from the upper surface of the photopolymerization plate 312.

In the pre-washing section 318, the overcoat layer removed from the surface of the photopolymerization plate 312 is recovered, together with washing water, in the washing tank 340. Further, the washing tank 340 is provided so that fresh washing water is supplied thereto by fresh water supplying (or replenishing) means (not shown). As a result, excessive washing water and the removed overcoat layer are discharged from the washing tank 340 by overflow means (not shown).

The conveyance roller pair 388 is disposed in the apparatus casing 314 and is used to discharge the photopolymerization plate 312 from an exhaust opening 390. As shown in FIG. 9, when the conveyance roller pair 388 within the apparatus casing 314 is omitted and a processing apparatus such as an automatic processor is disposed adjacent to the downstream side of the preprocessing apparatus 310, a conveyance roller pair provided at the most upstream position at the upstream side of the processing apparatus may be used as the conveyance roller pair 388.

In the preprocessing apparatus 310 structured as described above, when the photopolymerization plate 312 exposed imagewise is inserted in the pre-heating section 316, the photopolymerization plate 312 is heated at a predetermined heating temperature and for a predetermined heating time, to increase the degree of polymerization of a photopolymerization layer in an image portion. As a result, resistance to printing of the photopolymerization plate 312 is increased.

The photopolymerization plate 312 having passed through the pre-heating section 316 is conveyed to the pre-washing section 318. In the pre-washing section 318, the photopolymerization plate 312 is sent out diagonally to the lower side while conveying force is being imparted to the photopolymerization plate 312 by the conveyance rollers 342, 344 and 346 disposed in a zigzag manner. As a result, the photopolymerization plate 312 is conveyed to a position between the brush roller 348 and the back-up roller 350.

In the preprocessing apparatus 310, when a state in which the photopolymerization plate 312 is inserted is detected by the plate detecting sensor 324, the conveyance roller pair 322 and the like are driven, to start conveying processing of the photopolymerization plate 312. At the same time, in the preprocessing apparatus 310, based on a timing of detecting a plate by the plate detecting sensor 324, washing water within the washing tank 340 is supplied to the spray pipes 352 and 354 provided in the pre-washing section 318.

When washing water is supplied to the spray pipe 354, the spray pipe 354 jets out the washing water toward the flow-straightening plate 368 and supplies the washing water to the brush roller 348 while diffusing the washing water by the flow-straightening plate 368.

Further, when washing water is supplied to the spray pipe 352, the spray pipe 352 supplies the washing water from the holes 356 to the flow-straightening plate 368. As a result, washing water runs down the flow-straightening plate 368 toward the brush material 374 of the channel brush 372 while being diffused by the flow-straightening plate 368 in the longitudinal direction of the channel brush 372, that is, the widthwise direction of the photopolymerization plate 312, so that washing water adheres to the brush material 374 of the channel brush 372 and stays within the brush material 374.

The leading end of the photopolymerization plate 312 sent out from a position between the conveyance rollers 344 and 346 is conveyed between the brush roller 348 and the idle roller 350 while the leading end abuts against the end of the channel brush 372. At this time, the brush material 374 of the channel brush 372 protruding toward the conveyance path of the photopolymerization plate 312 abuts and rubs against the leading end of photopolymerization plate 312.

As a result, washing water stored within the brush material 374 of the channel brush 372 is supplied to the leading end of the photopolymerization plate 312. At this time, the brush material 374 of the channel brush 372 are provided so as to contact an entire region of the photopolymerization plate 312 along the widthwise direction thereof, and therefore, washing water is supplied from the brush material 374 of the channel brush 372 to an entire region of the leading end of the photopolymerization plate 312 along the widthwise direction thereof.

The photopolymerization plate 312, to which washing water is uniformly supplied to the entire region along the widthwise direction of the photopolymerization plate, is conveyed in between the brush roller 348 and the idle roller 350 in a state in which an overcoat layer swells with washing water and is apt to be peeled off, and brushed with the brush roller 348.

Accordingly, the overcoat layer is reliably and uniformly removed from the leading end of the photopolymerization plate 312.

Further, when washing water supplied from the spray pipe 352 via the flow-straightening plate 368 is excessively supplied to the channel brush 372, the washing water runs down from the channel brush 372 to the surface of the photopolymerization plate 312 which abuts against the channel brush 372. At this time, the photopolymerization plate 312 is conveyed in an inclined manner so that the position thereof becomes lower at the side of the brush roller 348, and therefore, washing water is accumulated on the surface of the photopolymerization plate 312 at the upstream side of the brush roller 348.

When the washing water is accumulated on the surface of the photopolymerization plate 312, the overcoat layer reliably swells with the washing water. When the photopolymerization plate 312 is brushed with the brush roller 348 in the state in which the overcoat layer has sufficiently swollen, the overcoat layer is reliably removed.

The leading end of the brush material 374 in the channel brush 372 protrudes toward the conveyance path of the photopolymerization plate 312. Therefore, the leading end of the brush material reliably comes into contact with the photopolymerization plate 312 up to the trailing end thereof and washing water used to swell the overcoat layer can be supplied entirely to the surface of the photopolymerization plate 312.

Accordingly, an overcoat layer at the trailing end of the photopolymerization plate 312 is also reliably removed.

Further, the photopolymerization plate 312 brushed with the brush roller 348, to remove an overcoat layer therefrom, is nipped by the conveyance roller pair 388 and passed to a subsequent process, in a state in which washing water has been squeezed out from the photopolymerization plate 312 together with the overcoat layer removed from the surface of the photopolymerization plate 312.

As described above, in the preprocessing apparatus 310 applied to the present embodiment, brushing with the brush roller 348 is carried out by supplying washing water to the photopolymerization plate 312 from the leading end to the trailing end thereof, and therefore, in a reliably manner, there is no possibility that the overcoat layer may remain unevenly at the leading and trailing ends of the photopolymerization plate. Accordingly, there is no possibility that the overcoat layer remaining on the surface of the photopolymerization plate 312 partially delays development during developing processing of the photopolymerization plate 312, thereby causing uneven finishing such as uneven development. In other words, the surface of the photopolymerization plate 312 can be finished by being uniformly subjected to development processing.

The aforementioned embodiment is not provided so as to restrict the structure of the present invention thereto. For example, in the present embodiment, the channel brush 372 is used as the dampening member, but the present invention is not limited to the same. The channel brush 372 can be replaced with a common brush, a band-shaped cloth material such as textile fabrics having a high water holding property, or a sponge material. Here, the channel brush 372 preferably has a high wear resistance, thereby suppressing wear thereof caused by contact with the surface of the photopolymerization plate 312. The channel brush 372 thus formed can be used for a long period of time.

Further, in the present embodiment, washing water jetted out from the spray pipe 352 is supplied to the brush material 374 of the channel brush 372 via the flow-straightening plate 368. However, washing water may also be jetted out directly toward the brush material 374 by turning the holes 374 toward the brush material 374 without using the flow-straightening plate 368.

Moreover, the aforementioned structure can be applied to a preprocessing apparatus having any suitable structure, in which the surface of a planographic printing plate such as a photopolymerization plate is brushed with a brushing member such as a brush roller while supplying washing water to the surface of the planographic printing plate.

As described above, in the present embodiment, washing water jetted out from the spray pipe can be evenly supplied by a dampening member to an entire region from a leading end to a trailing end of the planographic printing plate in the conveying direction, along the widthwise direction of the planographic printing plate. Therefore, when, for example, an overcoat layer or the like is removed from the surface of the planographic printing plate, the state in which the overcoat layer partially remains can be reliably prevented. That is, the overcoat layer or the like can be removed from an entire region on the surface of the planographic printing plate.

As a result, an excellent effect is obtained in which partial remaining of the overcoat layer is reliably prevented. As a result, unevenness in finishing such as uneven development is reliably prevented.

[Fourth Embodiment]

Figure 12:
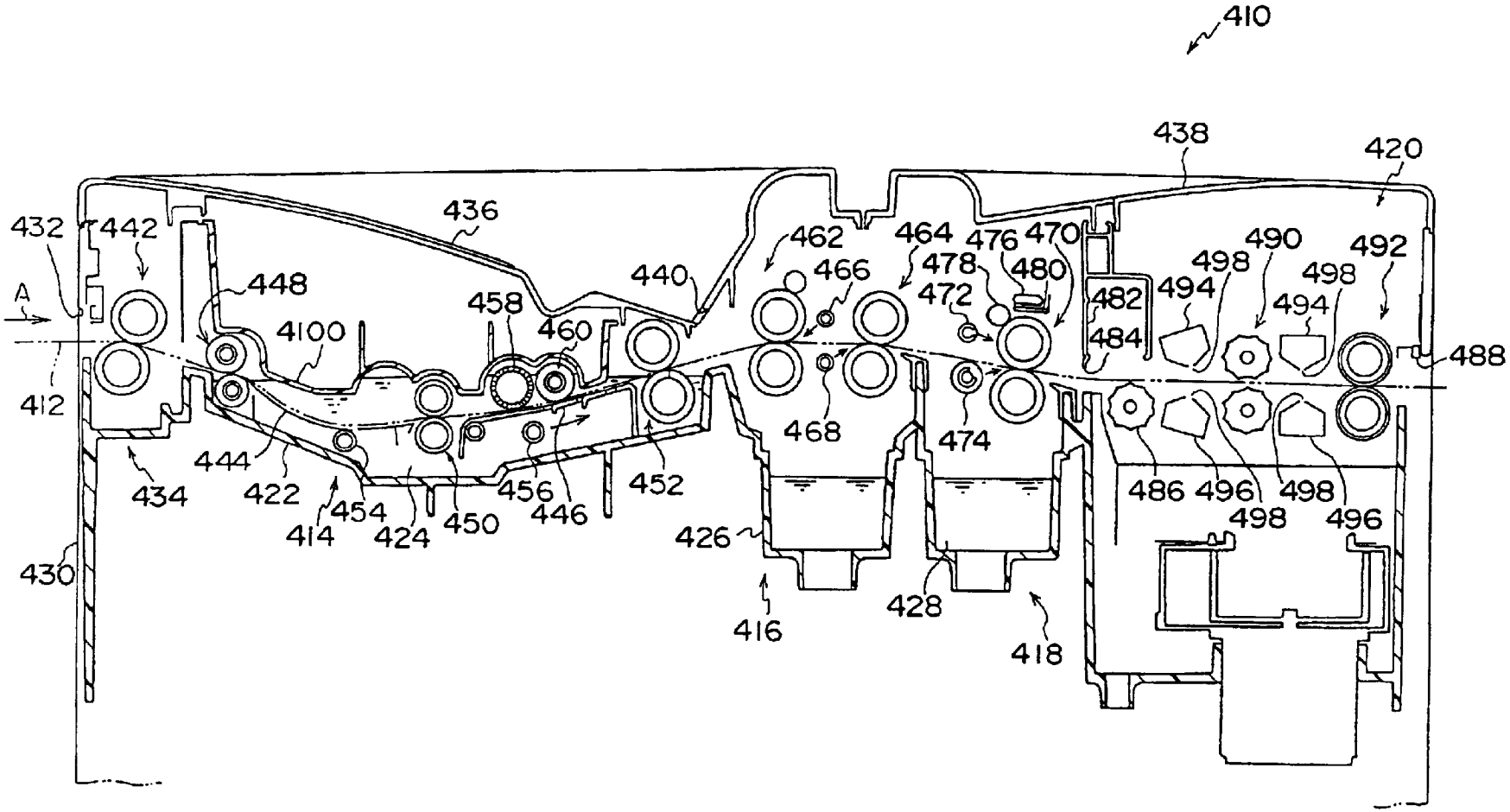
FIG. 12 is a schematic structural diagram of a PS plate processor according to a fourth embodiment of the present invention.

Next, a fourth embodiment of the present invention will be described with reference to the attached drawings. FIG. 12 schematically shows the structure of a photosensitive planographic printing plate processor (hereinafter referred to as a "PS plate processor 410") based on a photosensitive material processing apparatus of the present embodiment.

The present embodiment is similar to the aforementioned first embodiment. Therefore, only structures and operation different from those of the first embodiment will be described and the same structures and operation as those of the first embodiment will be basically omitted.

The PS plate processor 410 based on the fourth embodiment is noticeably different from the PS plate processor 110 of the first embodiment in that conveyance rollers of the processor 410 disposed in a pair are easily mounted in a removable manner and nipping force is easily imparted to the conveyance rollers. A device used to remove/attach the conveyance rollers and impart nipping force will be particularly described hereinafter.

The PS plate processor 410 carries out processing, with a processing solution, for a photosensitive planographic printing plate (used as a photosensitive material and referred hereinafter to as a "PS plate 412") exposed imagewise by an exposure device (not shown). The PS plate 412 is formed by a support and a photosensitive layer formed on the support, which support is a thin-walled rectangular flat plate such as an aluminum plate. For the PS plate 412, a photopolymerization plate can also be used in which a photosensitive layer is formed by a light adhesive layer, a photopolymerization layer and an overcoat layer in an overlapped state and is exposed imagewise to laser light to accelerate a polymerization reaction in an image portion of the photopolymerization layer.

The PS plate processor 410 of the present embodiment is provided with a plurality of conveyance roller pairs 442, 448, 450, 452, 462, 464, 470, 490, 492 and the like, which nip the PS plate 412 and impart conveying force to the PS plate 412. These conveyance roller pairs each have nipping force for nipping the PS plate 412 between facing conveyance rollers. Further, the conveyance roller pairs 452, 464 and 470 provided at the downstream side in each processing section for processing with a processing solution are each mounted, in a state in which a large nipping force is imparted thereto between facing conveyance rollers for the purpose of squeezing out a processing solution adhering to the surface of the PS plate 412 from the surface of the PS plate 412.

With reference to FIGS. 14 to 18, a holder 4110 used for mounting the conveyance roller pair 464 provided in a washing section 416 of the PS plate processor 410 will be described.

Figure 17:
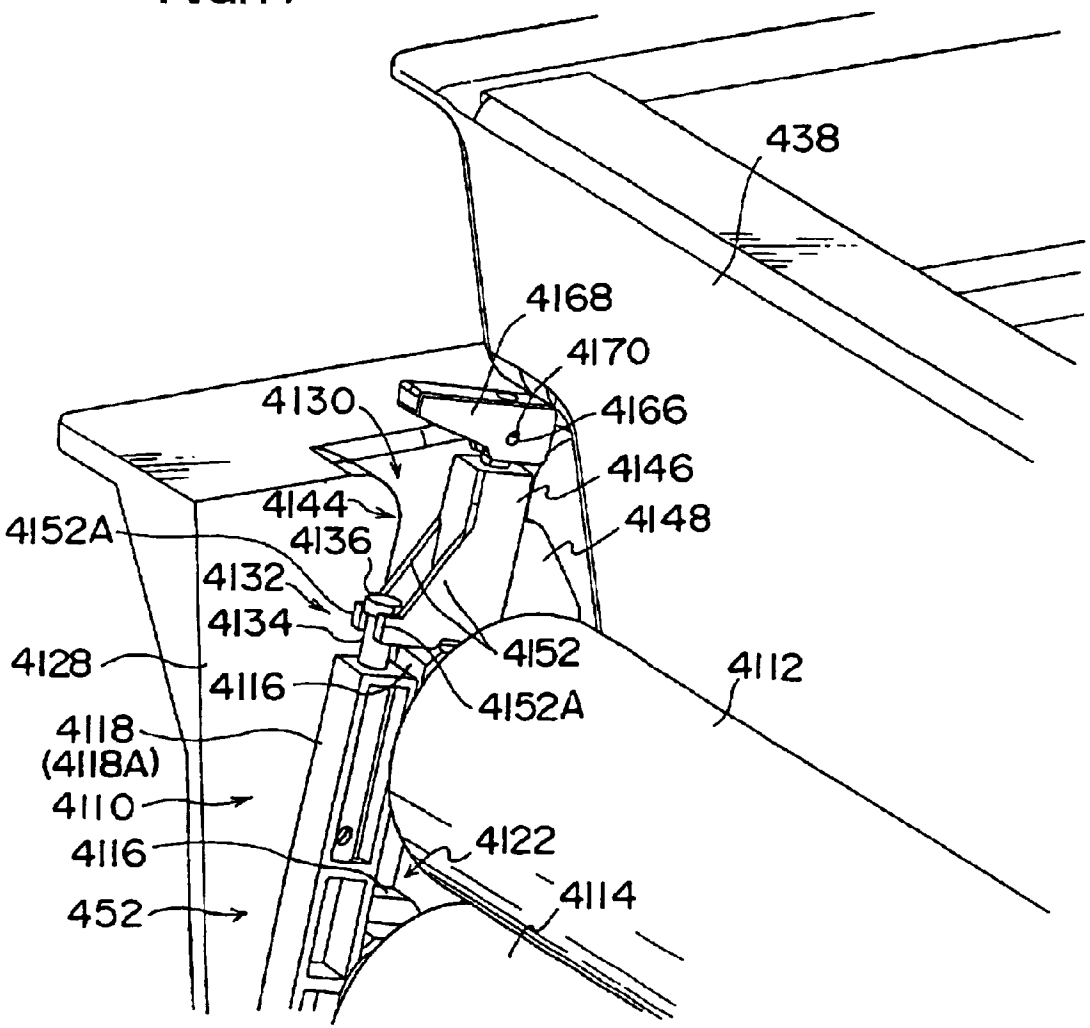
FIG. 17 is a perspective view of a principal portion, which schematically shows relative positions of a cover and the holder in a state in which a lever based on the fourth embodiment is inclined.
Figure 18:
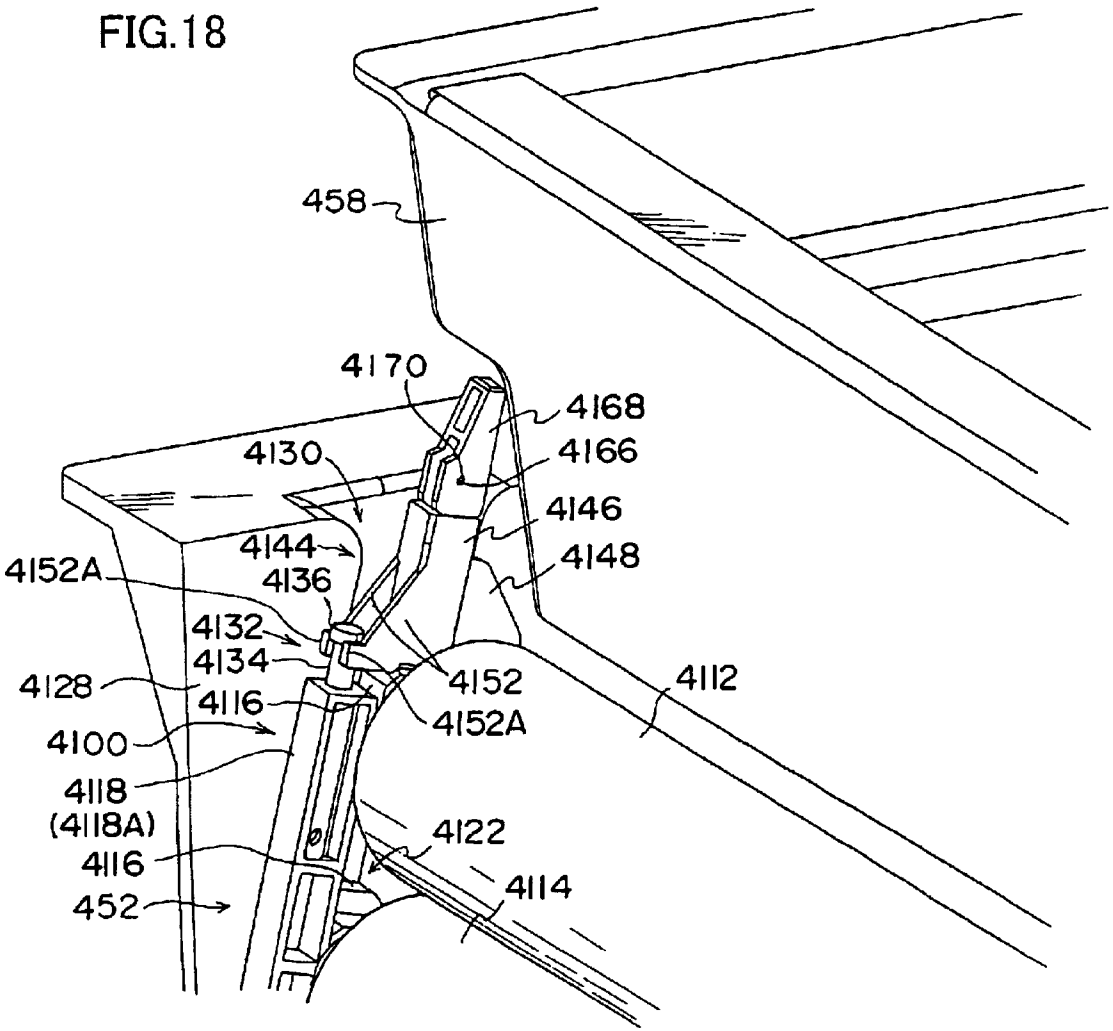
FIG. 18 is a perspective view of a principal portion, which schematically shows relative positions of the cover and holder in a state in which the lever is set upright.

As shown in FIGS. 17 and 18, the conveyance roller pair 464 is formed by an upper conveyance roller 4112 and a lower conveyance roller 4114 and is provided so as to nip the PS plate 412 between the conveyance rollers 4112 and 4114. The conveyance rollers 4112 and 4114 each may be comprised of, for example, a rubber roller in which an outer periphery of a metal cylinder is covered with an elastic member such as silicone rubber.

The conveyance rollers 4112 and 4114 are each provided with a gear (not shown) at an axial-direction end thereof. A general structure in which respective gears mesh with each other at the outer peripheries thereof and thus the gears (the rollers) are rotated integrally is applied to these conveyance rollers.

A rotating shaft (not shown) protruding from both axial-direction ends of each conveyance roller 4112, 4114 is inserted in a roller bearing 4116. The conveyance rollers 4112 and 4114 of the conveyance roller pair 464 are rotatably supported by holding the roller bearings 4116 at predetermined positions in the washing section 416. At this time, the respective roller bearings 4116 of the conveyance rollers 4112 and 4114 are integrally held by the holder 4110.

As shown in FIGS. 14, 15, 16A and 16B, the holder 4110 is formed so as to have a substantially U-shaped configuration by a pair of side frames 4118 and a lower frame 4120 which connects respective one ends of the pair of side frames 4118. An accommodating portion 4122 for the roller bearings 4116 (see FIGS. 17 and 18) is provided between the pair of side frames 4118. As a result, the roller bearings 4116 are accommodated within the accommodating portion 4122 by being inserted between the side frames 4118 from an open side opposite to the lower frame 4120. In FIGS. 14, 15, 16A and 16B, the roller bearings 4116 mounted in the holder 4110, and the conveyance rollers 4112 and 4114 are not shown.

Figure 15:
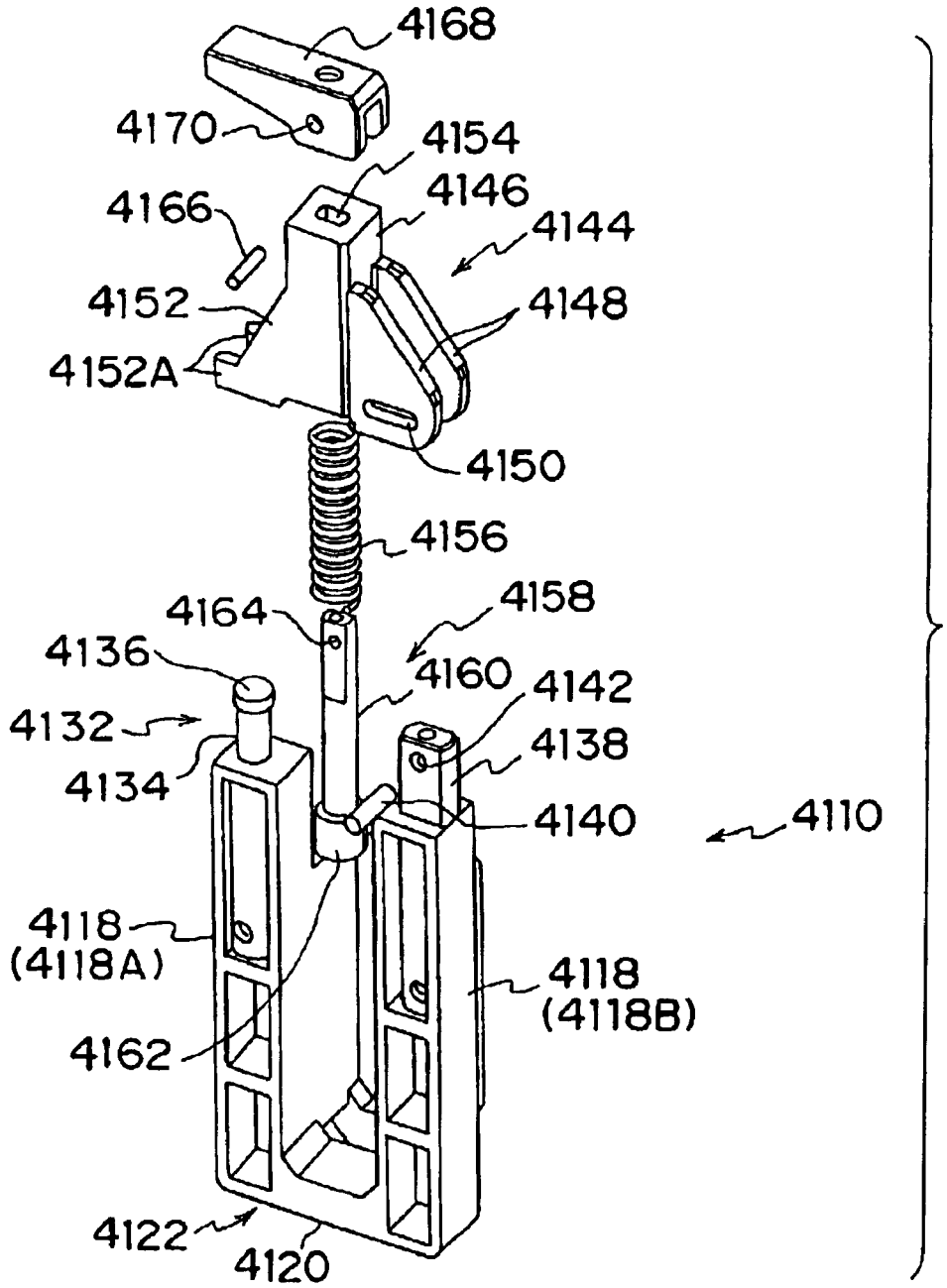
FIG. 15 is a perspective view which schematically shows an exploded state of the presser member provided in the holder.
Figure 16B:
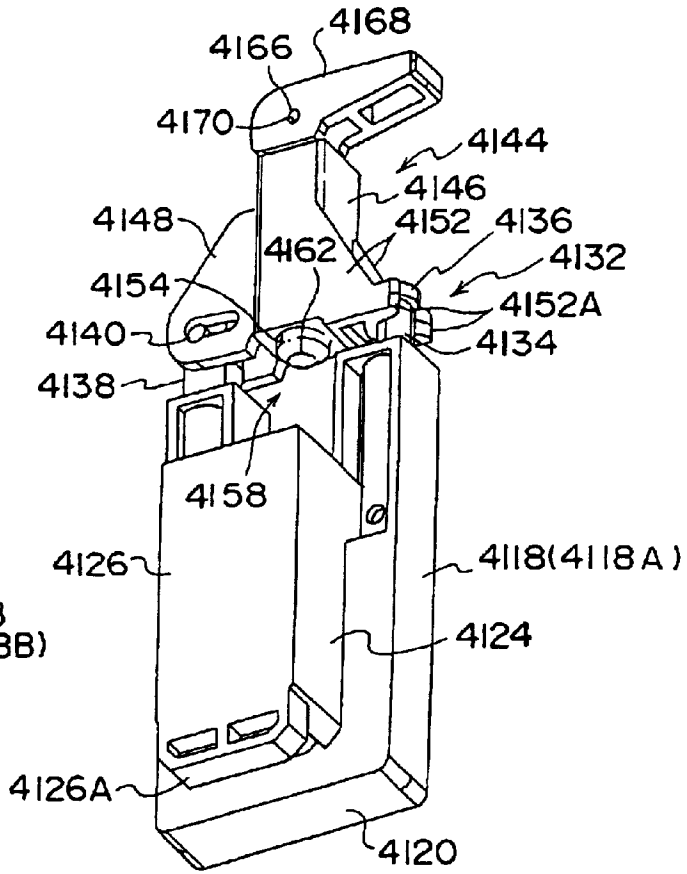
FIG. 16B is a schematic perspective view of the holder when seen from a direction different from one in FIG. 16A.

As shown in FIG. 16B, a leg plate 4124 is formed so as to extend from the pair of side frames 4118. The leg plates 4124 respectively extend from the pair of side frames 4118 in parallel with each other, and the respective ends thereof opposite to the side frames 4118 are connected by a base plate 4126. As a result, the holder 4110 is formed so as to have a substantially U-shaped configuration when seen from the open side of the pair of side frames 4118 (that is, when seen from the upper side in FIGS. 14, 15, 16A and 16B), and the roller bearings 4116 are accommodated in the accommodating portion 4122 so that the conveyance rollers 4112 and 4114 are disposed at a side opposite to the base plate 4126. The roller bearings 4116 are each formed into a rectangular block when seen from outside, and rotation thereof is prevented in a state in which the bearings 4116 are inserted between the pair of side frames 4118.

Further, the base plate 4126 includes an extending portion 4126A formed so as to extend from the lower end thereof in parallel with the lower frame 4120.

As shown in FIGS. 17 and 18, the holder 4110 is mounted at a pair of side plates 4128 disposed in the washing section 416. A mounting groove 4130 having a widthwise dimension corresponding to an interval between the leg plates 4124 (not shown in these drawings) of the holder 4110 is formed in the side plate 4128 at a predetermined position corresponding to a position at which the conveyance roller pair 464 is mounted. The holder 4110 is inserted from the extending portion 4126A of the base plate 4126 and mounted in the mounting groove 4130. At this time, the holder 4110 is fixed to the side plate 4128 due to a protrusion formed at the lower end of the mounting groove 4130 being fitted in between the extending portion 4126A of the base plate 4126, and the lower frame 4120.

As shown in FIG. 15, a locking pin 4132 is mounted at one of the side frames 4118 (for example, a side frame 4118A). A flange portion 4136 is formed at one end of a shaft 4134, and the locking pin 4132 is fixed to the side frame 4118A in such a manner that the shaft 4134 is inserted in the side frame 4118A from a side opposite to the flange portion 4136. At this time, the locking pine 4132 is fixed with a predetermined interval being formed between the flange portion 4136 and the end of the side frame 4118A.

Further, a presser receiving portion 4138 is mounted at the other side frame 4118 (for example, a side frame 4118B) of the holder 4110. The presser receiving portion 4138 is formed substantially in the shape of a bar and is fixed to the side frame 4118B by being fitted in the side frame 4118B from a longitudinal-direction end thereof.

A pin hole 4142 in which a pin 4140 is inserted is formed in the presser receiving portion 4138 at an end thereof protruding from the side frame 4118B.

As shown in FIGS. 14, 15, 16A and 16B, in the holder 4110, a presser member 4144 is mounted in the pair of side frames 4118. The presser member 4144 is formed in such a manner that a pair of leg plates 4148 are mounted to an elongated block-shaped base portion 4146. The leg plates 4148 are each formed substantially in a triangular shape. Further, a pin hole 4150 is formed in each of the pair of leg plates 4148 so that the longitudinal direction thereof is orthogonal to the longitudinal direction of the base plate 4146.

The presser member 4144 is mounted in such a manner that the presser receiving portion 4138 of the side frame 4118B is interposed between the pair of leg plates 4148, and is further mounted to the side frame 4118B due to the pin 4140, inserted in the pin holes 4150 of the leg plates 4148, being inserted in the pin hole 4142 of the presser receiving portion 4138. At this time, the presser member 4144 is made rotatable around the pin 4140.

Further, a pair of leg portions 4152 facing the locking pin 4132 is formed in the presser member 4144 so as to face a direction opposite to the leg plates 4148. The interval between the leg portions 4152 is slightly wider than the outer diameter of the shaft 4134 of the locking pin 4132 and is narrower than the outer diameter of the flange portion 4136. When the presser member 4144 is mounted to the side frame 4118, respective ends 4152A of the leg portions 4152 are interposed between the flange portion 4136 of the locking pin 4132 and the upper end of the side frame 4118A.

In the state in which the pin 4140 is inserted in the elongated pin holes 4150 of the leg plates 4148, the presser member 4144 can be moved between a fixed position at which the ends 4152A of the leg portions 4152 catch the shaft 4134 below the flange portion 4136 of the locking pin 4132, and a withdrawal position at which the ends 4152A of the leg portions 4152 retreat from the positions below the flange portion 4136 of the locking pin 4132.

The presser member 4144 closes the end side of the pair of side frame 4118 at the fixed position to prevent pullout of the roller bearings 4116 from between the pair of side frames 4118. Further, the presser member 4144 rotates around the pin 4140 at the withdrawal position of the ends 4152A of the leg portions 4152, to open a space between the ends of the pair of side frames 4118 to allow insertion and removal of the roller bearings 4116.

A mounting hole 4154 is formed in the base portion 4146 of the presser member 4144. The mounting hole 4154 is formed along the longitudinal direction of the base portion 4146. The diameter of the mounting hole 4154 at the upper end of the base portion 4146 is made small, and the diameter thereof in a region from the intermediate portion to the lower end portion of the base portion 4146 is made larger.

A compression coil spring 4156 and a pusher pin 4158 are inserted and mounted in the mounting hole 4154. One end of a shaft 4160 of the pusher pin 4158 is enlarged in diameter to form a presser portion 4162. As shown in FIG. 16B, the lower end of the mounting hole 4154 corresponds to the outer diameter of the presser portion 4162, and the shaft 4160 of the pusher pin 4158 is inserted in the mounting hole 4154 so that the presser portion 4162 is disposed at the lower side, that is, at the side of the accommodating portion 4122 between the side frames 4118. At this time, due to the shaft 4160 being inserted in the compression coil spring 4156, the compression coil spring 4156 is disposed within the mounting hole 4154 so as to be able to urge the pusher pin 4158 in a direction in which the presser portion 4162 of the pusher pin 4158 is pushed out from the mounting hole 4154, that is, toward the accommodating portion 4122.

As shown in FIG. 15, a pin hole 4164 is formed at an end of the pusher pin 4158 opposite to the presser portion 4162 of the shaft 4160, and a lever 4168 is mounted to the pusher pin 4158 via a pin 4166 inserted in the pin hole 4164.

As shown in FIGS. 14, 15, 16A and 16B, a pin hole 4170 in which the pin 4166 is inserted is formed at a longitudinal-direction end of the lever 4168. The lever 4168 is connected to the pusher pin 4158 and mounted to the presser member 4144 by inserting the pin 4166 inserted in the pin hole 4170, in the pin hole 4164 (see FIG. 15) formed in the shaft 4160 of the pusher pin 4158. Further, the lever 4168 is rotatable around the pin 4166.

The pin hole 4164 of the shaft 4160 is protruded from the upper end of the base portion 4146 against urging force of the compression coil spring 4156, so that the lever 4168 is mounted to the presser member 4144. The pin hole 4170 in the lever 4168 is positioned so that a distance therefrom to a longitudinal-direction end of the lever is longer than a distance therefrom to an end of the lever in a direction orthogonal to the longitudinal direction.

Figure 16A:
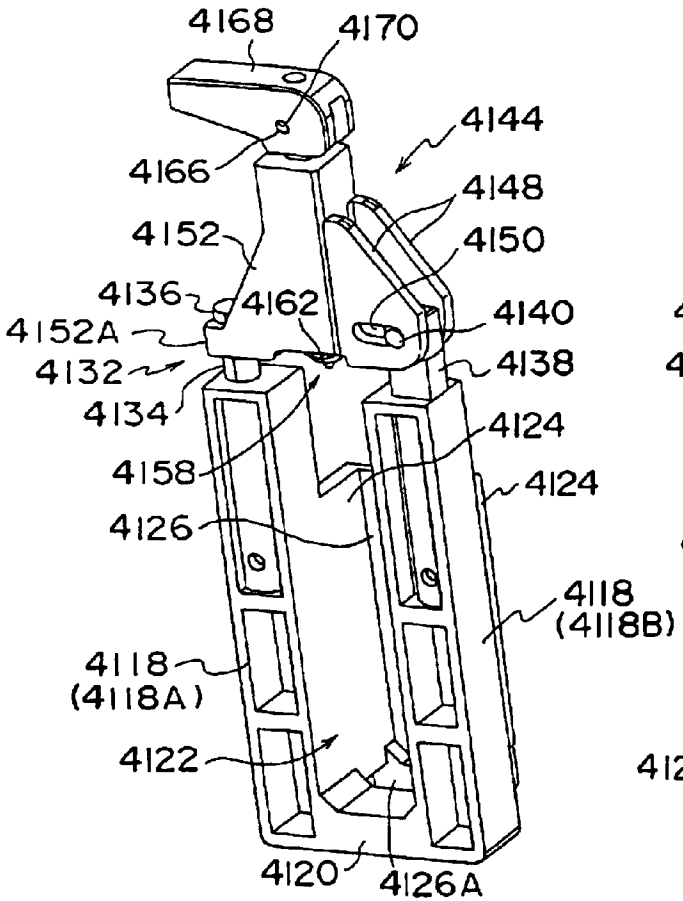
FIG. 16A is a perspective view of the holder which schematically shows a state in which the presser member is inclined.

In the presser member 4144, when the lever 4168 is inclined so that the longitudinal direction thereof is made orthogonal to the longitudinal direction of the base portion 4164, the pusher pin 4158 allows the presser portion 4162 to protrude toward the accommodating portion 4122 due to urging force of the compression coil spring 4156 (see FIGS. 16A and 16B). Further, when the lever 4168 is set upright so that the longitudinal direction thereof coincides with the longitudinal direction of the base portion 4146, and the pusher pin 4158 is pulled up against the urging force of the compression coil spring 4156, the presser portion 4162 of the presser member 4144 is accommodated in the mounting hole 4154.

In the state in which the presser member 4144 spans between the side frames 4118 with the ends 4152A of the leg portions 4152 being inserted in the lower side of the flange portion 4136 of the locking pin 4132, when the lever 4168 is inclined, the presser portion 4162 of the pusher pin 4158 protrudes toward the accommodating portion 4122 of the holder 4110 in which the roller bearings 4116 of the conveyance rollers 4112 and 4114 are accommodated. In the conveyance roller pair 464, the presser portion 4162 protruding from the presser member 4144 due to inclination of the lever 4168 abuts against the roller bearing 4116 of the upper conveyance roller 4112 and the conveyance roller 4112 is, together with the roller bearing 4116, urged toward the conveyance roller 4114.

At this time, the roller bearing 4116 of the lower conveyance roller 4114 abuts against the lower frame 4120 of the holder 4110, and therefore, nipping force at the time of nipping the PS plate 412 is imparted between the conveyance rollers 4112 and 4114 of the conveyance roller pair 464.

Further, in the holder 4110, when the lever 4168 is set upright, the pusher pin 4158 is pulled up against the urging force of the compression coil spring 4156, and the conveyance roller 4112 and the roller bearing 4116 thereof are released from a state of being urged by the compression coil spring 4156.

At this time, the ends 4152A of the leg portions 4152 can be pulled out from the lower side of the flange portion 4136 of the locking pin 4132, and therefore, the presser member 4144 can be made rotatable around the pin 4140.

When the space between the pair of side frames 4118 is opened by rotating the presser member 4144 around the pin 4140, the roller bearings 4116 can be pulled out by lifting up the conveyance rollers 4112 and 4114 of the conveyance roller pair 464.

Figure 13:
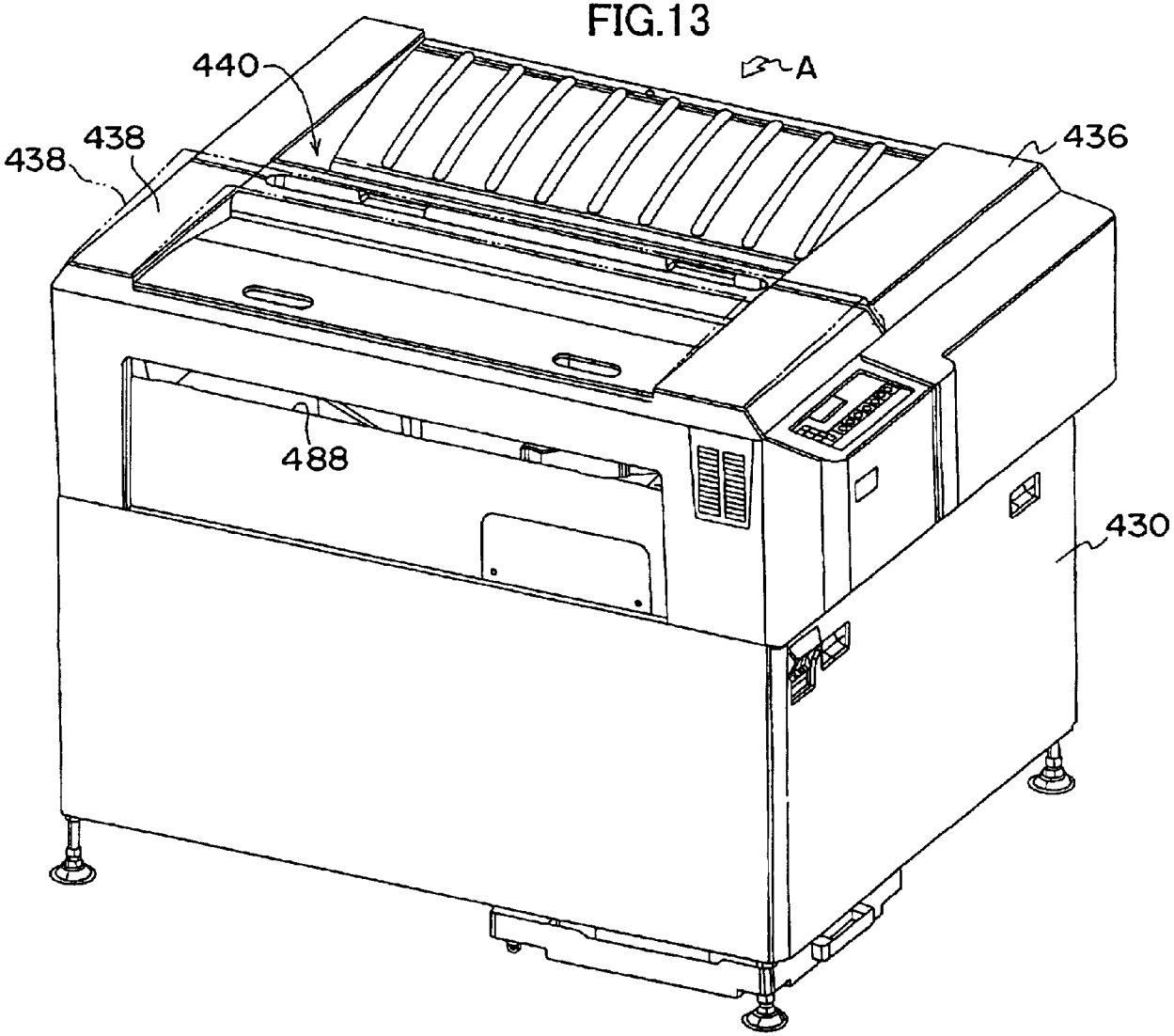
FIG. 13 is a perspective view which schematically shows an exterior of the PS plate processor according to the fourth embodiment.
Figure 14:
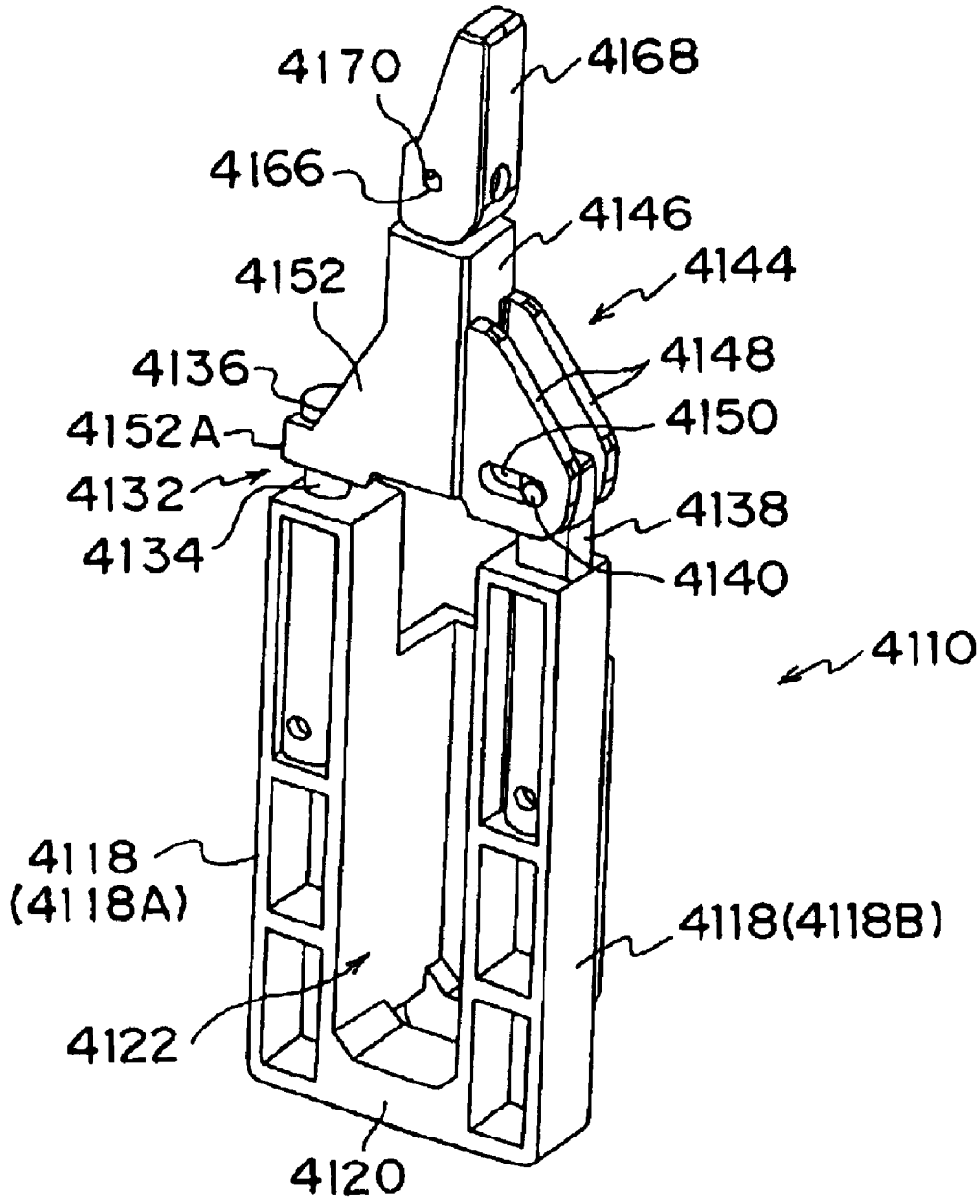
FIG. 14 is a perspective view which schematically shows a holder based on the fourth embodiment in a state in which a lever of a presser member is set upright.

As shown in FIG. 12, a cover 438 which covers the washing section 416 is provided, together with a cover 436, above the conveyance roller pair 464. As shown in FIG. 17, the holder 4110 mounted at the rack side plate 4128 of the washing section 416 is provided so that the lever 4168 does not interfere with the cover 438 due to inclination of the lever 4168. As a result, as indicated by the solid line in FIG. 13, when the cover 438 is mounted in a normal state, the upper portion of the PS plate processor 410 is closely covered.

On the other hand, as shown in FIG. 18, when the lever 4168 of the holder 4110 is set upright, the end of the lever 4168 protrudes upward and interferes with the cover 438. Accordingly, when the upper side of the washing section 416 and the drying section 420 is closed by the cover 438, the lever 4168 abuts against and lifts up the cover 438 (the state indicated by the two-dot chain line in FIG. 13). As a result, nipping force for nipping the PS plate 412 is no longer imparted between the conveyance rollers 4112 and 4114 of the conveyance roller pair 464.

In the PS plate processor 410 structured as described above, when the PS plate 412 on which an image is recorded by being exposed by a printing device (not shown) is inserted from the insertion opening 432, the conveyance roller pair 442 is driven to rotate. As a result, the PS plate 412 is pulled in the PS plate processor 410 in a state in which the PS plate is nipped by the conveyance roller pair 442.

In the PS plate processor 410 of the present embodiment, a plurality of conveyance roller pairs for nipping and conveying the PS plate 412 are provided. In these conveyance roller pairs, a predetermined urging force is imparted between upper and lower conveyance rollers, and during maintenance or the like, it is necessary that the covers 436 and 438 are taken away and the conveyance rollers are removed against urging force imparted between the conveyance rollers.

Next, mounting and removal of conveyance rollers 4112 and 4114 in the conveyance roller pair 464 will be described. In the PS plate processor 410, the holder 4110 is used for mounting the conveyance roller pair 464. In the holder 4110, due to the lever 4168 of the presser member 4144 being set upright from an inclined state, the presser portion 4162 abutting against the roller bearing 4116 of the conveyance roller 4112 can be separated from the bearing 4116 against the urging force of the compression coil spring 4156. As a result, urging force imparted between the conveyance rollers 4112 and 4114 is released.

Further, the presser member 4144 provided in the holder 4110 is structured such that the space between the side frames 4118, in which the roller bearings 4116 are accommodated, can be opened by setting the lever 4168 upright. As a result, due to the bearings 4116 being pulled out from the accommodating portion 4122 by lifting up the conveyance rollers 4112 and 4114, the conveyance rollers 4112 and 4114 can be removed.

As described above, the holder 4110 applied to the present embodiment allows removal of the conveyance roller pair 464 in an extremely simple manner.

When the conveyance roller pair 464 is mounted, the roller bearings 4116 are mounted respectively at rotating shafts of the conveyance rollers 4112 and 4114 and inserted in the accommodating portion 4122 between the pair of side frames 4118 formed in the holder 4110. Subsequently, the presser member 4144 is rotated to close the opening between the side frames 4118 and the ends 4152A of the leg portions 4152 are inserted in the lower side of the flange portion 4136 of the locking pin 4132.

In the aforementioned state, when the lever 4168 of the presser member 4144 is inclined, the presser portion 4162 of the pusher pin 4158 is made to abut against the roller bearing 4116 of the conveyance roller 4112. As a result, the ends 4152A of the leg portions 4152 are pushed against the flange portion 4136 of the locking pin 4132 by urging force of the compression coil spring 41156, to prevent removal of the presser member 4144. Further, the conveyance roller 4112 is urged via the bearing 4116 toward the conveyance roller 4114 kept from moving by the roller bearing 4116 abutting against the lower frame 4120.

As a result, a predetermined nipping force is imparted between the conveyance rollers 4112 and 4114 and the conveyance roller pair 464 is mounted at the rack side plate 4128.

As described above, the holder 4110 applied to the present embodiment facilitates not only removal but also mounting of the conveyance roller pair 464 and assembling efficiency of the conveyance roller pair can be extremely improved.

The nipping force between the conveyance rollers 4112 and 4114 can be adjusted by changing the urging force of the compression coil spring 4156. That is, so long as the compression coil spring 4156 which produces urging force corresponding to a required nipping force is used, the nipping force between the conveyance rollers 4112 and 4114 can be adjusted.

When the presser member 4144 provided in the holder 4110 is mounted to impart a predetermined nipping force to between the conveyance rollers 4112 and 4114, the lever 4168 is inclined. In a state in which no nipping force is imparted between the conveyance rollers 4112 and 4114, the lever 4168 is set upright and abuts against the cover 438 which covers the upper side of the conveyance roller pair 464. In a case in which the cover 438 is mounted to the PS plate processor 410, the cover 438 is lifted up.

As a result, based on a determination as to whether or not the cover 438 is mounted in a normal state, it can be clearly determined whether or not a proper nipping force is imparted to the conveyance roller pair 464.

Further, not only in the PS plate processor 410, but also in various types of automatic processors, generally, an interlock mechanism is provided which can process the PS plate 412 or can be activated so as to process the PS plate 412 only when the covers 436 and 438, or the like are mounted in a normal state.

In such cases, the interlock mechanism can be activated due to the cover 438 being lifted up by the lever 4168. Accordingly, the state in which the PS plate processor 410 is activated with no proper nipping force being imparted to the conveyance roller pair 464 or the like can be reliably prevented.

The aforementioned embodiment does not restrict the structure of the present invention thereto. For example, in the present embodiment, mounting of the conveyance roller pair 464 provided in the washing section 416 was described as an example, but the holder 4110 can also be applied to mounting of any suitable conveyance roller pair which nips and conveys the PS plate 412.

At this time, in the present embodiment, the lever 4168 of the presser member 4144 abuts against and lifts up the cover 438. However, the lever 4168 may abut against and lift up the cover 436. Alternatively, the lever 4168 may abut against a shielding lid 4100 to lift up the cover 436.

Further, the PS plate processor 410 applied to the present embodiment does not restrict thereto the photosensitive material processing apparatus to which the present invention is applied. The aforementioned structure can also be applied to a PS plate processor having any suitable structure in which a planographic printing plate such as a PS plate is nipped and conveyed by conveyance roller pairs. Furthermore, the aforementioned structure can also be applied to a photosensitive material processing apparatus having any suitable structure in which not only a printing plate such as a PS plate, but a photosensitive material such as photographic printing paper or a photographic film is nipped and conveyed.

According to the present embodiment, imparting and releasing of nipping force to conveyance rollers, and mounting and removal of conveyance rollers can be effected by a swinging operation of a mounting lever. Further, an excellent effect is obtained that the mounting lever is provided so as to abut against and lift up the cover in a state in which the lever is set upright and nipping force imparted between conveyance rollers has been released, thereby reliably preventing a photosensitive material from being mistakenly processed in a state in which no nipping force is imparted between conveyance rollers.

[Fifth Embodiment]

Figure 19:
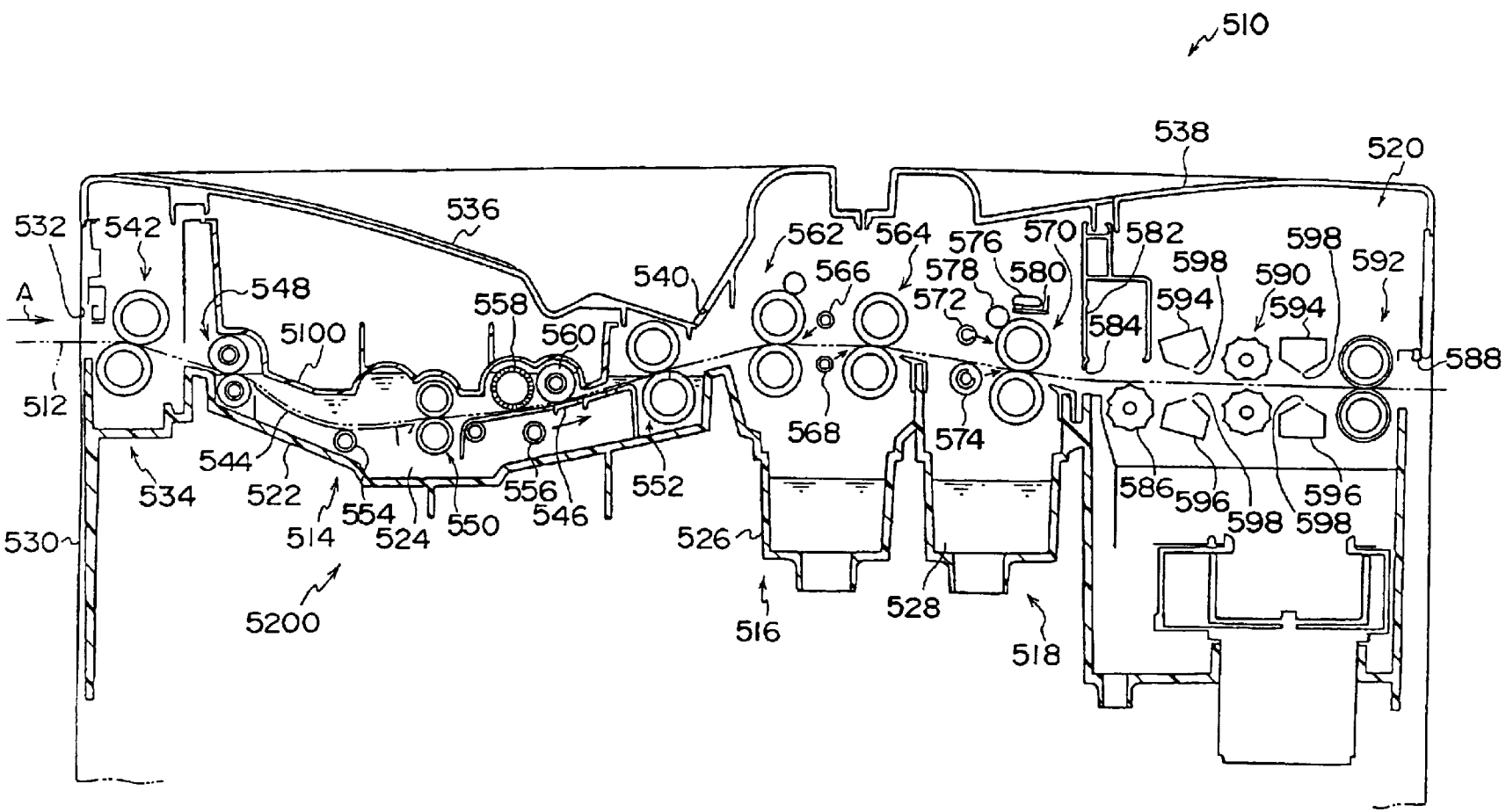
FIG. 19 is a schematic structural diagram of a PS plate processor according to a fifth embodiment of the present invention.
Figure 20:
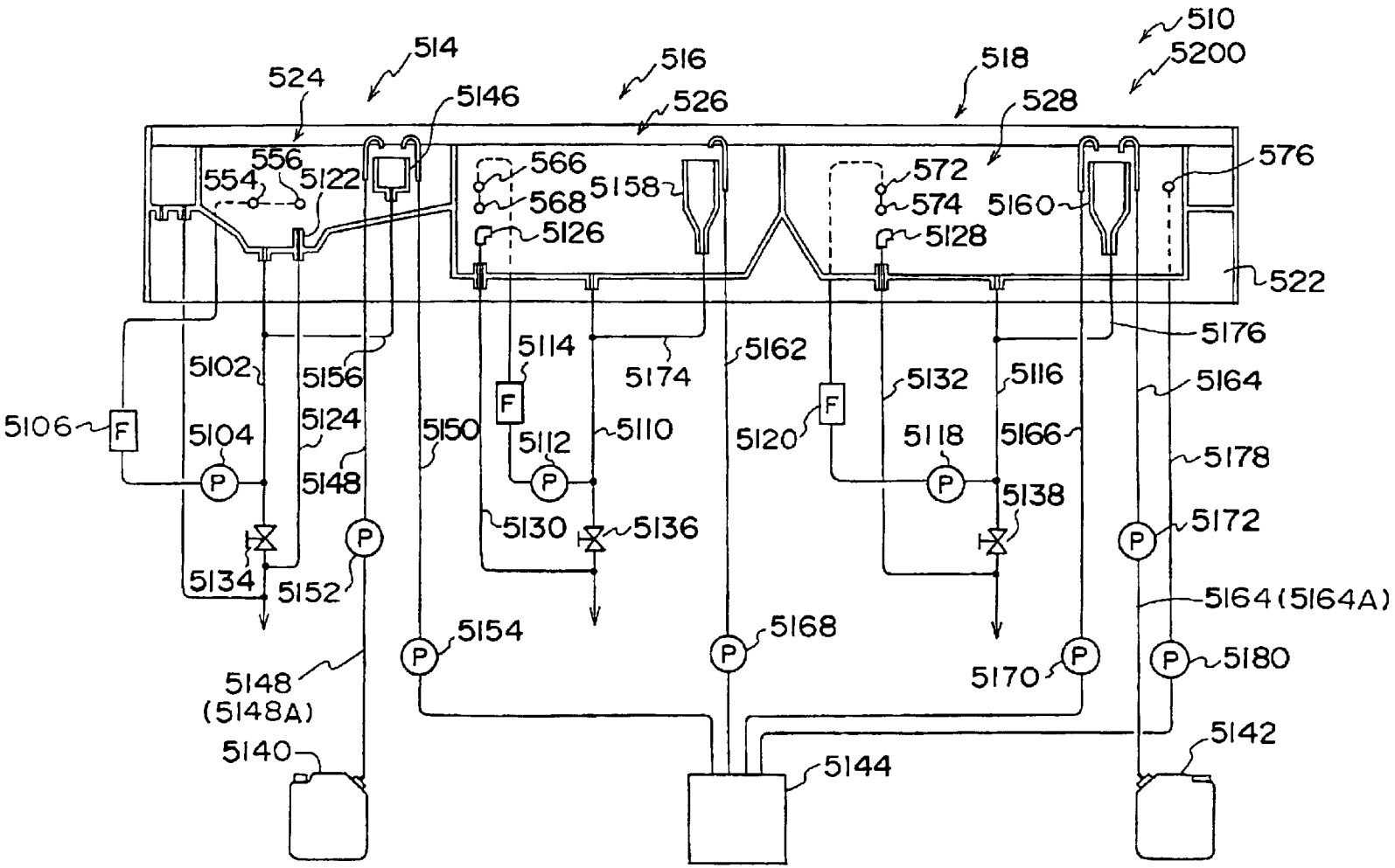
FIG. 20 is a schematic diagram showing a pipeline in which circulation of a processing solution and replenishment of a replenisher are carried out, of the PS plate processor according to the fifth embodiment.

Next, a fifth embodiment of the present invention will be described with reference to the attached drawings. FIG. 19 schematically shows the structure of a photosensitive planographic printing plate processor (hereinafter referred to as a "PS plate processor 510") based on a photosensitive material processing apparatus of the present embodiment.

The fifth embodiment is similar to the aforementioned first embodiment. Therefore, only structures and operation different from those of the first embodiment will be described, and the same structure sand operation as those of the first embodiment will be basically omitted.

The PS plate processor 510 based on the present embodiment is noticeably different from the PS plate processor 110 of the first embodiment in an advantageous feature that mounting of a replenisher case filled with a replenisher is facilitated and remaining of a liquid in piping or in a replenisher case is prevented. A characteristic mechanism of supplying a replenisher will be hereinafter described.

In the PS plate processor 510 of the present embodiment, as shown in FIG. 19, a processing tank 522 is disposed at an upper side of the processor and processing sections from a developing section 514 to a drying section 520, in which a PS plate 512 is processed while being conveyed, are provided in the processing tank 522. That is, a PS plate processing section 5200, in which the PS plate 512 is processed with a processing solution and subjected to drying processing while being conveyed, is disposed at an upper side of the processor.

Figure 21:
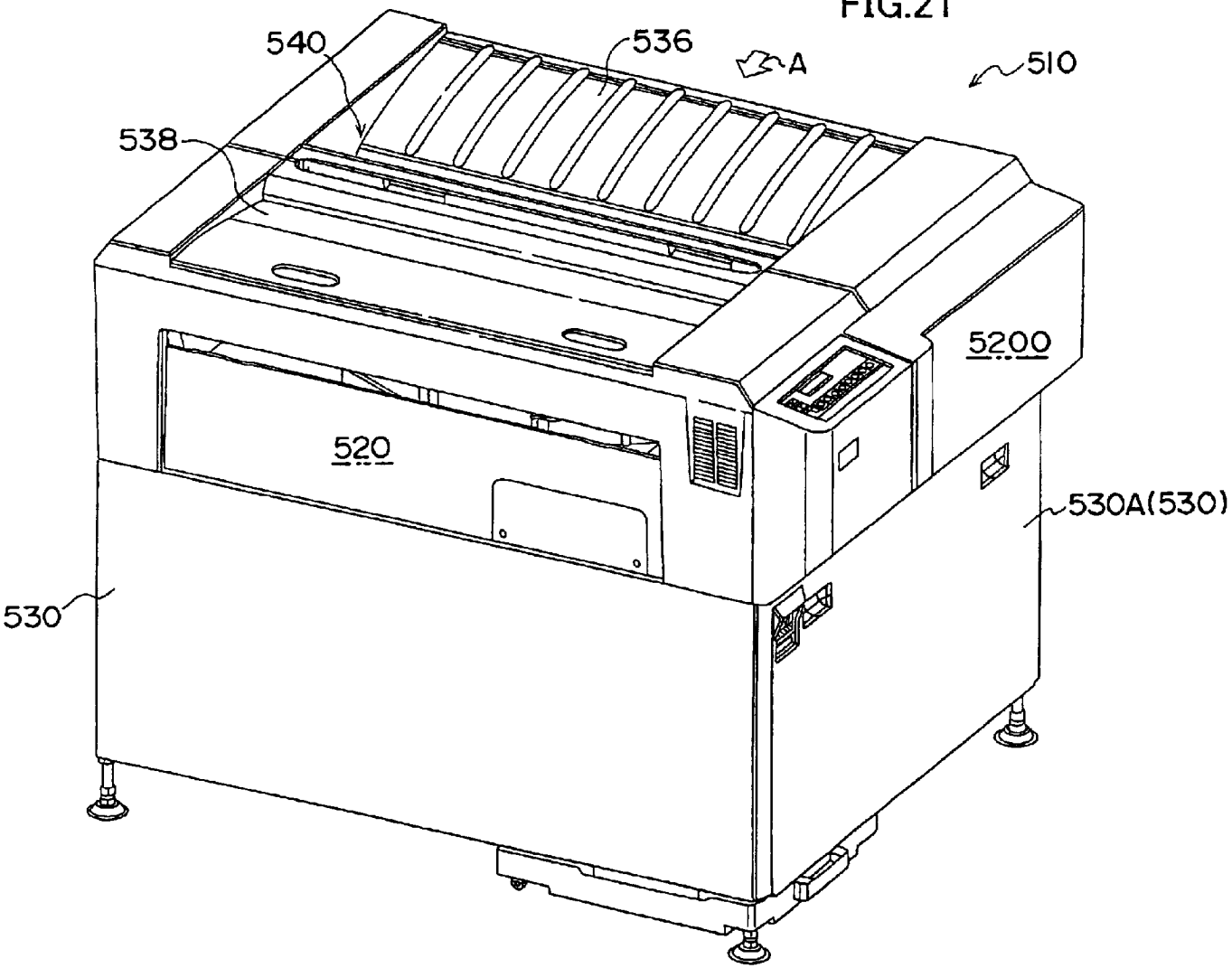
FIG. 21 is a perspective view which schematically shows an exterior of the PS plate processor according to the fifth embodiment.
Figure 22:
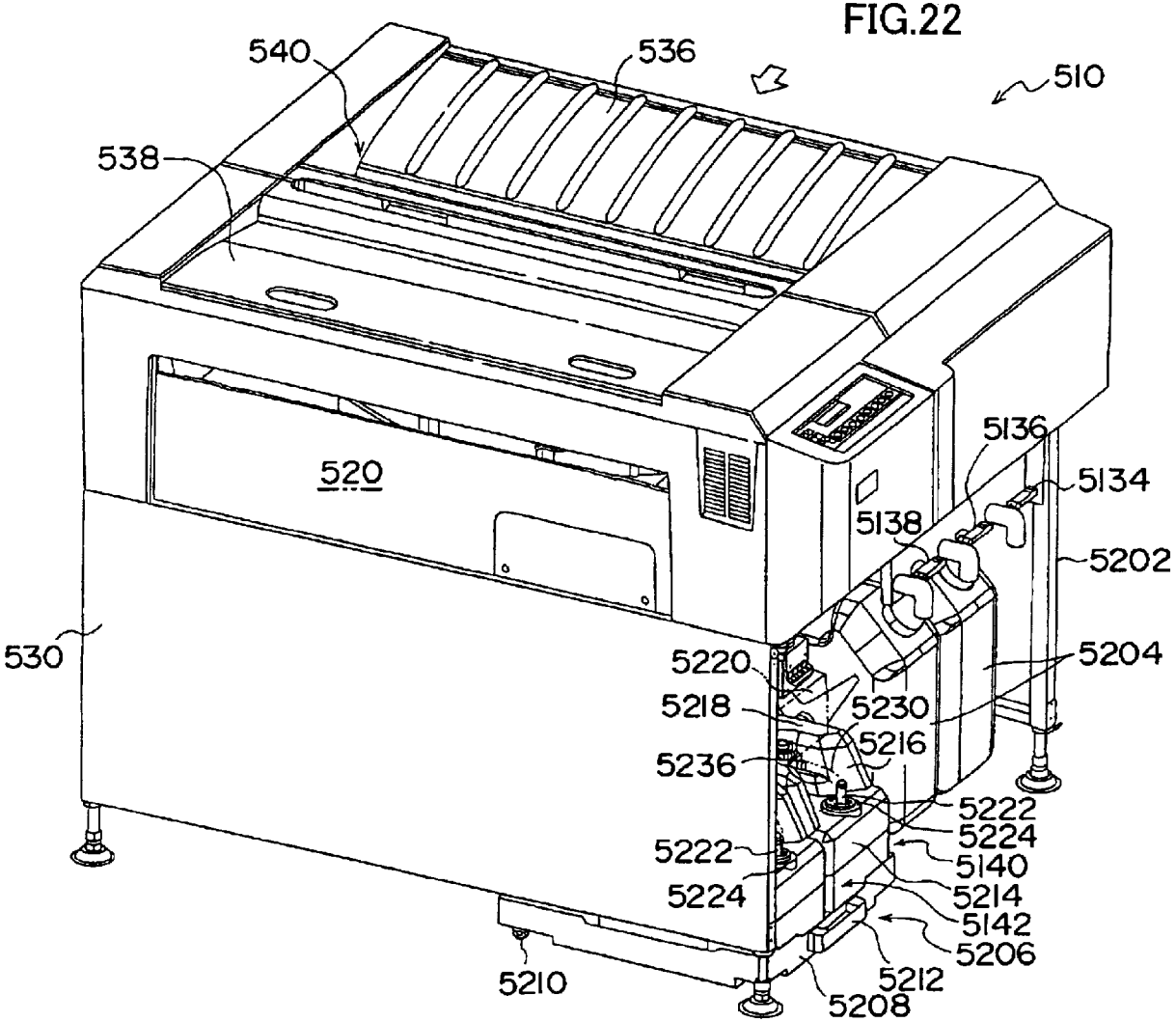
FIG. 22 is a perspective view which schematically shows the PS plate processor of the fifth embodiment in a state in which an interior of an apparatus casing is opened.
Figure 23:
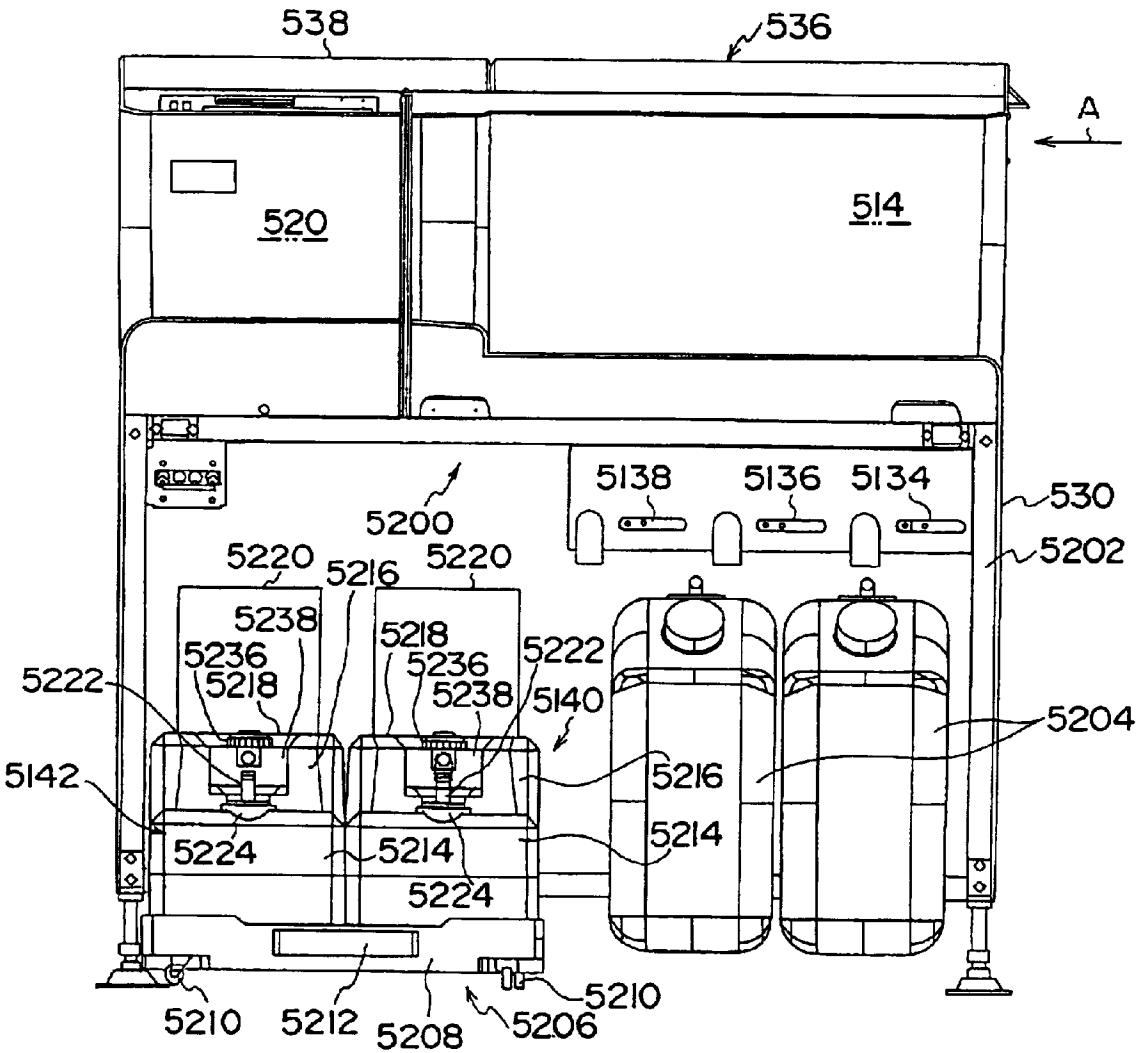
FIG. 23 is a side view which schematically shows the PS plate processor of the fifth embodiment in a state in which an interior of the apparatus casing is opened.

As shown in FIGS. 21 to 23, the PS plate processor 510 is enclosed by an outer plate panel 530 and includes an apparatus casing 5202 above which the PS plate processing section 5200 is provided. Further, one side of the outer plate panel 530 (hereinafter referred to as an "outer plate panel 530A" shown in FIG. 21) in the widthwise direction orthogonal to the conveying direction of the PS plate 512 is mounted in a removable manner. FIGS. 22 and 23 each show a state in which the outer plate panel 530A is removed.

As shown in FIGS. 22 and 23, in the PS plate processor 510, the interior of the apparatus casing 5202 at the lower side of the processor is opened by removing the outer plate panel 530A.

In the PS plate processor 510, waste liquid tanks 5204, in which a developer discharged from a developing tank 524, and the like are recovered, are loaded in the apparatus casing 5202. Further, a trolley 5206 is mounted within the apparatus casing 5202. In the PS plate processor 510, for example, two waste liquid tanks 5204 are accommodated at the side of the developing tank 524 and the trolley 5206 can be mounted at the side of the drying section 520.

Figure 24:
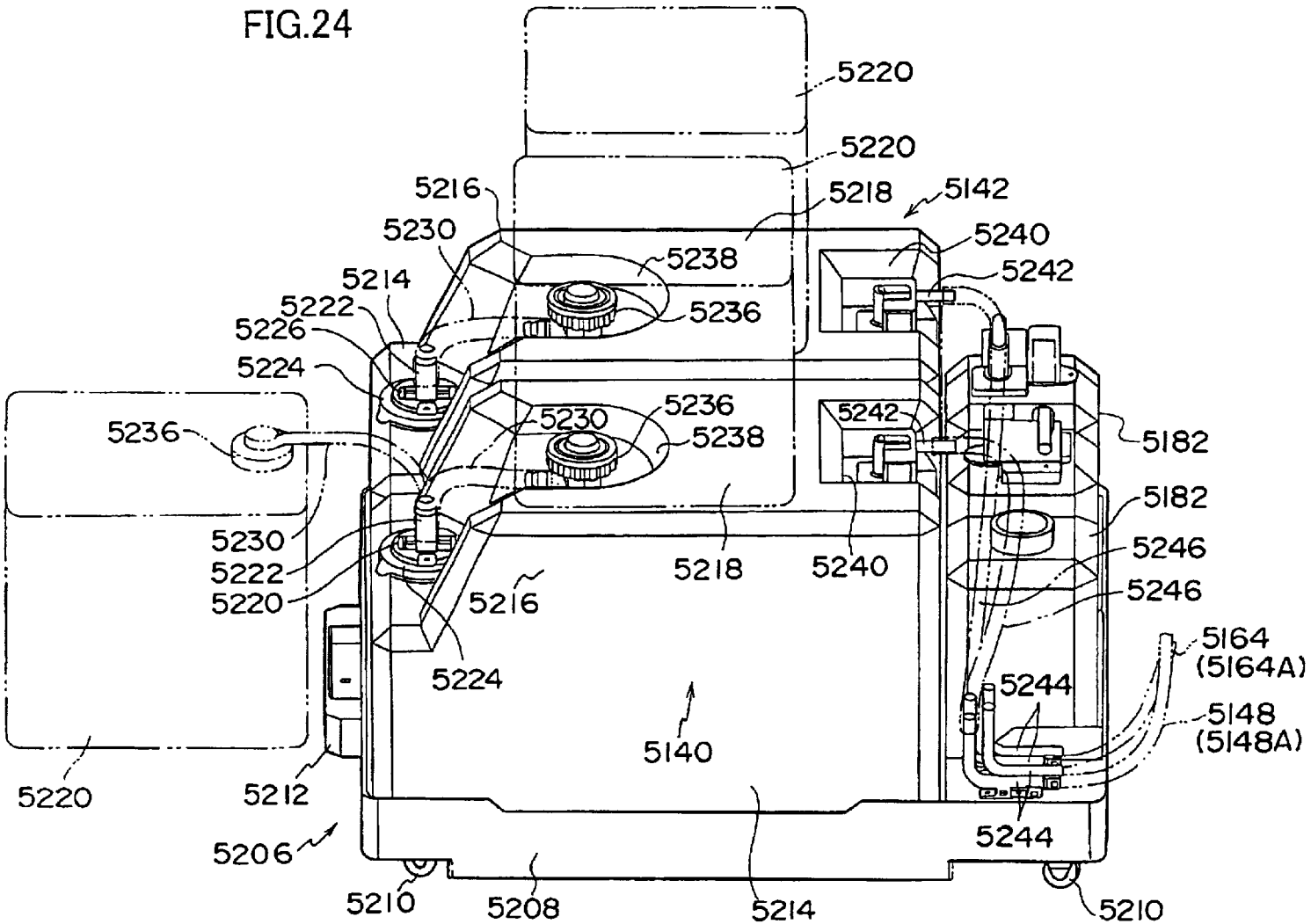
FIG. 24 is a perspective view which schematically shows a trolley and replenisher tanks mounted thereon in the fifth embodiment.

As shown in FIG. 24, the trolley 5206 includes a base 5208 having a substantially rectangular configuration when seen from the top. Casters 5210 are mounted respectively at four corners of the base 5208 and the trolley 5206 is movable by the casters 5210 on a floor surface on which the PS plate processor 510 is installed. Further, a grip 5212 is formed on one side of the base 5210 in the trolley 5206, and the trolley 5206 can be moved by holding the grip 5212 between a position at which it is mounted within the apparatus casing 5202, and a position at which it is pulled out from the apparatus casing 5202.

Replenisher tanks 5140 and 5142 are mounted on the base 5208 of the trolley 5206. The replenisher tanks 5140 and 5142 are disposed within the apparatus casing 5202 in a state in which the trolley 5206 is mounted within the apparatus casing 5202. In addition to the replenisher tanks 5140 and 5142, a chemicals tank 5182 in which chemicals used by the PS plate processor 510 are accommodated can be mounted on the base 5208 of the trolley 5206.

The replenisher tanks 5140 and 5142 are each structured in such a manner that a tank portion 5214 in which a replenisher (developer replenisher or a gum solution replenisher) is accommodated, and a mounting portion 5216 having a substantially trapezoidal configuration when seen from the side and disposed at the upper side of the tank portion 5214, are integrally formed. The replenisher tanks 5140 and 5142 have the same shape, and the replenisher tank 5140 will be mainly described hereinafter. A developer replenisher and a gum solution replenisher are accommodated in the replenisher tanks 5140 and 5142, respectively.

An upper surface 5218 of the mounting portion 5216 is made flat, and a cubitainer 5220, that is, a replenisher case filled with a replenisher, is mounted on the upper surface 5218.

The cubitainer 5220 is formed in such a manner that a hermetically sealed container made of resin is accommodated in an outer box made of corrugated fiberboard or the like, and a replenisher (developer replenisher or gum solution replenisher) is filled in the hermetically sealed container made of resin.

A connecting nozzle 5222 is provided at an upper side of the tank portion 5214 in the replenisher tank 5140. The connecting nozzle 5222 is mounted to a holder 5224 provided on the upper surface of the tank portion 5214.

The holder 5224 is mounted at an end on the upper surface of the tank portion 5214, and the replenisher tank 5140 is mounted on the base 5208 of the trolley 5206 so that the holder 5224 and the grip 5212 are disposed on the same side surface.

Figure 25:
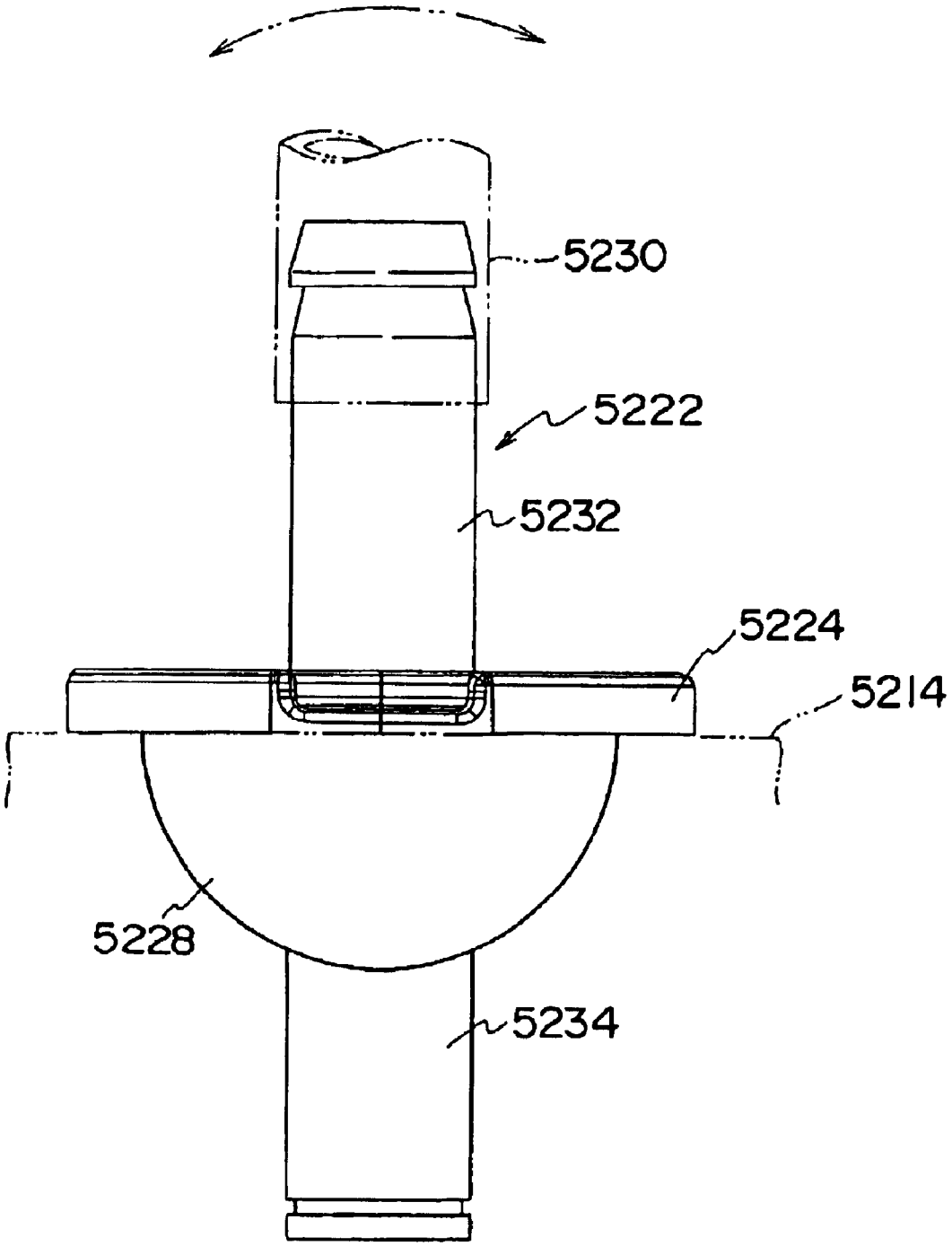
FIG. 25 is a perspective view which schematically shows a holder and a nozzle according to the fifth embodiment, seen from one side (the upper side) of the holder.
Figure 26:
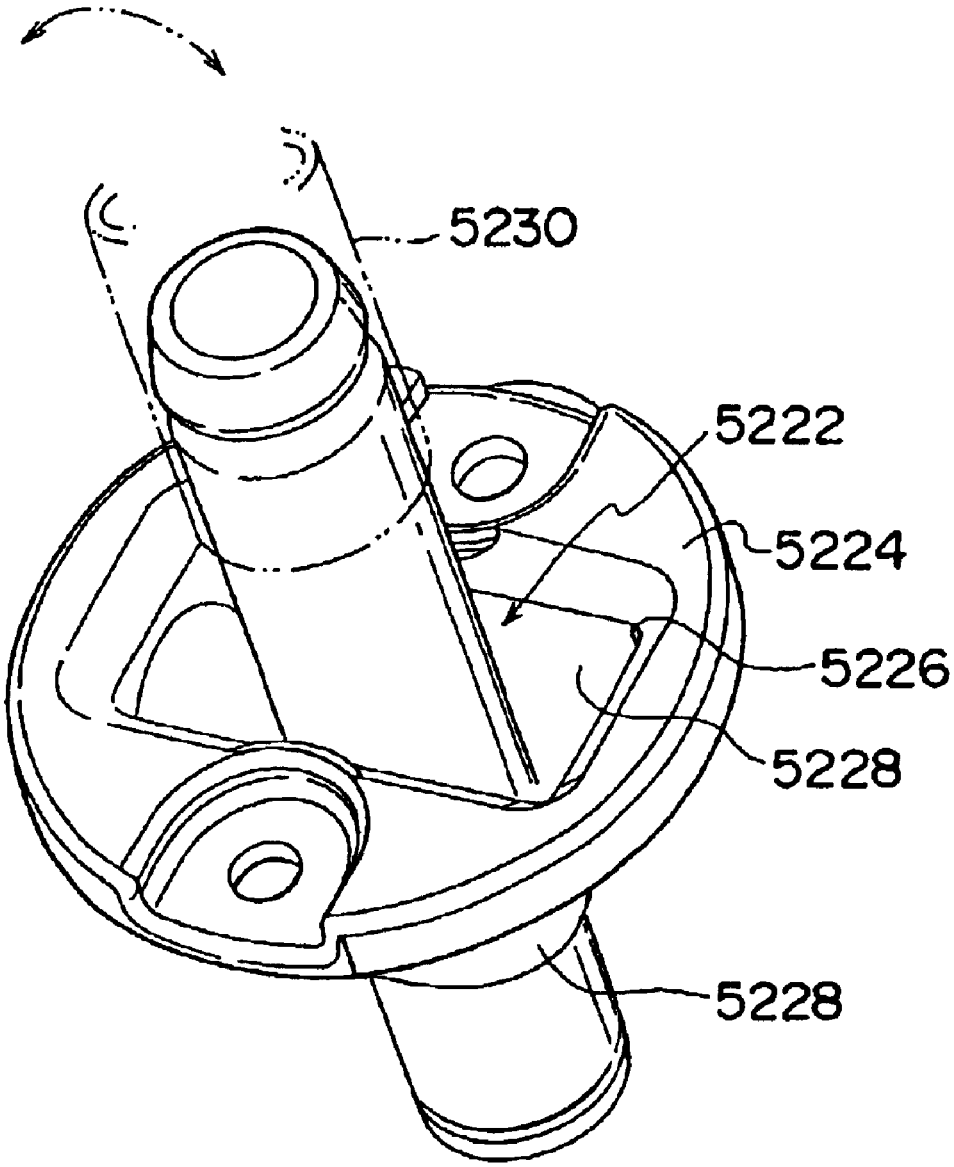
FIG. 26 is a perspective view which schematically shows a holder and a nozzle according to the fifth embodiment, seen from another side (the lower side) of the holder.
Figure 27:
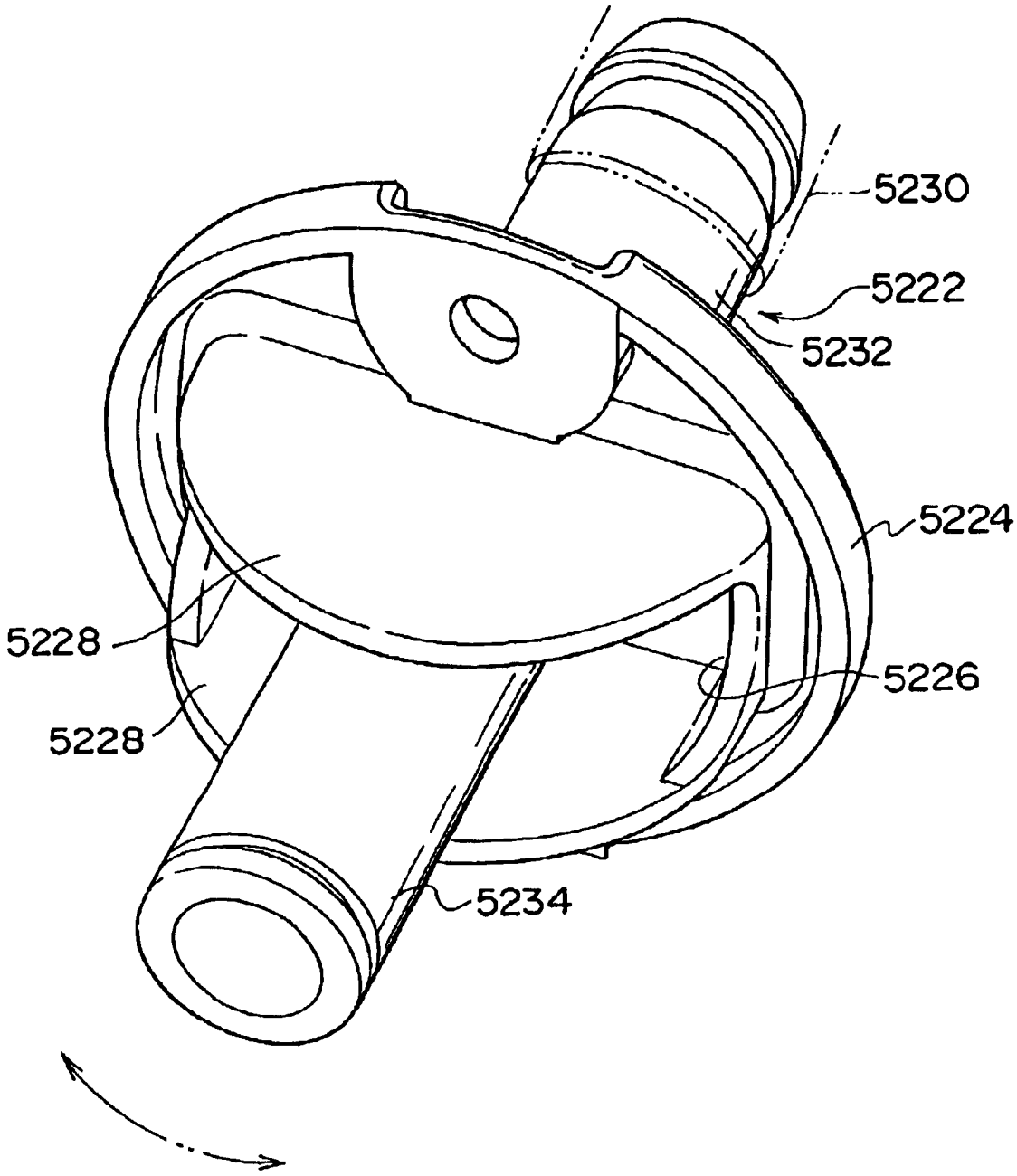
FIG. 27 is a schematic side view of the holder and the nozzle according to the fifth embodiment.

As shown in FIGS. 25 to 27, the holder 5224 is formed in the shape of a substantially circular plate when seen from the top, and a mounting hole 5226 (not shown in FIG. 25) for the connecting nozzle 5222 is formed at the central portion of the holder 5224. As shown in FIG. 24, the holder 5224 is mounted on the tank portion 5214 so that one longitudinal-direction end of the mounting hole 5226 is disposed at the side of the grip 5212 of the trolley 5206 and the other end of the mounting hole is disposed at the side of the mounting portion 5216.

As shown in FIGS. 25, 26 and 27, guides 5228 which makes a pair are provided so as to protrude from the holder 5224 toward the interior of the tank portion 5214. The guides 5228 are provided at both sides of the mounting hole 5226 in the widthwise direction thereof and each formed in the shape of a semicircular plate. That is, the guides 5228 are formed in a pair with the mounting hole 5226 interposed therebetween.

Further, as shown in FIGS. 25 to 27, the connecting nozzle 5222 has a stick-shaped configuration in which a conduit is formed inside thereof. One end of the connecting nozzle 5222 is formed as a connecting portion 5232 which is inserted in and connected to a flexible tube 5230. Moreover, as shown in FIG. 25, a portion of the connecting nozzle 5222 (from the intermediate portion to an end opposite to the connecting portion 5232) is formed as a diameter enlarged portion 5234.

The outer diameter of the connecting nozzle 5222 at the side of the connecting portion 5232 is smaller than an open width of the mounting hole 5226 formed in the holder 5224, and the outer diameter thereof at the side of the diameter enlarged portion 5234 is larger than the open width of the mounting hole 5226. Further, the outer diameter of the flexible tube 5230 is larger than the open width of the mounting hole 5226 of the holder 5224, and a space between the guides 5228 formed in a pair in the holder 5224 is slightly larger than the outer diameter of the diameter enlarged potion 5234 of the connecting nozzle 5222.

The connecting nozzle 5222 is inserted in the mounting hole 5226 of the holder 5224 from the side of the connecting portion 5232 so that the connecting portion 5232 protrudes upward from the tank portion 5214, and the flexible tube 5230 is connected to the connecting portion 5232.

The connecting nozzle 5222 is provided so as not to be pulled out from the mounting hole 5226, due to the flexible tube 5230 being connected thereto in a state in which the connecting nozzle 5222 is inserted in the mounting hole 5226.

Further, the connecting nozzle 5222 is movable in the longitudinal direction of the mounting hole 5226 because the diameter enlarged portion 5234 is disposed between the pair of guides 5228. Thus, the connecting nozzle 5222 is swingable along the longitudinal direction of the mounting hole 5226. That is, inclination of the connecting nozzle 5222 within the mounting hole 5226 in the widthwise direction thereof is limited and the connecting portion 5232 protruding upward from the holder 5224 can be inclined toward the mounting portion 5216 and toward an outer side of the PS plate processor 510 opposite to the mounting portion 5216.

As shown in FIG. 24, a cap 5236 is mounted at the cubitainer 5220 at an outlet opening of a replenisher, and the flexible tube 5230 is connected to the cap 5236. A replenisher stored in the cubitainer 5220 flows into the replenisher tank 5140 by connecting the flexible tube 5230 to the cap 5236 and inverting the cubitainer 5220 with the cap 5236 turned downward at a position higher than the tank portion 5214 of the replenisher tank 5140.

As shown in FIGS. 23 and 24, a concave portion 5238, which is made semicircular when seen from the top, is formed in the mounting portion 5216 of the replenisher tank 5140 (5142) at the side of the connecting nozzle 5222. When the cubitainer 5220 is mounted on the upper surface 5218 of the mounting portion 5216 with the cap 5236 turned downward, the cap 5236 is fitted in the concave portion 5238.

Further, as shown in FIG. 24, a substantially rectangular concave portion 5240 is formed in the mounting portion 5216 of the replenisher tank 5140 at a side opposite to the connecting nozzle 5222, and a vacuum nozzle 5242 is provided in the concave portion 5240. Moreover, a plurality of elbows 5244 each having an internal conduit bent into a substantially L-shaped configuration are mounted to the base 5208 of the trolley 5206.

The vacuum nozzles 5242 of the replenisher tank 5140 are each connected to an end of the elbow 5244 by piping 5246. Further, piping 5148 (5148A) connected to an input side of a replenisher pump 5152 and piping 5164 (5164A) connected to an input side of a replenisher pump 5172 are connected respectively to the elbows 5244. When the replenisher pump 5152 is activated, a developer replenisher is pumped out from the replenisher tank 5140. Further, when the replenisher pump 172 is activated, a gum solution replenisher is pumped out from the replenisher tank 5142.

The piping 5148A and the piping 5164A which connect the elbows 5244 to the replenisher pumps 5152 and 5172 each have predetermined slackness. Therefore, when the trolley 5206 is moved from the position at which the trolley is mounted within the apparatus casing 5202 to the position to which the trolley is pulled out from the apparatus casing 5202, there is no possibility that the piping 5148A and 5164A may be forcedly pulled or movement of the trolley 5206 may be hindered.

In the PS plate processor 510, replenishment of a replenisher is carried out in such a manner that the replenisher pumps 5152 and 5154 are activated in accordance with the amount of PS plates 512 to be processed and a developer replenisher and water used to dilute the developer at a predetermined ratio are supplied to the developing tank 524. Further, in the PS plate processor 510, replenishment of a gum solution is carried out in such a manner that fresh water of washing water is replenished to the washing tank 526, and the replenisher pumps 5172 and 5170 are activated to supply a gum solution replenisher and water used to dilute the gum solution at a predetermined ratio, to the desensitizing tank 528.

When the developer replenisher is supplied to the developing tank 524 and the gum solution replenisher is supplied to the desensitizing tank 528, the developer replenisher within the replenisher tank 5140 and the gum solution replenisher within the replenisher tank 5142 are reduced. Accordingly, the developer replenisher and the gum solution replenisher each need to be supplied.

In the PS plate processor 510, when the developer replenisher and the gum solution replenisher are supplied for the replenisher tanks 5140 and 5142, respectively, first, the outer plate panel 530A is removed to open the interior of the apparatus casing 5202. Thereafter, the trolley 5206 mounted in the apparatus casing 5202 is pulled out from the apparatus casing 5202.

As a result, the replenisher tanks 5140 and 5142, and the cubitainer 5220 which are loaded in the PS plate processor 510, can be pulled out from the processor, and the cubitainer 5220 in an empty state can be easily removed.

When a replenisher is supplied to the replenisher tank 5140, the cubitainer 5220 in an empty state is removed and thereafter, the flexible tube 5230 connected to the connecting nozzle 5222 of the replenisher tank 5140 is connected to the cap 5236 of a new cubitainer 5220. As a result, a replenisher can be made to flow from the new cubitainer 5220 into the replenisher tank 5140.

Subsequently, the cubitainer 5220 is inclined and inverted, and then placed on the upper surface 5218 of the mounting portion 5216 formed at the upper side of the replenisher tank 5140. As a result, a replenisher is made to flow from the cubitainer 5220 into the replenisher tank 5140.

At this time, the connecting nozzle 5222 moves within the mounting hole 5226 of the holder 5224 along the longitudinal direction of the mounting hole 5226 correspondingly to movement of the flexible tube 5230 which connects the cap 5236 of the cubitainer 5220 and the connecting nozzle 5222 of the replenisher tank 5140, and the connecting nozzle 5222 is further inclined, thereby preventing any forced bending or breaking in the flexible tube 5230.

Accordingly, it is possible to reliably prevent a state in which a replenisher remains in the cubitainer 5220 or a replenisher does not run down from the cubitainer 5220.

The cubitainer 5220 is thus placed on the replenisher tank 5140, and thereafter, the trolley 5206 is moved into the apparatus casing 5202 and the cubitainer 5220 is, together with the replenisher tank 5140, loaded in the PS plate processor 510, and the interior of the processor is closed by the outer plate panel 530A.

A replenisher runs down from the cubitainer 5220 placed on the replenisher tank 5140 in accordance with the quantity of a replenisher in the replenisher tank 5140. That is, when the liquid surface of the replenisher in the replenisher tank 5140 rises up and an opening at an end of the connecting nozzle 5222 at the side of the diameter enlarged portion 5234 contacts the liquid surface of the replenisher, flowing of the replenisher stops. Accordingly, the replenisher can be supplied from the cubitainer 5220 in accordance with the quantity of a replenisher in the replenisher tank 5140.

As described above, in the PS plate processor 510, the replenisher tanks 5140 and 5142, and the cubitainer 5220 filled with a replenisher to be supplied to each of the replenisher tanks 5140 and 5142 are placed on the trolley 5206 and loaded in the apparatus casing 5202. Accordingly, the cubitainer 5220 can be handled outside the processor and an operation of supplying a developer replenisher and a gum solution replenisher to the replenisher tanks 5140 and 5142 is extremely facilitated.

Further, the connecting nozzle 5222 provided in each of the replenisher tanks 5140 and 5142 is made swingable in a direction to which the cubitainer 5220 is inclined. Therefore, there is no possibility that the flexible tube 5230 which connects each of the replenisher tanks 5140 and 5142 to the corresponding cubitainer 5220 may be forcedly bent or broken. As a result, it is possible to reliably prevent a state in which a developer replenisher or a gum solution replenisher may remain in the cubitainer due to breaking or forced bending of the flexible tube 5230.

Accordingly, when the cubitainer 5220 is replaced, an operation of flowing a developer replenisher or a gum solution replenisher which remains in the cubitainer 5220, into the replenisher tanks 5140 and 5142, becomes unnecessary, and a supplying operation of a replenisher can be facilitated still further.

The aforementioned embodiment is not provided so as to restrict the structure of the present invention. In the present embodiment, the PS plate processor 510 for processing a PS plate was described as a photosensitive material processing apparatus, but the present invention is not limited to the same and can be applied to a photosensitive material processing apparatus having any suitable structure, in which various types of photosensitive material such as a photographic film or photographic printing paper are processed with a processing solution.

According to the present embodiment, a replenisher tank and a replenisher case filled with a replenisher to be supplied to the replenisher tank are mounted together on a trolley and can be pulled out from an apparatus casing, thereby facilitating an operation of supplying a replenisher for the replenisher tank. Further, in the present invention, a nozzle provided in the replenisher tank is made swingable. As a result, no breaking in piping connected to the replenisher case is caused and all the replenisher within the replenisher case can be reliably made to run down into the replenisher tank.

What is claimed is:

1. A photosensitive material processing apparatus comprising:

first blowing means provided adjacent to a photosensitive material conveyance path at a section thereof along which a photosensitive material is conveyed diagonally downward with respect to a surface of a processing solution while being immersed in the processing solution stored in a processing tank, the first blowing means jetting out the processing solution supplied thereto along a direction orthogonal to a conveying direction of the photosensitive material;

second blowing means provided adjacent to the photosensitive material conveyance path at a section thereof along which the photosensitive material is conveyed diagonally upward with respect to the surface of a processing solution while being immersed in a processing solution stored in the processing tank, so that a longitudinal direction of the second blowing means coincides with a widthwise direction of the photosensitive material, the second blowing means jetting out the processing solution supplied thereto, from holes formed along the longitudinal direction of the second blowing means toward a downstream side in the conveying direction of the photosensitive material; and circulating means for circulating a processing solution by sucking in, the processing solution within the processing tank, from a suction hole formed at a predetermined position in the processing tank and supplying the sucked processing solution to the first blowing means and the second blowing means.

2. The photosensitive material processing apparatus of claim 1, wherein the suction hole is provided on a bottom portion of the processing tank between the first and second blowing means.

3. The photosensitive material processing apparatus of claim 1, wherein the holes in the second blowing means open diagonally downward with respect to the horizontal plane.

4. The photosensitive material processing apparatus of claim 1, wherein when temperature adjustment means is provided for maintaining the temperature of the processing solution in a predetermined temperature range, flow-rate control means is also provided for regulating the quantity of processing solution jetted out from the first blowing means, to be larger than the quantity of processing solution jetted out from the second blowing means.

5. A photosensitive material processing apparatus comprising:

a photosensitive material processing section which is provided above an apparatus casing and in which a photosensitive material is processed with a processing solution, or a photosensitive material is processed with a processing solution and subjected to drying processing;

a trolley which can be moved between a position within a space provided in the apparatus casing and below the photosensitive material processing section, and a position to which the trolley is pulled out from the apparatus casing;

a replenisher tank disposed on the trolley and accommodating a replenisher of a processing solution used for processing of the photosensitive material;

a replenisher case to contain the replenisher which is to be accommodated by the replenisher tank, the replenisher case being removably attached to the replenisher tank;

a replenisher pump used to supply a replenisher filled in the replenisher tank to a processing tank.

6. The photosensitive material processing apparatus of claim 5, wherein a mounting portion, in which the replenisher case is mounted, is formed on the replenisher tank, and the replenisher case can be inserted between the replenisher tank and the photosensitive material processing section when the trolley is moved to a predetermined position in the apparatus casing.

7. The photosensitive material processing apparatus of claim 5, wherein a nozzle provided in the replenisher tank and connected to an outlet opening of the replenisher case by a flexible tube is supported swingably by a holder provided in an inlet opening of the replenisher tank.

8. The photosensitive material processing apparatus of claim 5, wherein the replenisher case is attached to the replenisher tank by a flexible tube.

9. The photosensitive material processing apparatus of claim 5, wherein the replenisher tank has a nozzle which is operative to swivel and is in communication with the replenisher case.

10. The photosensitive material processing apparatus of claim 5, wherein the replenisher case has a substantially rectangular box-shaped configuration.

* * * * *